US006374648B1

(12) United States Patent
Mitsuyama

(10) Patent No.: US 6,374,648 B1
(45) Date of Patent: Apr. 23, 2002

(54) COMMODITY ANTITHEFT IMPLEMENT

(76) Inventor: Masuhiro Mitsuyama, 1071, Kinugasa, Wake-cho, Wako-gun, Okayama (JP)

( * ) Notice: Subject to any disclaimer, the term of this patent is extended or adjusted under 35 U.S.C. 154(b) by 0 days.

(21) Appl. No.: 09/597,768

(22) Filed: Jun. 20, 2000

(30) Foreign Application Priority Data

Jun. 21, 1999 (JP) ..... 11-212589
Oct. 19, 1999 (JP) ..... 11-338353
May 22, 2000 (JP) ..... 2000-190291

(51) Int. Cl.[7] ..... B65D 85/67

(52) U.S. Cl. ..... 70/57.1; 70/58; 70/60; 206/308.1; 206/308.2

(58) Field of Search ..... 70/57.1, 58, 60; 206/307, 308.1, 308.2, 387.1, 387.11

(56) References Cited

U.S. PATENT DOCUMENTS 4,469,225 A * 9/1984 Takahashi ..... 206/387.1
4,928,825 A * 5/1990 Hehn ..... 206/387.13
5,158,176 A * 10/1992 Wolf ..... 206/751
5,446,618 A * 8/1995 Tetsuya et al. ..... 361/683
5,499,714 A * 3/1996 Konno ..... 206/387.13
5,503,272 A * 4/1996 Morita ..... 206/387.1
5,518,116 A * 5/1996 Morita ..... 206/387.1

* cited by examiner

*Primary Examiner*—William A. Cuchlinski, Jr.
*Assistant Examiner*—Marthe Y. Marc-Coleman
(74) *Attorney, Agent, or Firm*—Wenderoth, Lind & Ponack, L.L.P.

(57) ABSTRACT

An economic commodity antitheft implement that can securely prevent a theft of a commodity, and can reduce the number of magnetic detection tags used for preventing a theft of a commodity. The implement includes a case for receiving a commodity and is formed of a box body and a cover body provided on the box body via a hinge so as to open and close an opening portion of the box body. Parallel arranged fitting grooves are formed when the opening portion of the box body is closed, and the fitting grooves are coupled together by a slider inserted over the entire length of the fitting grooves, keeping the box body and the cover body in a locked state. Unless the slider is drawn out of the fitting grooves, the commodity received in the case is not taken out of the case; therefore, it is possible to prevent commodity theft.

12 Claims, 60 Drawing Sheets

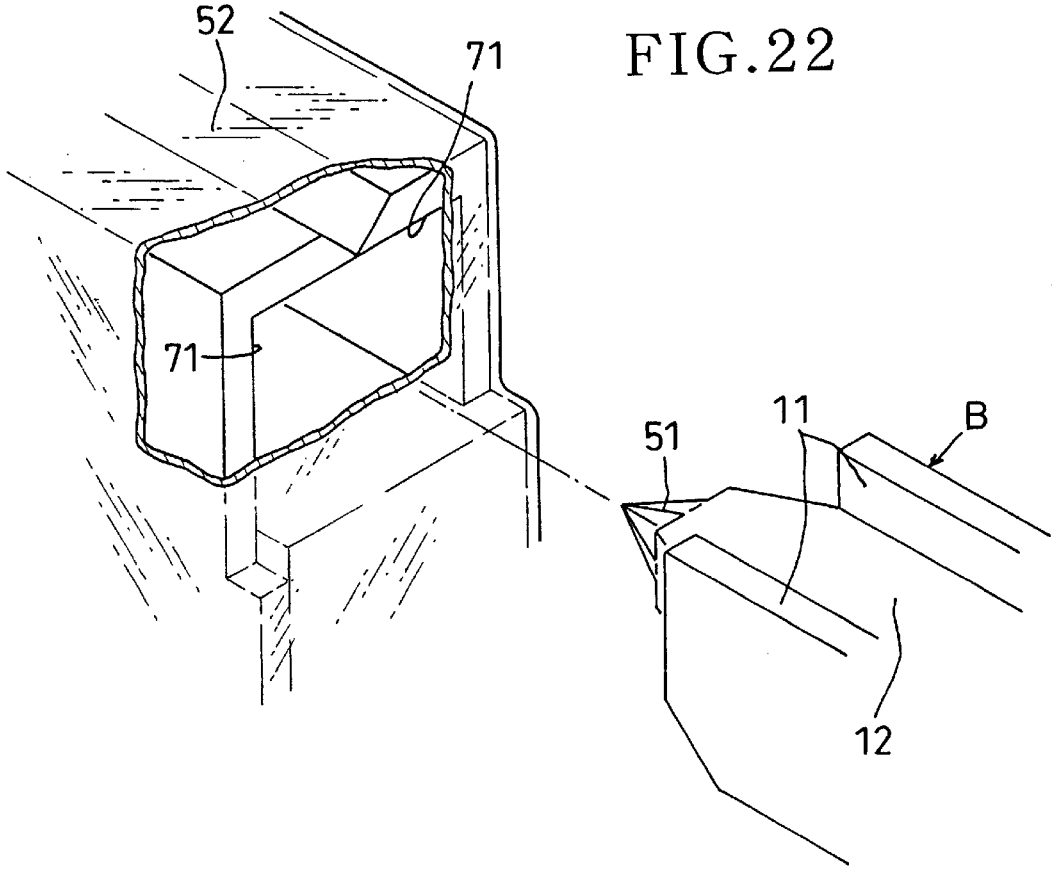
FIG.22
FIG.23
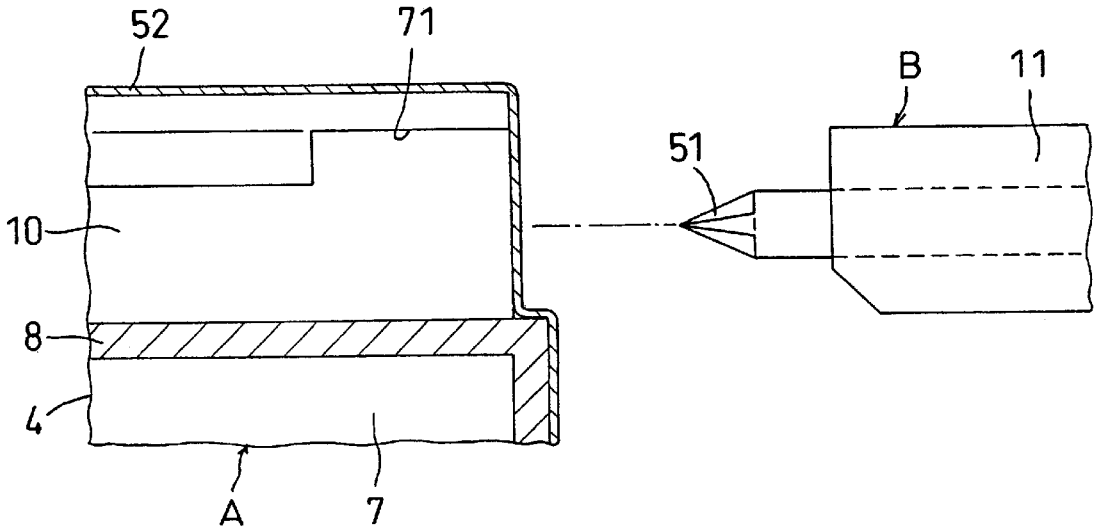

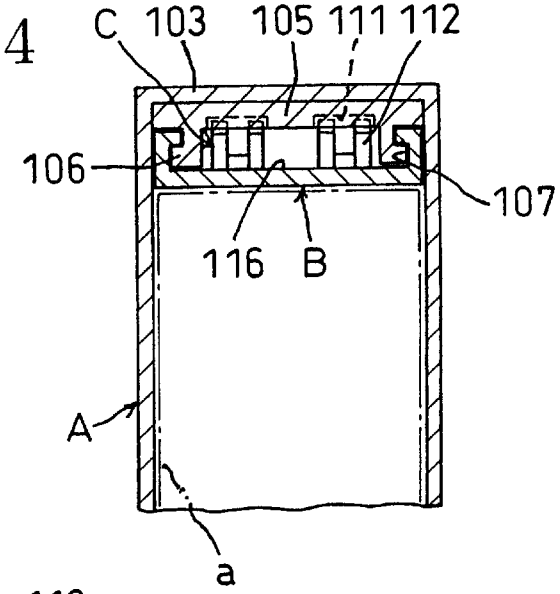
FIG.34
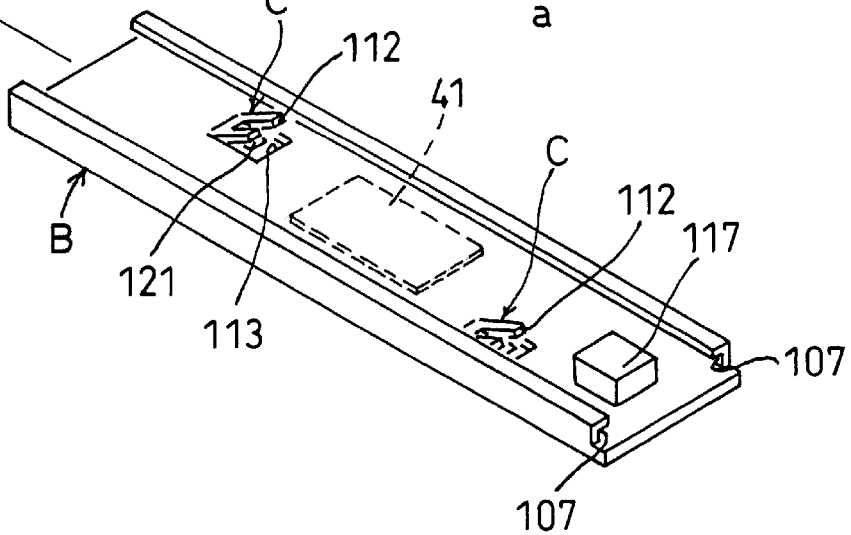
FIG.33
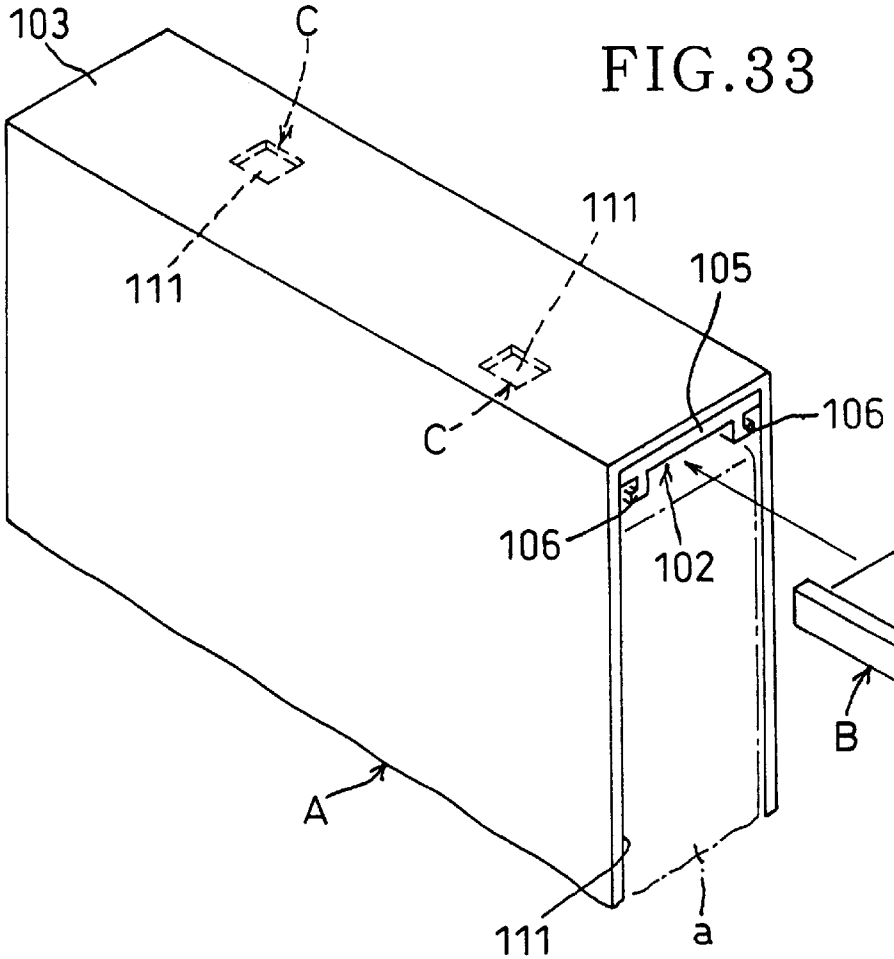

COMMODITY ANTITHEFT IMPLEMENT

BACKGROUND OF THE INVENTION

1. Field of the Invention

The present invention relates to a commodity antitheft implement for a lending service of discs and video tapes recording music and image of CD cassettes, game softwares and the like, and for sales commodities, or various sales commodities such as clothes, accessories, daily necessaries and the like.

2. Description of the Prior Art

In a lending service or sale of the above various sales commodities, it is necessary to take measures for preventing a theft of a commodity.

To give an example, the following method has been employed as a conventional antitheft means. More specifically, as already known, empty cases are arranged and displayed in a shelf of a rental shop, and when a customer takes a displayed empty case of a predetermined rental commodity name out of the shelf and brings it to a counter, a salesperson, who stands by the counter, takes a rental commodity displayed on the empty case out of a storage place, and then, performs a predetermined procedure, and thus, lends the rental commodity to the customer.

In the case where the aforesaid method is employed, the customer does not directly touch the rental commodity with his hand; therefore, it is possible to prevent a theft of a rental commodity.

However, the salesperson selects a rental commodity from the storage place, and must tidily store a great many of rental commodities; for this reason, a remarkable amount of time and labor is necessary. As a result, a problem has arisen such that it is difficult to smoothly perform a lending service, and a wide storage place is required.

On the other hand, a case receiving a rental commodity is displayed on a shelf of a shop, and then, the customer takes a desired rental commodity out of the displayed case and brings it to the counter, and thereafter, performs a rental procedure. By doing so, it is possible to solve the aforesaid problem.

However, the customer directly touches the rental commodity with his hand; for this reason, it is possible to take the rental commodity without permission. As a result, there is a possibility that a theft occurs.

So, in order to prevent a theft of commodity, an antitheft tag having a peculiar ID code is attached to an arbitrary position of rental commodity, and further, a predetermined high frequency electromagnetic field is generated in a gateway of the shop. When the rental commodity goes through the gateway of the shop, a resonance circuit of the ID code resonates so as to transmit a peculiar ID code, and then, the high frequency electromagnetic field modulates, and thereby, a passage of the rental commodity is detected. Then, the salesperson supervises whether the rental commodity has been already lent, or has been taken without permission.

However, in the rental procedure at the counter, unless the above ID code (tag) is shielded by any methods, the following problem arises; more specifically, the rental commodity taken according to the predetermined lending procedure is detected in the same manner as a rental commodity taken without permission.

For this reason, a troublesome work is required to perform a shielding procedure, and in addition, a shield equipment is required; for this reason, there is a problem that a cost greatly increases.

The aforesaid problems are not limited to the above rental commodities, and even if the tag is used for antitheft object commodities of other various articles such as clothes, accessories, daily necessaries and the like, the same problem as above is generated.

OBJECTS OF THE INVENTION

Accordingly, it is an object of the present invention to provide a commodity antitheft implement which can securely prevent theft of a commodity by an extremely simple operation.

Further, another object of the present invention is to provide an economical commodity antitheft implement which has no need to shield the tag because the tag is left at the shop, and can thus reduce usage of tags.

The above and other objects of the present invention will be understood more in detail from the following description with reference to the accompanying drawings showing an illustrative example.

BRIEF DESCRIPTION OF THE DRAWINGS

FIG. 22 is a perspective view showing another example of the fourth embodiment;

FIG. 23 is a longitudinal sectional side view showing principal parts of the fourth embodiment;

FIG. 33 is a perspective view showing another example of guide means;

FIG. 34 is a longitudinal sectional front view showing the guide means;

FIG. 82 is a transverse sectional plan view showing a state in which a fingertip is caught in.

DETAILED DESCRIPTION OF THE PREFERRED EMBODIMENTS

Figure 1:
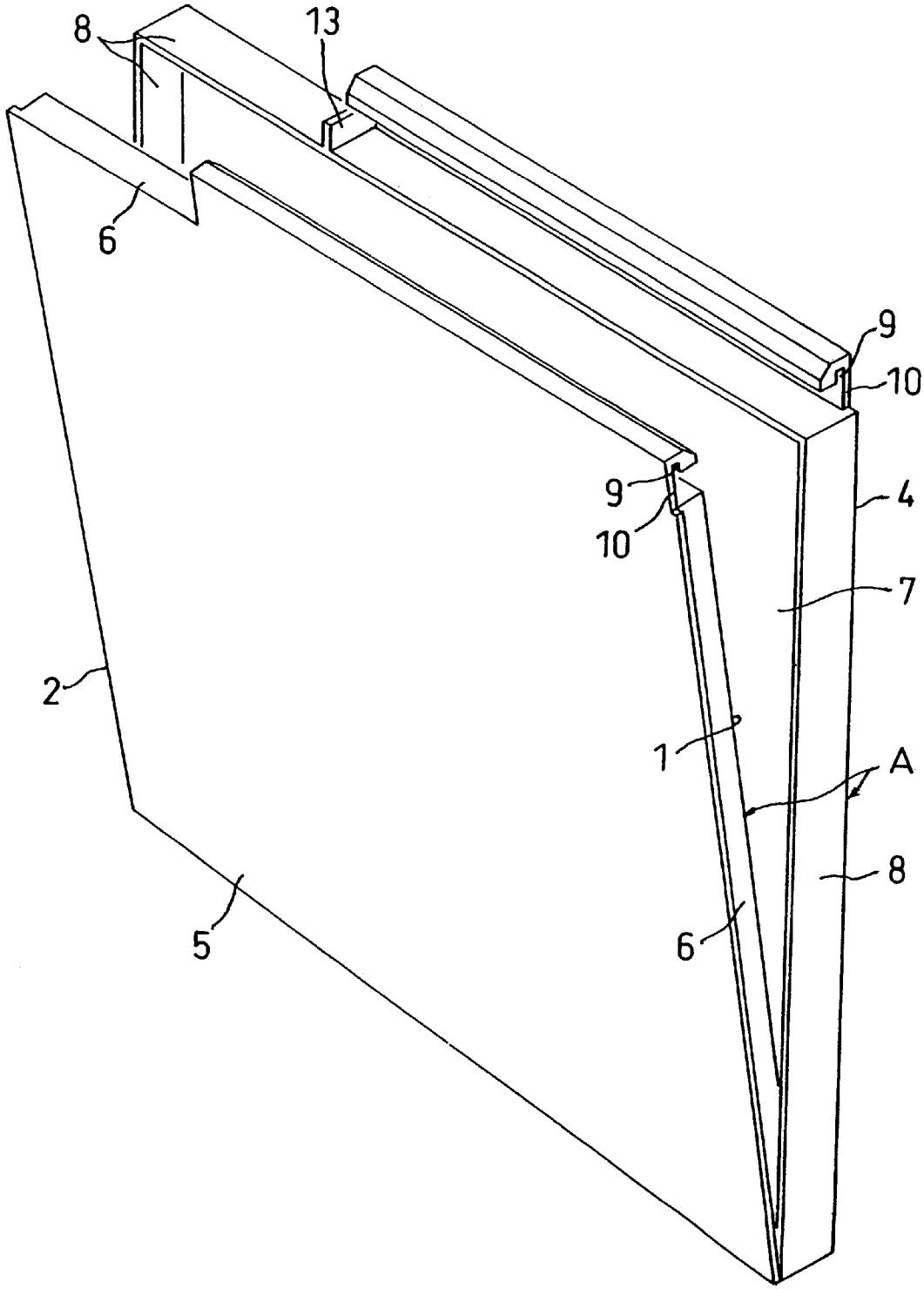
FIG. 1 is a perspective view showing a case according to a first embodiment of the present invention.
Figure 2:
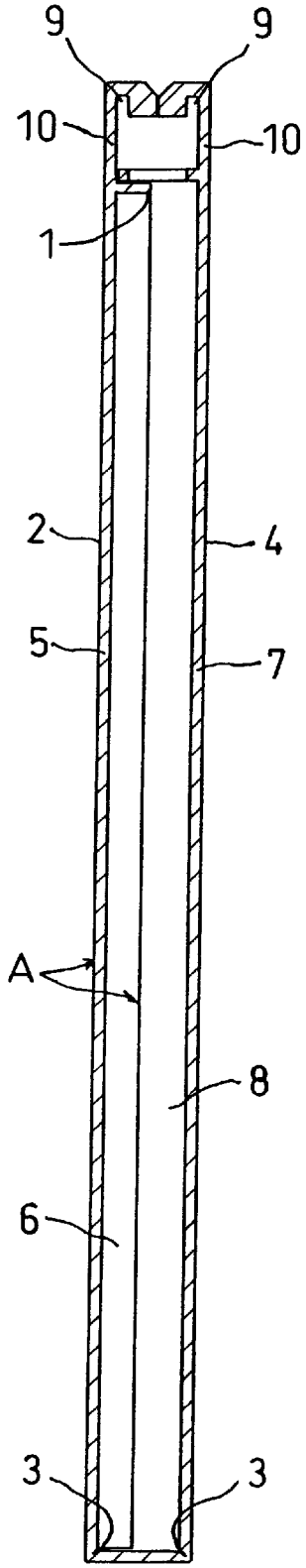
FIG. 2 is a longitudinal sectional front view of the case.

As shown in FIG. 1 and FIG. 2, in an antitheft implement according to a first embodiment of the present invention, a case A is composed of a box body 2 having an opening portion 1 for taking in and out a commodity at its side, and a cover body 4 which is provided at a lower edge side of the box body 2 via a hinge 3 so as to open and close the opening portion 1.

The box body 2 is formed of a side wall 5, and a peripheral wall 6 which is projected from each side edge of the side wall 5 to a back side of the side wall 5. The cover body 4 is formed of a side wall 7, and a peripheral wall 8 which is projected from side edges other than a lower side of the side wall 7 to a back side of the side wall 7. A hinge 3 is provided at a connective portion of the lower side of the side wall 7 and the peripheral wall 6 by being subjected to half-cut finishing. A hinge having other structure may be used; for example, the hinge may be molded by using a synthetic resin as a raw material. In this case, the peripheral walls 6 and 8 are partially formed with a notch for preventing a received commodity from being pulled out.

Moreover, fitting grooves 9 and 9 are formed at an upper side opposite to the box body 2 and the hinge 3 of the cover body 4 so as to be arranged in parallel when the cover body 4 closes the opening portion of the box body 2.

The fitting grooves 9 and 9 arranged in parallel form a part of an L-letter bend wall 10 which is extended from each of the side walls 5 and 7 and has a distal end directed downwardly, and are formed inside the bend wall 10. A shape of the each fitting groove 9 and 9 may be formed so as to correspond to a shape of a slider being used. The slider will be described later.

The case A is formed in the above manner, and for example, at a rental shop, the case A is in a state in which a rental commodity is received in the box body 2, and the opening portion 1 is closed by the cover body 4.

In this case, the fitting grooves 9 and 9 are arranged in parallel as shown in FIG. 2.

Figure 3:
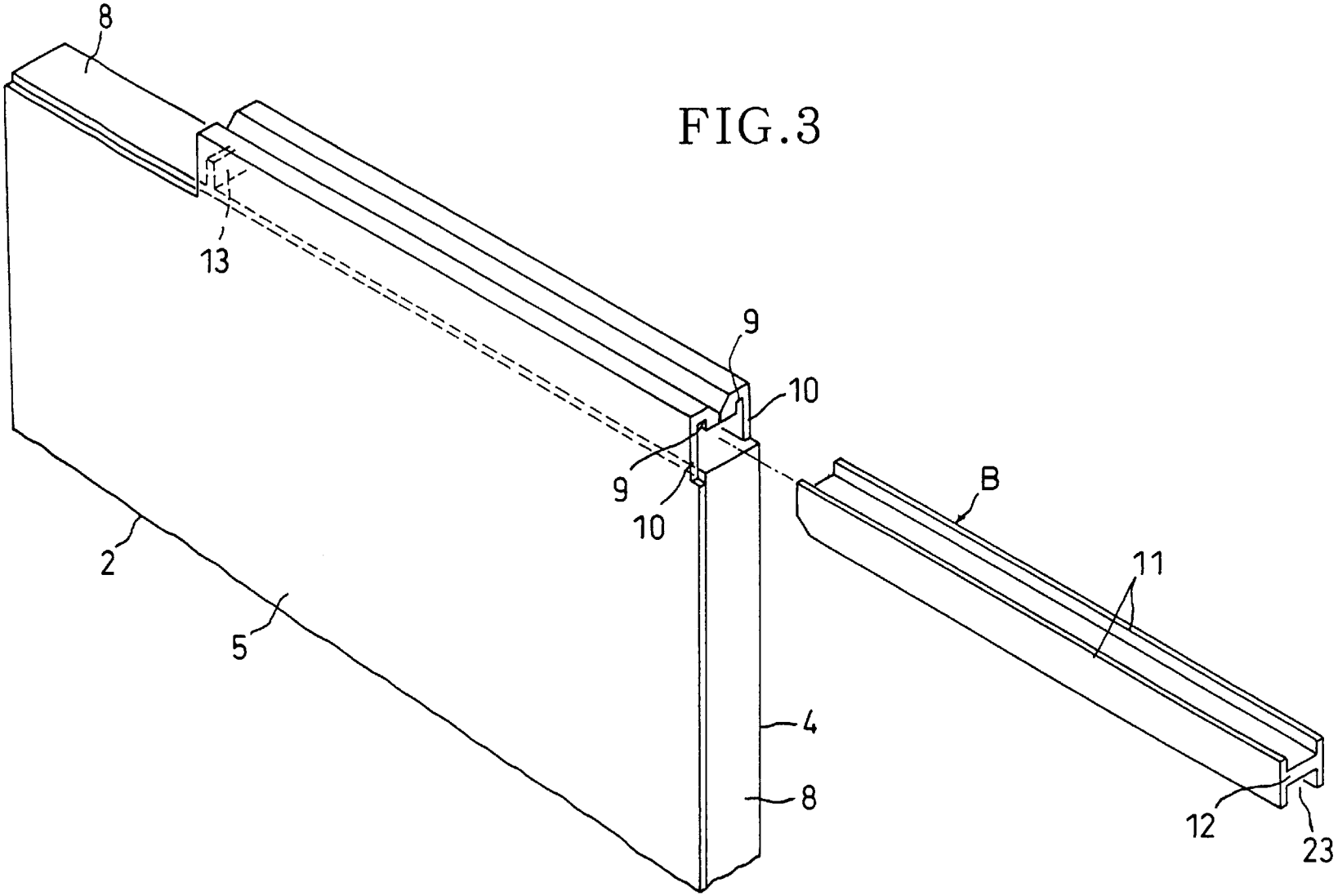
FIG. 3 is an exploded perspective view showing the case and a slider.

A slider B is used so as to combine the box body 2 and the cover body 4 of the case A into a closed state. As shown in FIG. 3, the slider B is fitted into the fitting grooves 9 and 9 arranged in parallel along the entire length of the fitting grooves 9 and 9 when the case A is in a closed state, and is formed so as to be freely pulled therefrom and inserted therein.

As described above, the slider B is inserted in a fitted state along the entire length of the fitting grooves 9 and 9 arranged in parallel, and thereby, the closed case A is suppressed from being opened; therefore, it is possible to prevent a theft of a commodity received in the case A displayed on a shelf.

Incidentally, the slider B is pulled out of the fitting grooves 9 and 9, and thereby, an engagement of the fitting grooves 9 and 9 arranged in parallel and the slider B is released; therefore, the opening portion 1 of the box body 2 closed by the cover body 4 can be opened. However, pulling the slider B out of the displayed case A gives an unfair feeling to the customer; thus, the customer has a hesitation, and thereby, it is possible to prevent a theft of commodity.

In the case of FIG. 3, the slider B is formed of a pair of side plates 11 and 11 which are abutted against the upper edge portion of the fitting grooves 9 and 9 arranged in parallel and are inserted inside the bend walls 10 and 10, and a connective plate 12 connecting an intermediate portion between opposing upper and lower faces of both side plates 11. In the arrangement of the fitting grooves 9 and 9 arranged in parallel, for example, a projected wall arranged in parallel is formed with a groove at its outer side, and the slider B may be fitted into the groove formed on the outer side of both projected walls. Namely, any other forms may be used so long as the inserted slider is fitted into the fitting groove so as to prevent the case from being opened.

A stopper 13 is provided inside the fitting grooves 9 and 9, and then, the distal end of the inserted slider B is abutted against the stopper 13 so that the slider B is stopped at a fixed position. The stopper 13 may be formed on both the peripheral wall 8 and the bend wall 10.

In this case, it is preferable that there is a contact resistance such that the slider B slides and does not come off even if the case A is tilted.

Figure 4:
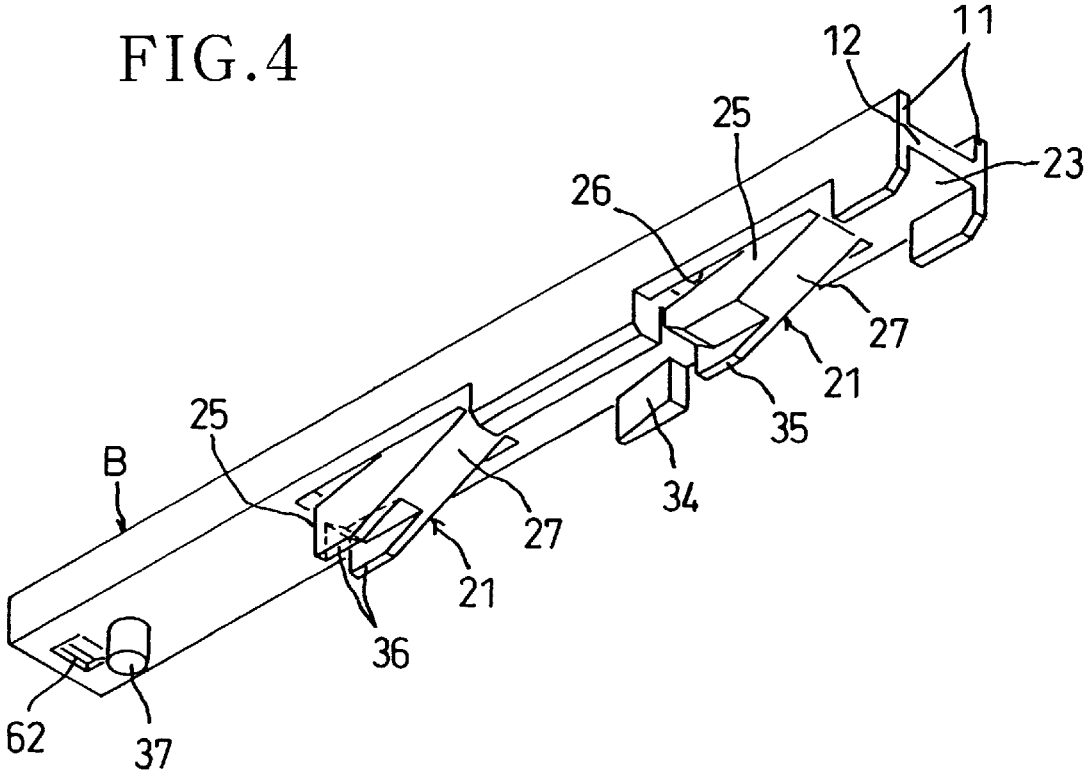
FIG. 4 is a perspective view showing a slider according to a second embodiment.
Figure 5:
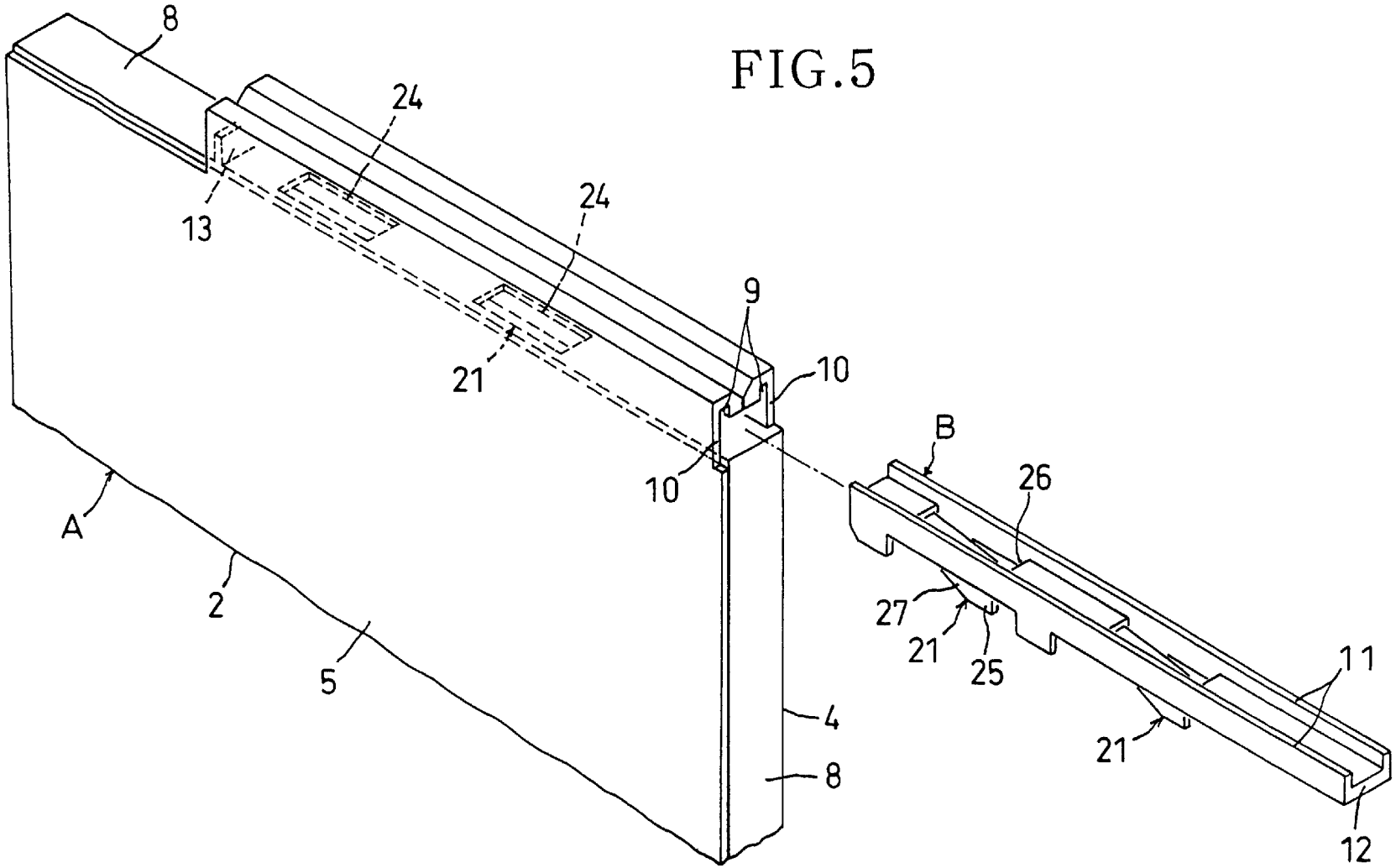
FIG. 5 is an exploded perspective view showing a case and the slider according to the second embodiment.
Figure 6:
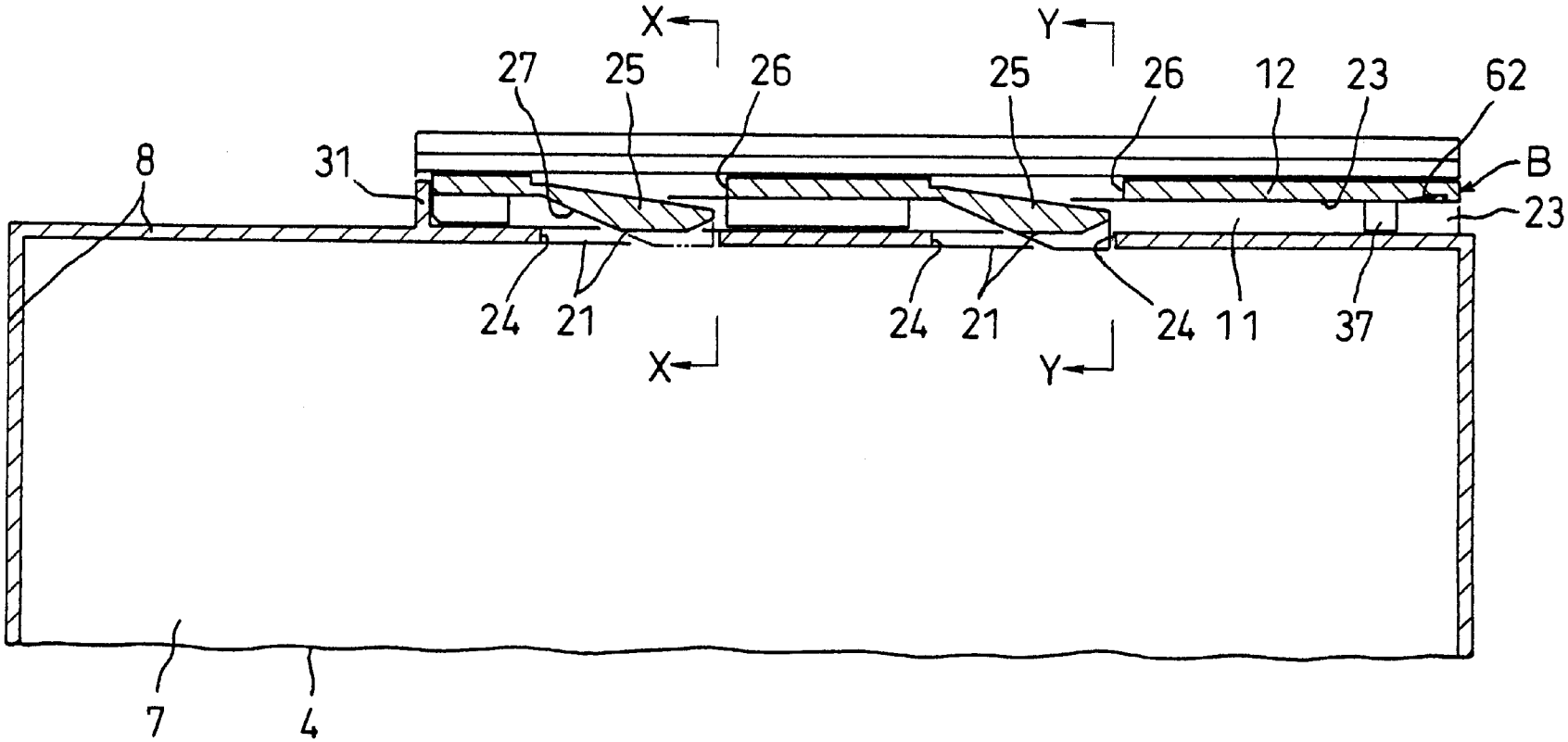
FIG. 6 is a longitudinal sectional side view showing a state in which the slider is inserted into the case.
Figure 7:
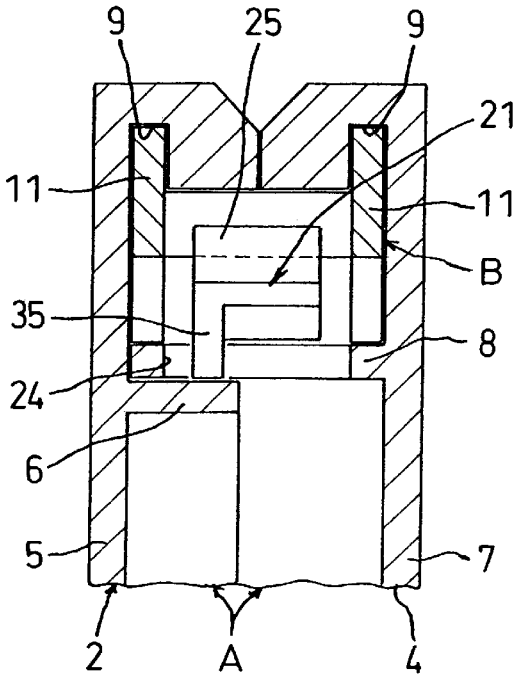
FIG. 7 is a sectional view cut along a line X—X shown in FIG. 6.
Figure 8:
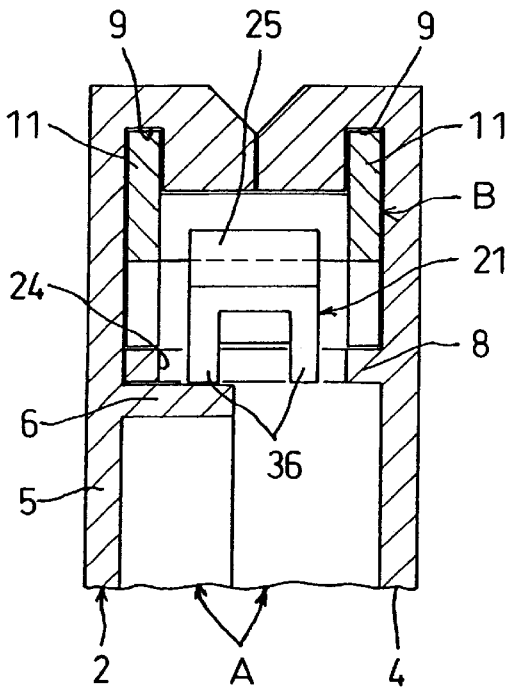
FIG. 8 is a sectional view cut along a line Y—Y shown in FIG. 6.

FIG. 4 to FIG. 6 show an antitheft implement according to a second embodiment. The slider B of the second embodiment is provided with a blocking means 21 at a side facing the case A or the fitting groove 9. The blocking means 21 is pushed back when the slider B is inserted, and then, becomes engaged when the insert of the slider B is completed so as to block a pull-out of the slider B. Moreover, the side having the blocking means 21 is provided with a space 23 for inserting an engagement releasing tool 22 of the blocking means 21.

The blocking means 21 is composed of a blocking portion 24 and a blocking member 25. The blocking portion 24 is a recess (concave) portion or a through hole formed at one of the peripheral wall 8 and the facing side of the connective plate 12 of the slider B, as seen from FIG. 4. The blocking member 25 is provided at the other of the peripheral wall 8 and the facing side of the connective plate 12 of the slider B, and is pushed back against a projecting force when the slider B is inserted, and thus, is automatically fitted into the blocking portion 24 when the insert of the slider B is completed. Further, the blocking member 25 prevents the slider B from sliding toward a direction opposite to the inserting direction of the slider B.

Figure 18:
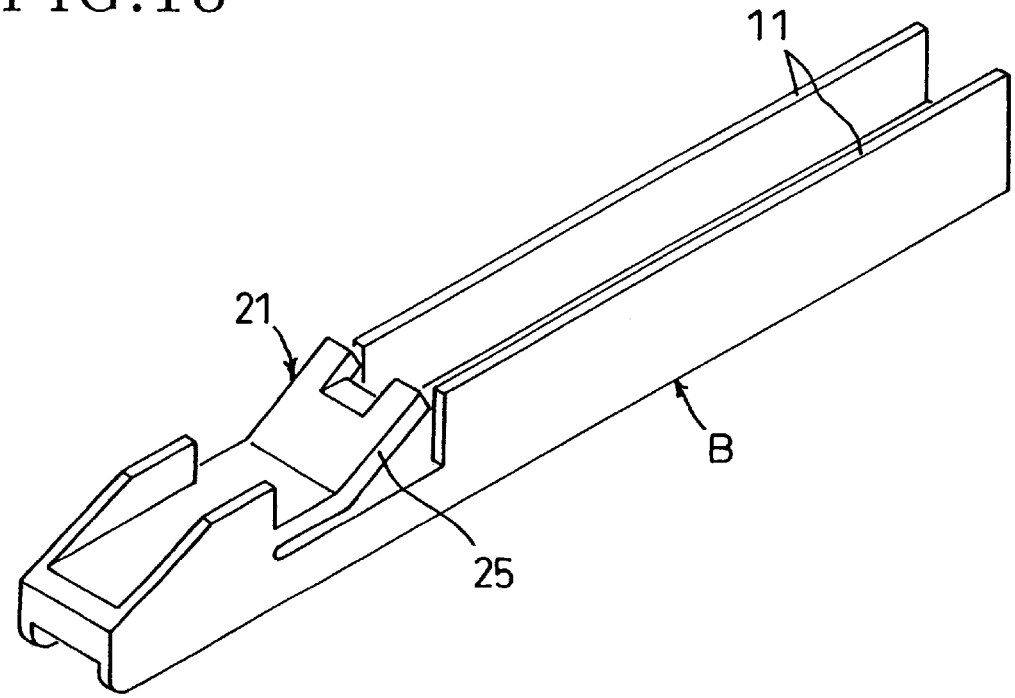
FIG. 18 is a perspective view showing another slider.
Figure 17:
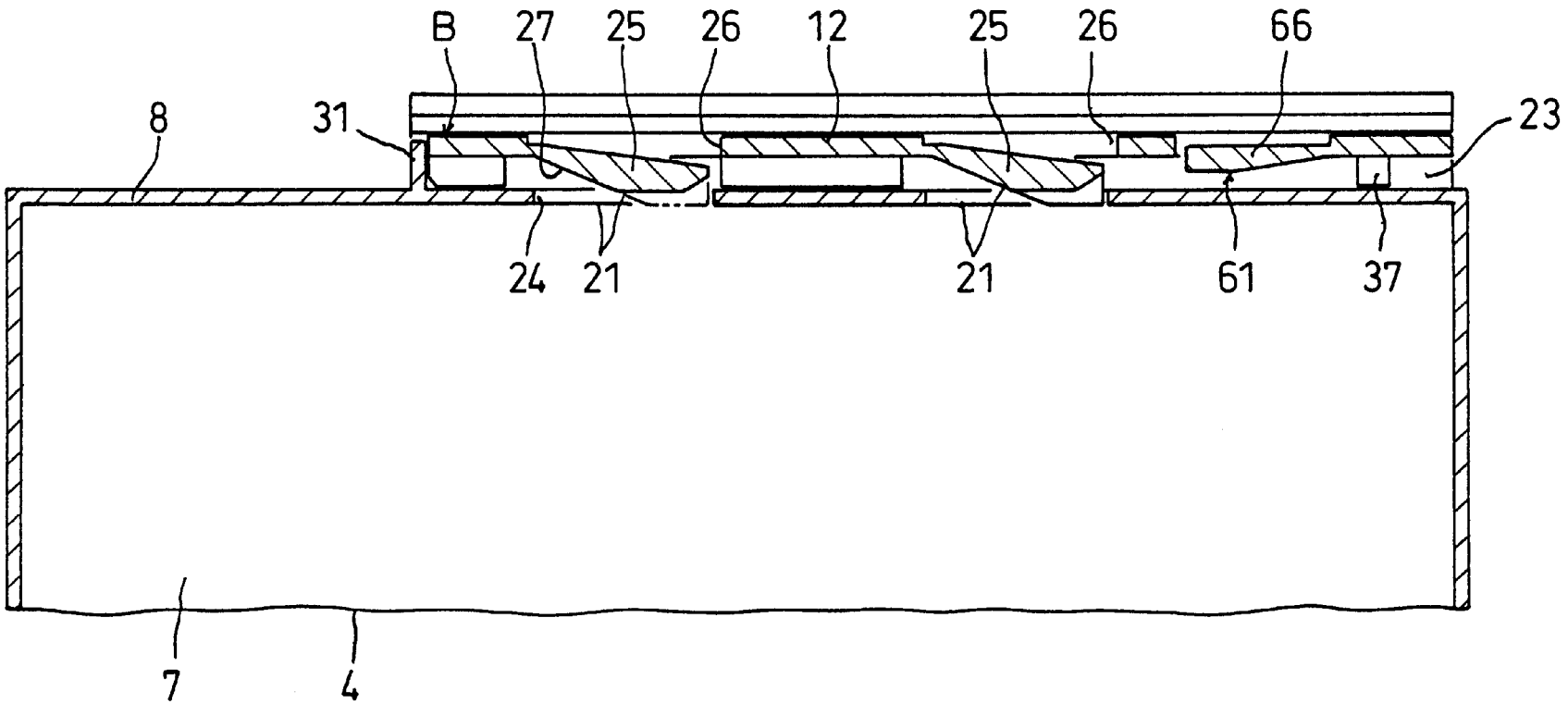
FIG. 17 is a longitudinal sectional view showing a slider.

As shown in FIG. 5, the blocking portion 24 is provided at the case A side, and the blocking member 25 is provided at the slider B side. These blocking portion 24 and blocking member 25 are not limited to the above position, and may be provided conversely to each other. Moreover, positional modifications may be effected depending upon a shape of the slider B and the fitting groove 9. In addition, the blocking member 25 is provided in a manner that the connective plate 12 is formed with a U-shaped slit 26, and an inside of the slit 26 is projected to the blocking portion 24 side. Further, the blocking member 25 is returned back to the original position by using an elastic force of a synthetic resin molded integrally with the slider B. The blocking member 25 may be provided by attaching another part, and as shown in FIG. 18, may be molded integrally with the slider B made of a synthetic resin when molding the slider B.

As seen from FIG. 4, the blocking member 25 is formed with a taper surface portion 27 which extends from a portion connecting with the connective plate 12 toward a free end, and is gradually larger projected into the facing blocking portion 24 side. Whereby it is possible to smoothly insert the slider B, and to smoothly push back the blocking member 25.

Moreover, the above space 23 uses a space surrounded by the connective plate 12 and both side plates 11. The space 23 may be formed like a groove depending upon a shape of the slider B and an arrangement and position of the fitting groove 9.

With the construction of the second embodiment, the slider B is inserted into the fitting grooves 9 and 9 arranged in parallel in a fitted state, and thereby, it is possible to prevent the case A from being opened.

In this case, when the slider B is inserted, the blocking member 25 abutting against the peripheral wall 8 is pushed back, and when the insert of the slider B is completed, the free end of the blocking member 25 is engaged with the blocking portion 24. Thus, the pushing back of the blocking member 25 by the peripheral wall 8 is released, so that the blocking member 25 is returned back to the original position; therefore, the free end of the blocking member 25 can be fitted into the blocking portion 24 as shown in FIG. 6.

The above engagement prevents the slider B from being pulled out of the case A by a third person, so that the case A can not be opened, whereby it is possible to prevent a theft of a commodity received in the case A.

As seen from FIG. 4, two blocking means 21 are arranged front and rear; however, the number of the blocking means 21 may be freely determined.

Figure 9:
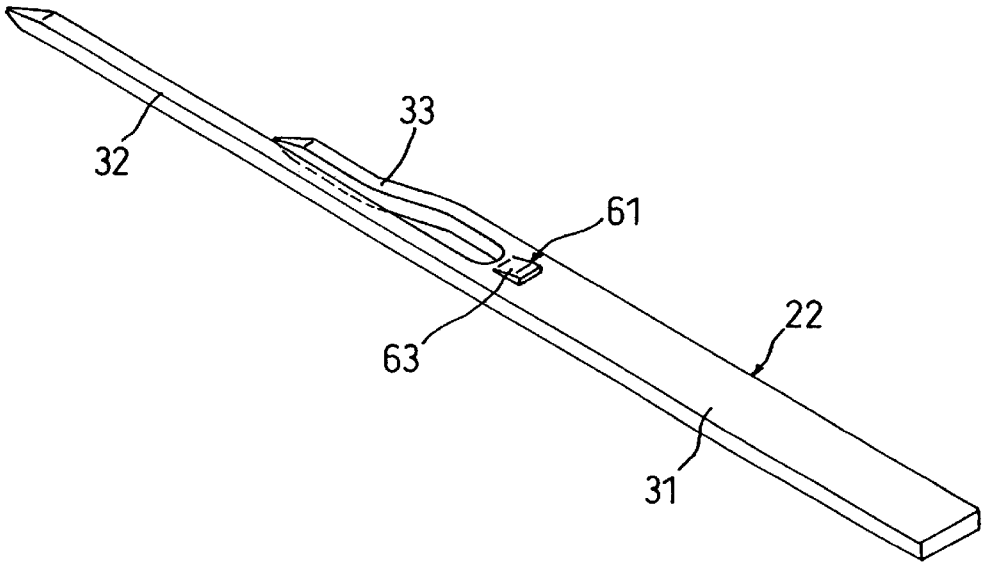
FIG. 9 is a perspective view showing a releasing tool used in the above second embodiment.
Figure 10:
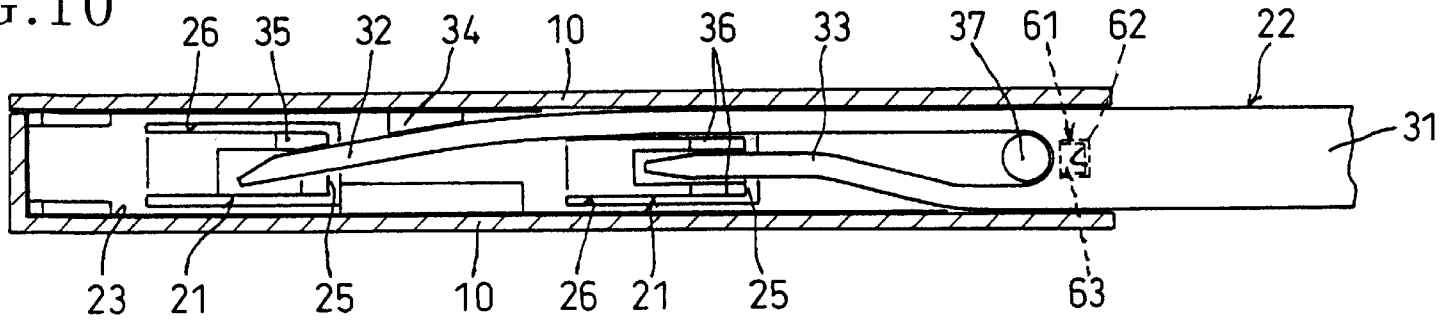
FIG. 10 is a transverse sectional view showing a state in which the releasing tool is used.
Figure 11:
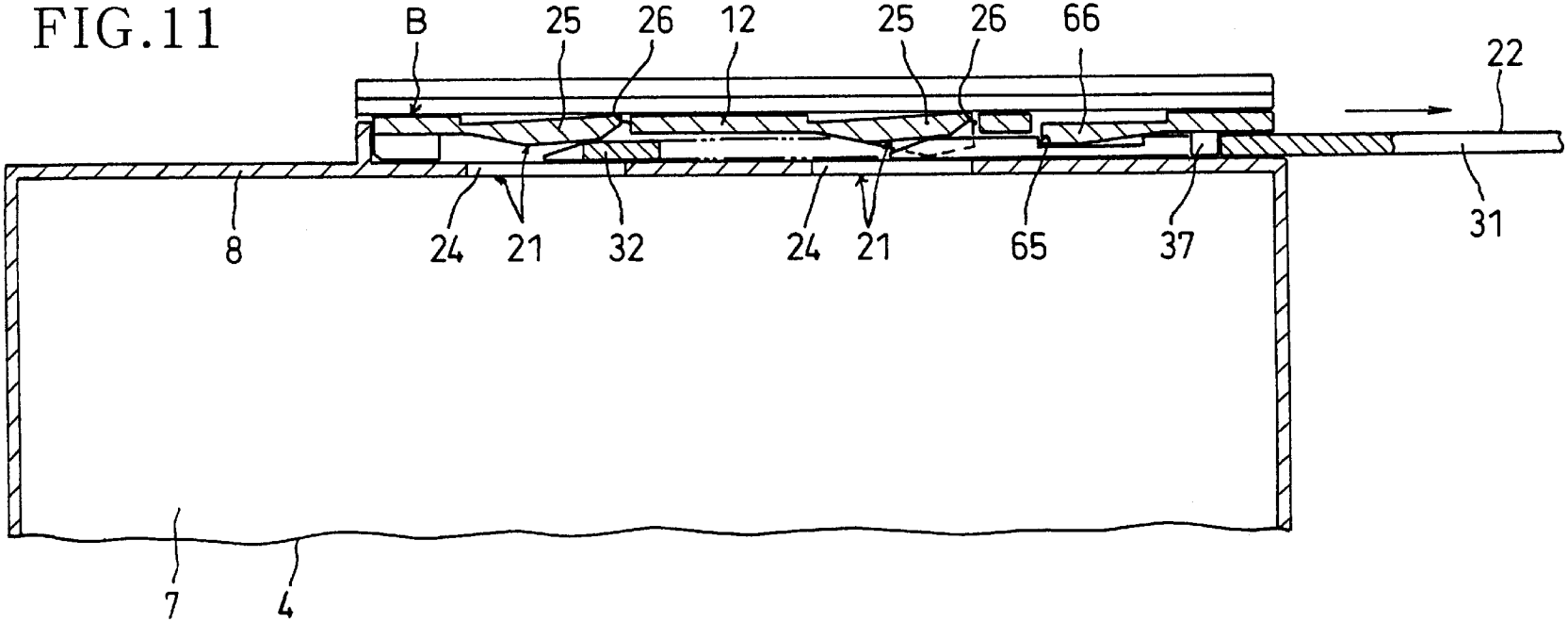
FIG. 11 is a longitudinal sectional view showing a state in which the releasing tool is used.

An engagement releasing tool 22 inserted into the space 23 for releasing an engagement of the above blocking means 21 is as shown in FIG. 9, FIG. 10 and FIG. 11. The engagement releasing tool 22 is composed of a plate-like portion 31, a longer piece portion 32 and a shorter piece portion 33 which are arranged in parallel. More specifically, the plate-like portion is inserted into the space 23, the longer piece portion 32 extends continuously from the plate-like portion 31 toward the front side, and pushes back the ahead-side blocking member 25 so that the blocking member 25 is released from the blocking portion 24, and the shorter piece portion 33 pushes back the rear-side blocking member 25 so that the blocking member 25 is released from the blocking portion 24.

In this case, as shown in FIG. 10, the longer piece portion 32 is bent by a guide 34 projecting from the slider B so as to be guided to a center on the lower side of the ahead-side blocking member 25, and then, the distal end of the longer piece portion 32 is guided to a center on the lower surface of the ahead-side blocking member 25 by a guide member 35 downwardly projecting from one side edge of the blocking member 25.

On the other hand, the shorter piece portion 33 has a tapered distal end, and is inserted between guide members 36 which are downwardly projecting from both side edges of the blocking member 25 and are arranged in parallel, and thus, is guided to a center on the lower surface of the ahead-side blocking member 25.

However, the engagement releasing tool 22 is not limited to the above construction, and may be formed by using a sheet of plate in the case where the blocking means 21 is only one.

Figure 19:
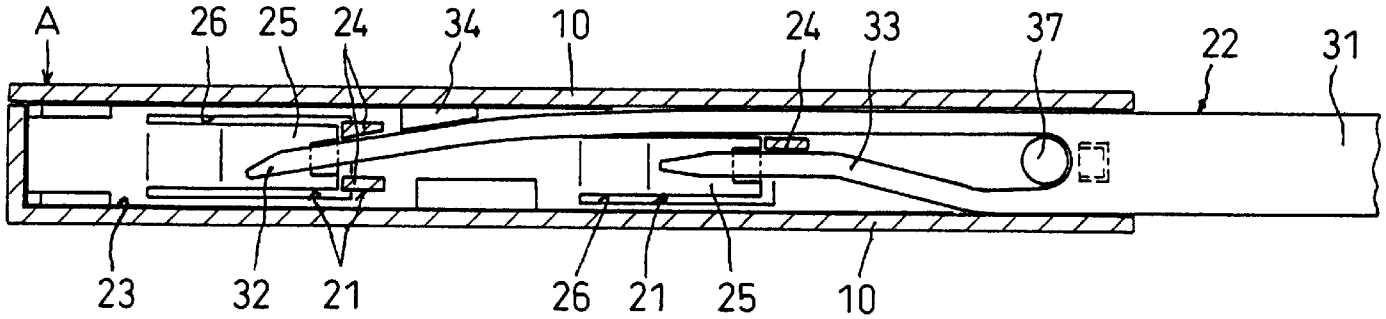
FIG. 19 is a bottom plan view showing another blocking portion.
Figure 20:
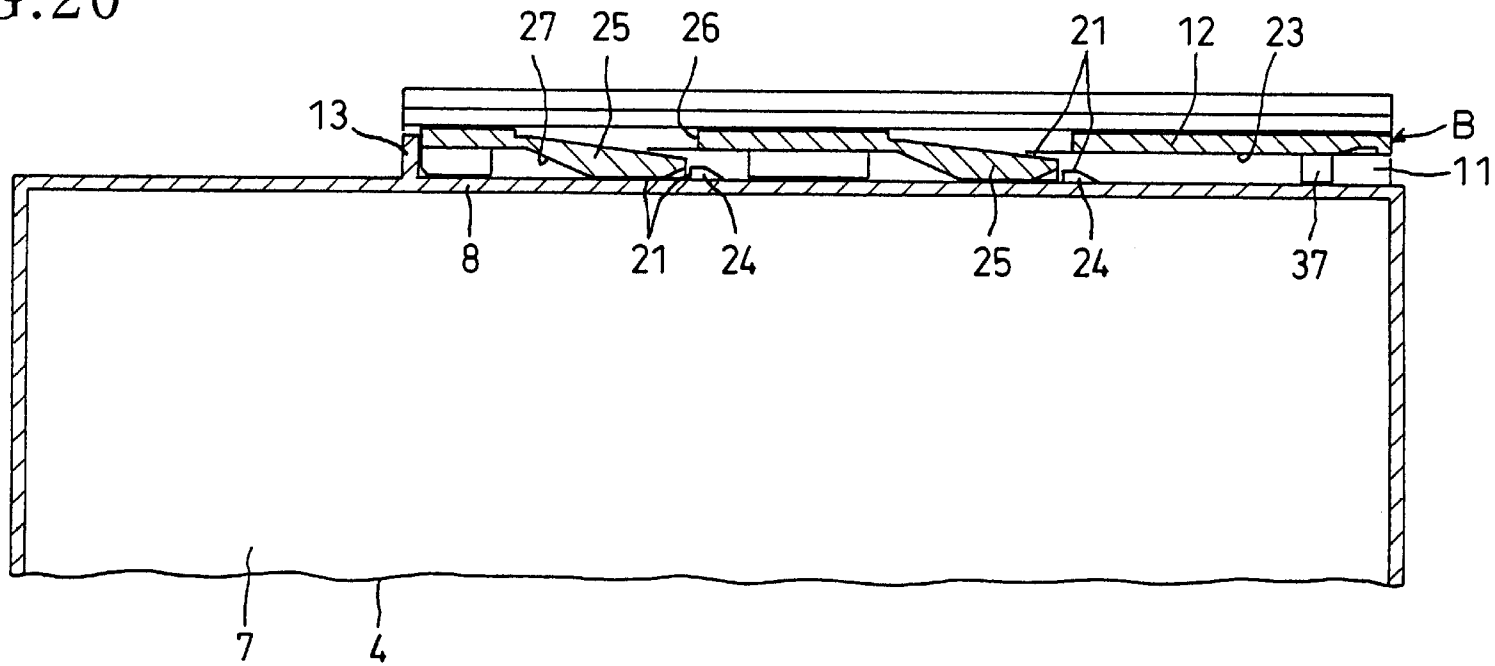
FIG. 20 is a longitudinal sectional side view showing another blocking portion.

The blocking portion 24 is not limited to the through hole shown, and may be formed into a recess portion, or as shown in FIG. 19 and FIG. 20, may be formed into a protrusion projecting from the upper surface of the peripheral wall 8 having the space 23.

In this case, when the engagement releasing tool 22 is inserted, a consideration should be given such that each insert distal end of the longer and shorter piece portions 32 and 33 do not collide with each other.

In FIG. 10, a reference numeral 37 denotes an insert stopper of the engagement releasing tool 22.

Figure 12:
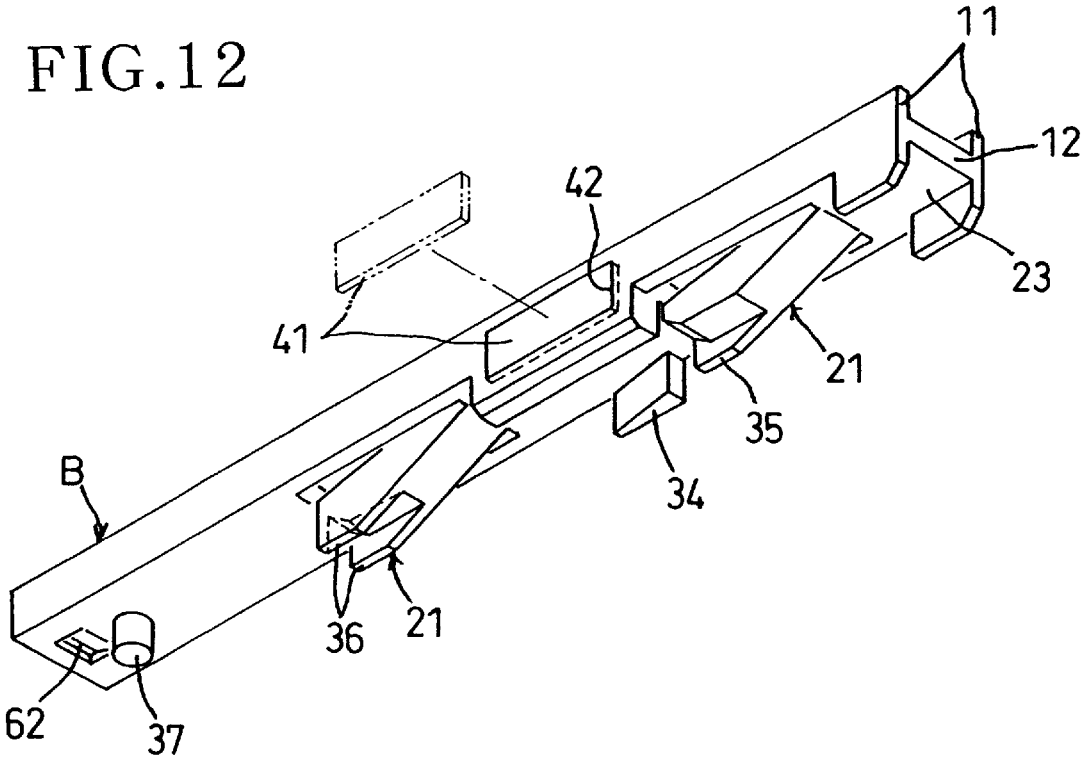
FIG. 12 is a perspective view showing a slider according to a third embodiment.

According to a third embodiment of the present invention, as shown in FIG. 12, an antitheft tag 41 is attached to a desired position of the slider B in order to prevent a commodity from being unfairly taken out of a shop.

The tag 41 is detected (sensed) by an already known magnetic coil, that is, a detecting means such as a magnetic sensor arranged on a gateway of the shop.

As seen from FIG. 12, the side of the slider B is formed with a recess (concave) portion 42 at its side surface, and the above tag 41 is fitted in the recess portion and is fixed thereto by a bonding (adhesive) agent or the like. The attaching position and means are not limited to the above manner.

Figure 21:
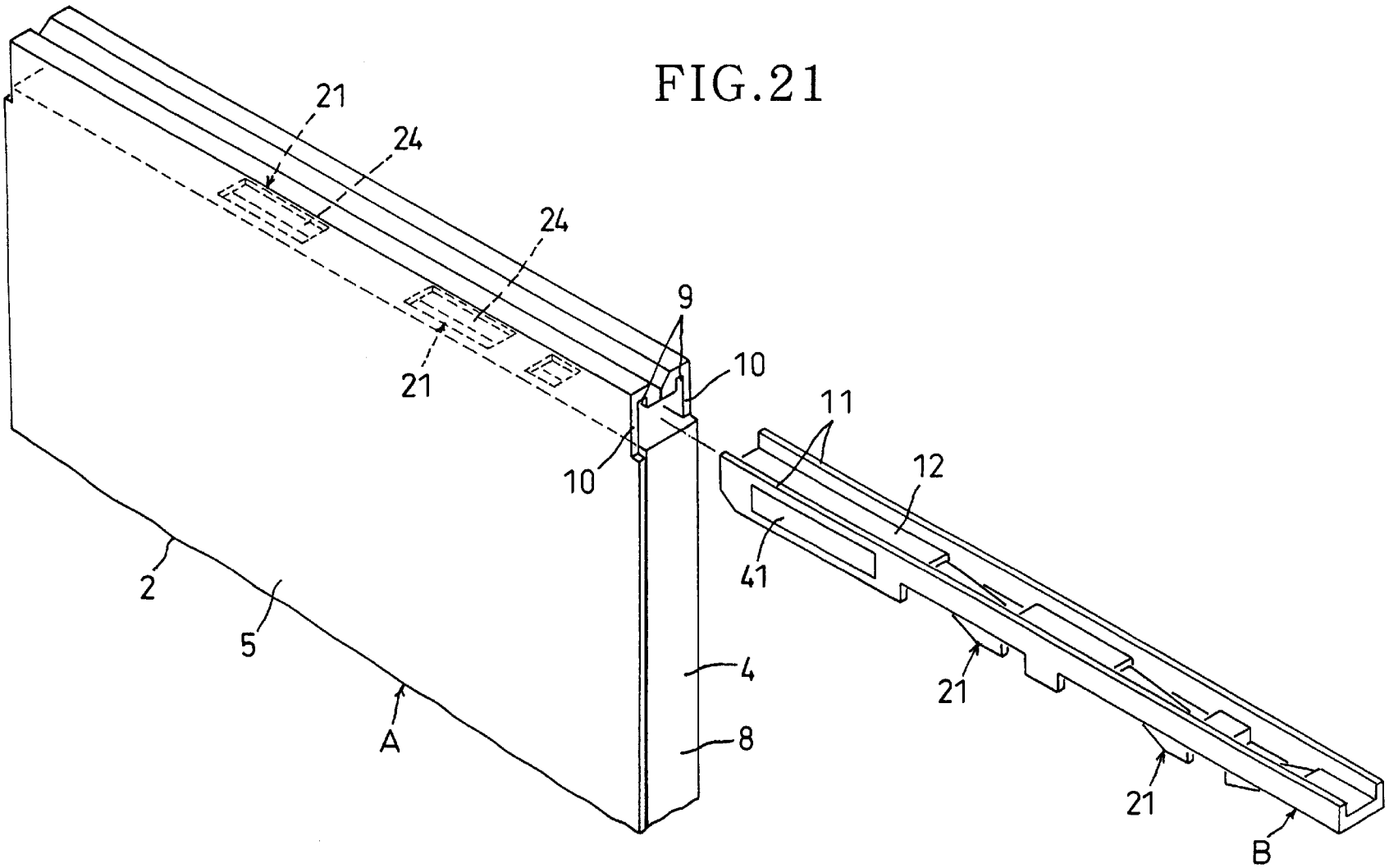
FIG. 21 is a perspective view showing another slider and fitting groove.

Of course, as shown in FIG. 21, the fitting grooves 9 arranged in parallel are provided along the entire length of the side edge of the case A, and also, the slider B is elongated so as to correspond to the entire length of the fitting groove, and thus, the tag 41 may be attached to a portion elongating the insert distal end side of the slider B.

With the above construction, in the case of selling and lending a commodity, the slider B is pulled out of the case A so as to be left at a shop side, and thereby, there is no need of directly attaching a tag to a case and a commodity; therefore, it is possible to achieve a cost reduction.

Figure 13:
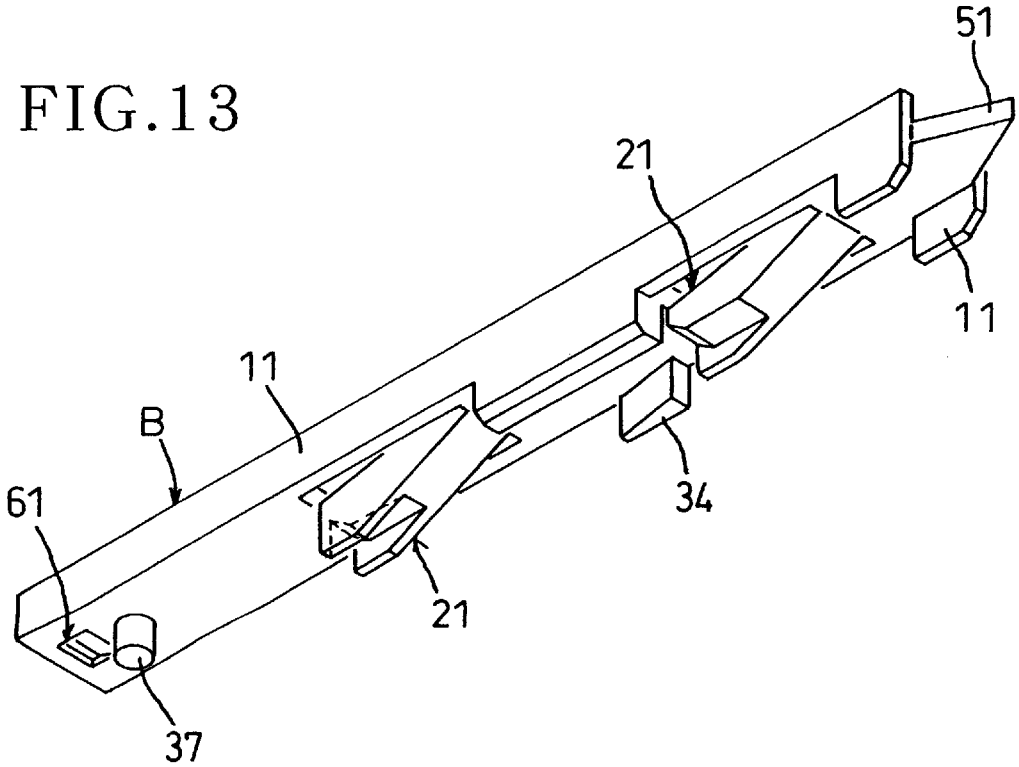
FIG. 13 is a perspective view showing a slider according to a fourth embodiment.

According to a fourth embodiment of the present invention, as shown in FIG. 13, an insert distal end of the slider B is provided with a breaking-through pointed portion 51.

The above pointed portion 51 is formed into a V-letter shape, and besides, as shown in FIG. 22, may be formed into a pointed portion 51 having a shape of plus driver.

Figure 14:
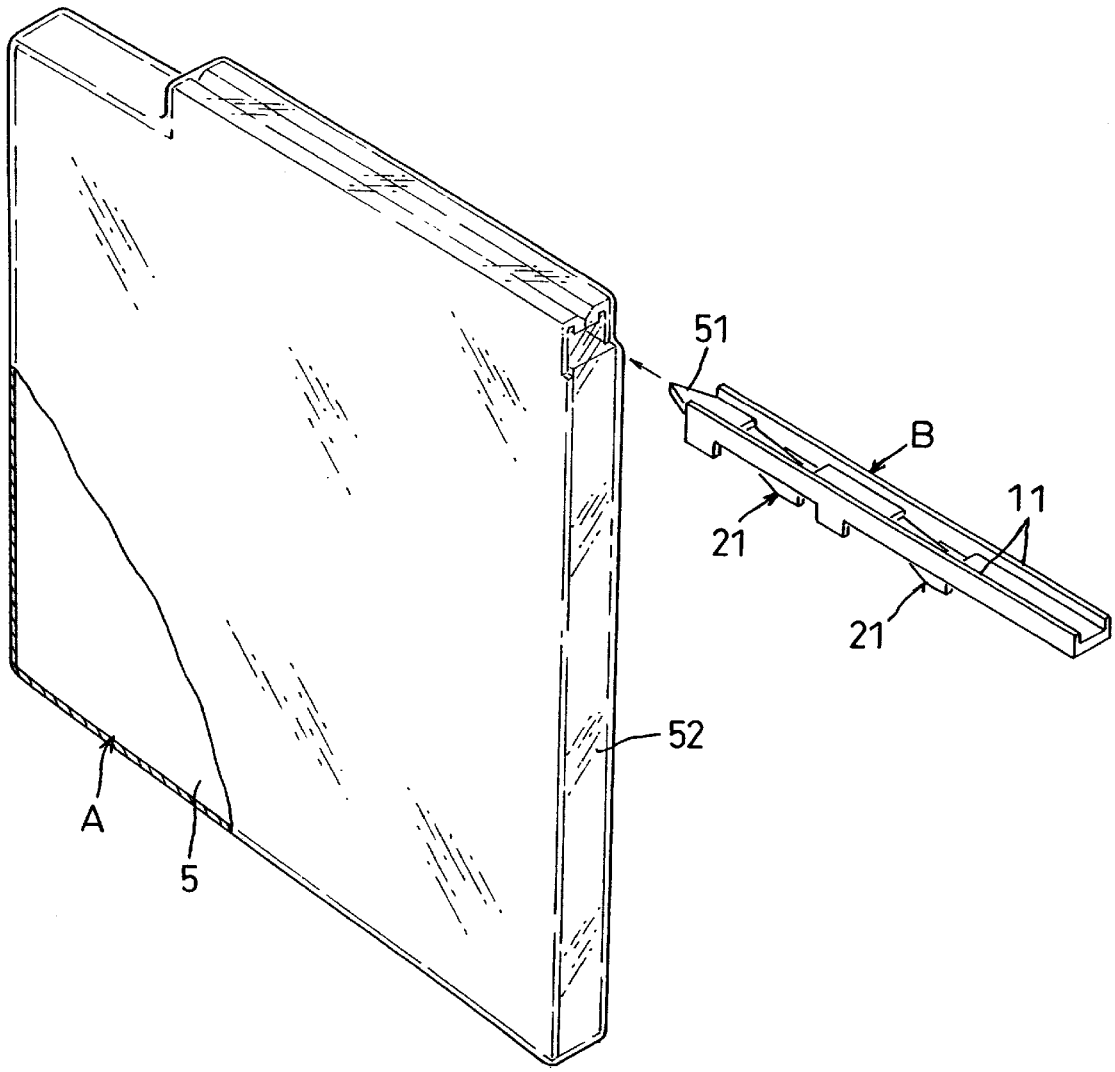
FIG. 14 is a perspective view showing a state in which the slider according to the fourth embodiment is used.

In short, as shown in FIG. 14, the pointed portion 51 breaks through a packaging film such as a thermally shrinkable film for packaging the case A so that the slider B is inserted into the fitting grooves arranged in parallel.

By doing so, even in the case where the case A is packaged by a film 52, it is possible to insert the slider B into the case A which is in a packaged state.

As shown in FIG. 22 and FIG. 23, the fitting groves 9 and 9 arranged in parallel are formed with a notch portion 71 at the end portion where the slider B is inserted, and thereby, even in the case where a broken piece of the packaging film 52 broken through by the pointed portion 51 is pushed into the case A by the slider B, the pushed broken piece is received in the notch 71. Therefore, no hindrance is given to a smooth insert of the slider B.

According to a fifth embodiment of the present invention, as shown FIG. 9, FIG. 13 and FIG. 15 and FIG. 11, FIG. 16, and FIG. 17, an engagement means 61 is provided on a surface where the slider B and the inserted releasing tool 22 overlap with each other.

Figure 15:
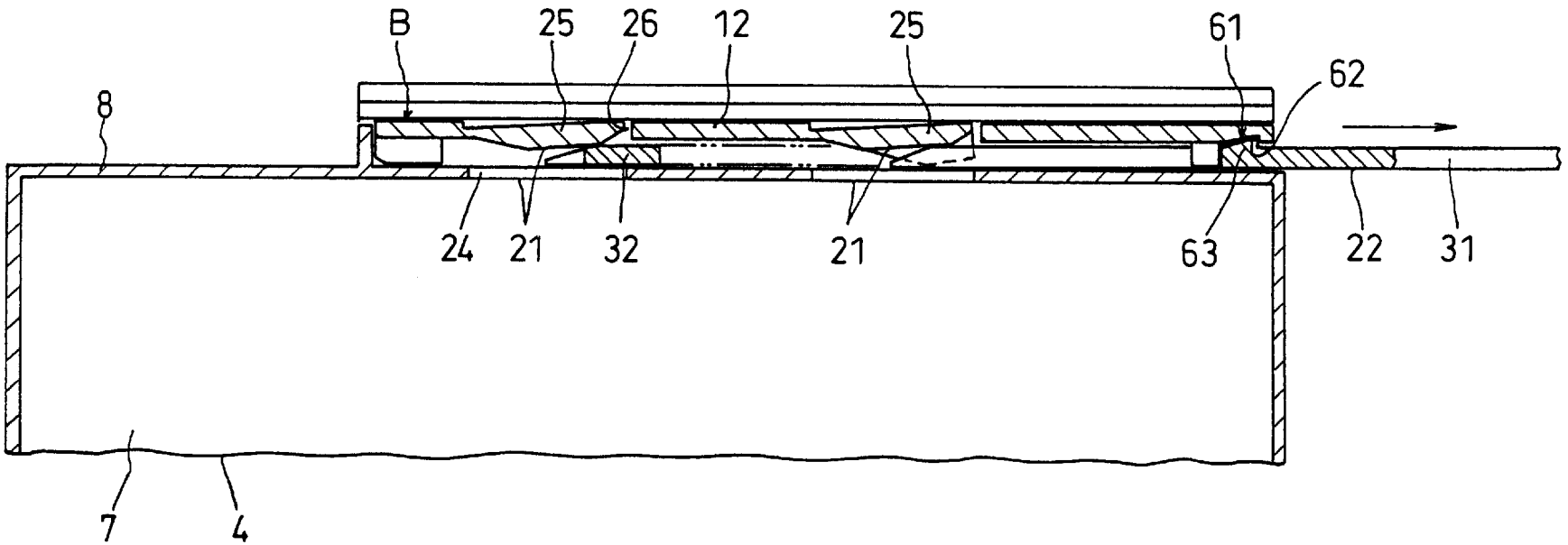
FIG. 15 is a longitudinal sectional view showing principal parts of a fifth embodiment.
Figure 16:
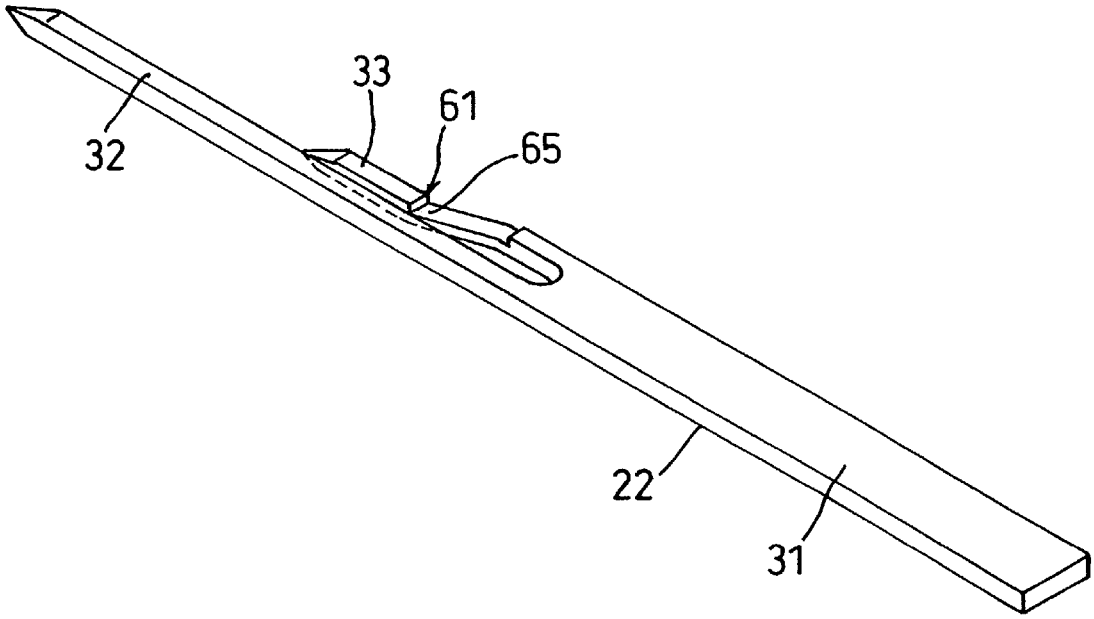
FIG. 16 is a perspective view showing a releasing tool.

In the engagement means 61, the slider B is formed with a recess (concave) portion 62, and the releasing tool 22 is formed with a tapered protrusion 63. The tapered protrusion 63 has a greatly projected portion in a drawing direction so as to be fitted in and engaged with the recess portion 62 when the releasing tool 22 is inserted. As shown in FIG. 15, the recess portion 62 and the tapered protrusion 63 are engaged with each other, and thereby, an engagement is performed. There are the following methods; more specifically, one is a method such that the slider B is drawn out simultaneously when drawing out the releasing tool 22 while slightly lifting it up. The other is the following method; more specifically, a recess stepped portion 65 is formed on the upper surface of the shorter piece portion 33, and when the releasing tool 22 is inserted, it is upwardly pushed against a return force by the shorter piece portion 33, and when the insert of the releasing tool 22 is completed, an elastic portion 66 is engaged with the recess stepped portion 65, and thereby, an engagement is performed, and thus, the slider B is drawn out together with the releasing tool 22.

Figure 24:
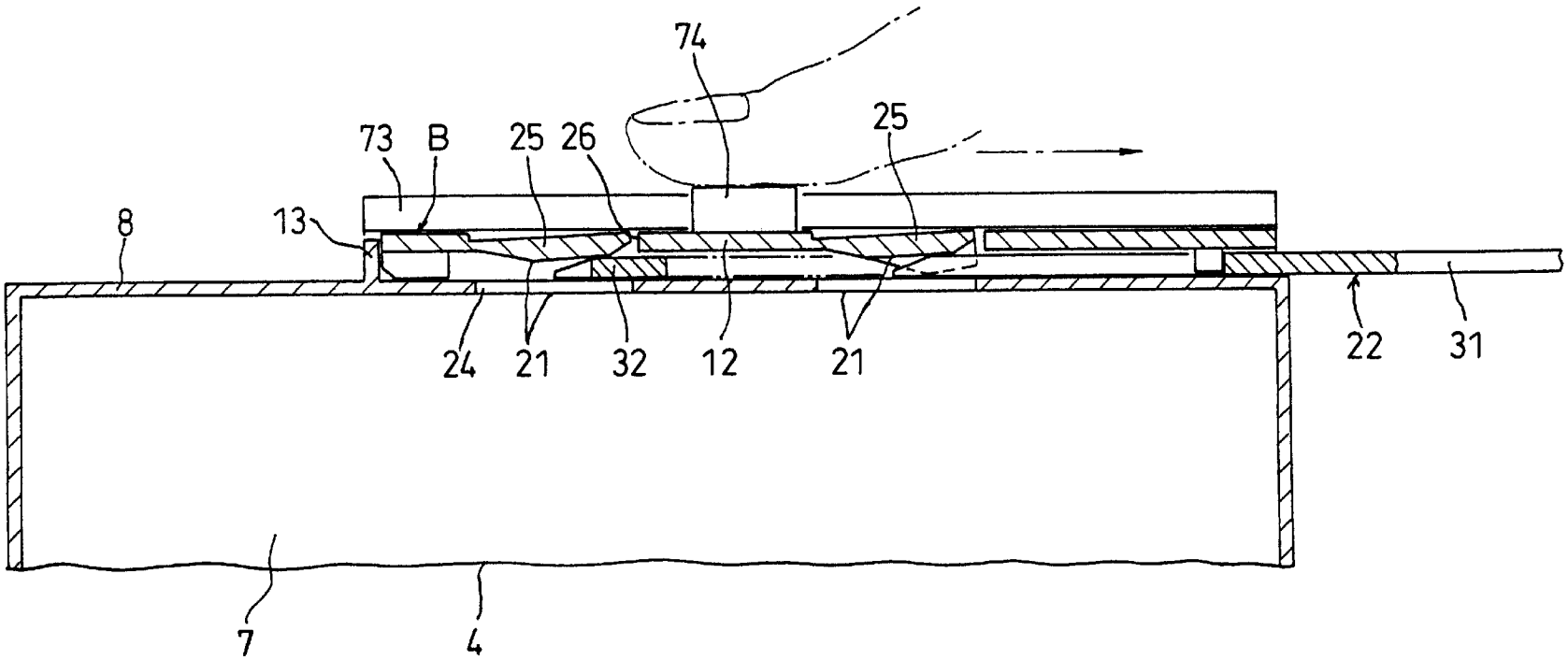
FIG. 24 is a longitudinal sectional side view showing a sixth embodiment.
Figure 25:
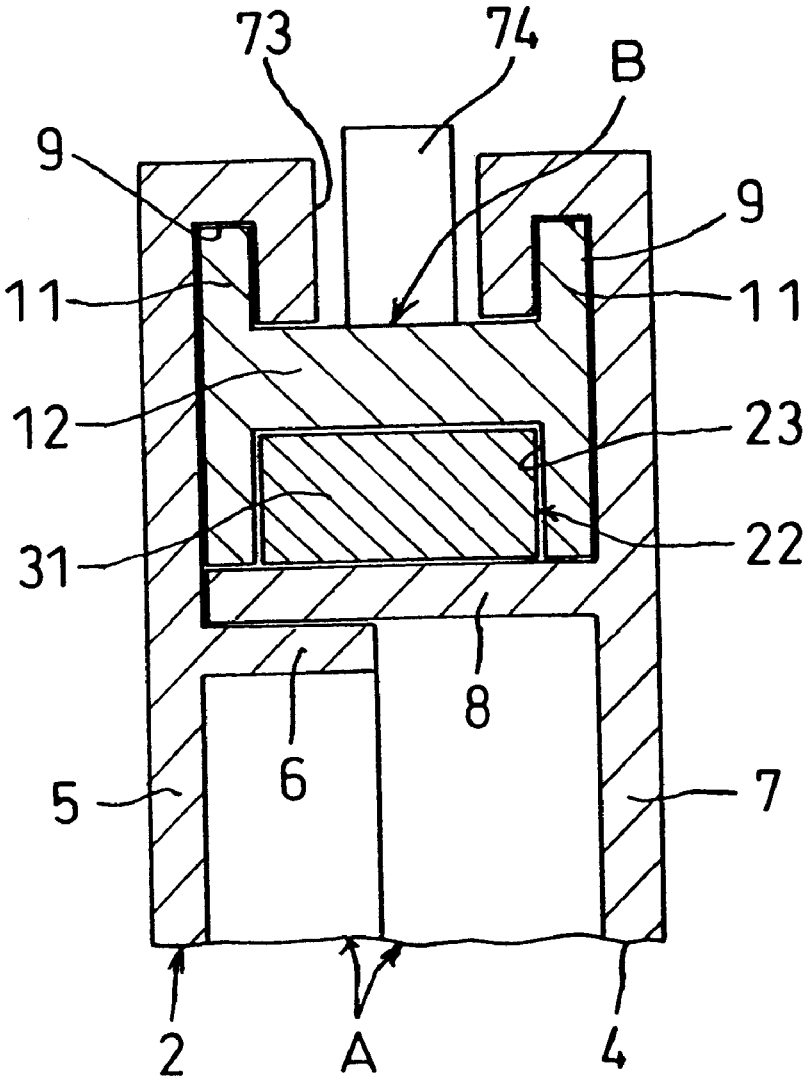
FIG. 25 is a longitudinal sectional front view showing the sixth embodiment.

According to a sixth embodiment of the present invention, as shown in FIG. 24 and FIG. 25, a space 73 is formed between the fitting grooves 9 and 9 arranged in parallel, and then, a fingertip operating portion 74 projected from the inserted slider B is fitted into the space 73.

Of course, when the slider B is inserted, the fingertip operating portion 74 is fitted into the space 73, and then, is moved therein; therefore, the space 73 is formed over the entire length of the space or a necessary range.

By doing so, after the slider B and the releasing tool 22 are inserted, as shown in FIG. 24, a fingertip is pushed against the fingertip operating portion 74, and then, when moving the fingertip to a direction shown by an arrow of FIG. 24, that is, a direction of drawing out the slider B while keeping a state in which the fingertip is pushed against the fingertip operating portion 74, the slider B is slid to a direction of being drawn by a pressing force when pushing the fingertip against the portion 74 in a state of overlapping with the releasing tool 22.

Therefore, in this example, there is no need of providing the engagement means 61 of the sixth embodiment in the slider B and the releasing tool 22.

In this case, the fingertip operating portion 74 may be set to have a projection length such that its appearance is beautiful.

Figure 26:
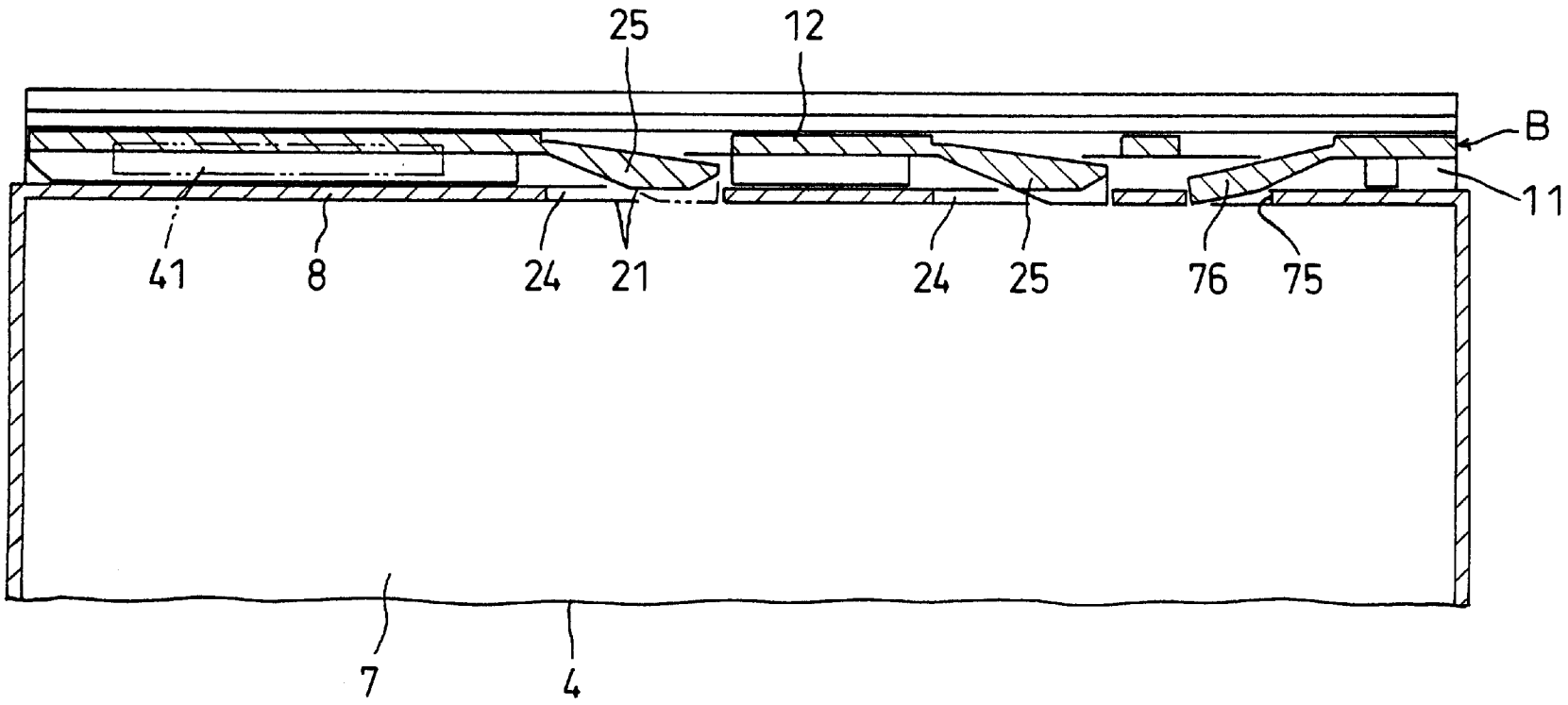
FIG. 26 is a longitudinal sectional side view showing a state in which the slider is positioned to a stop position.
Figure 27:
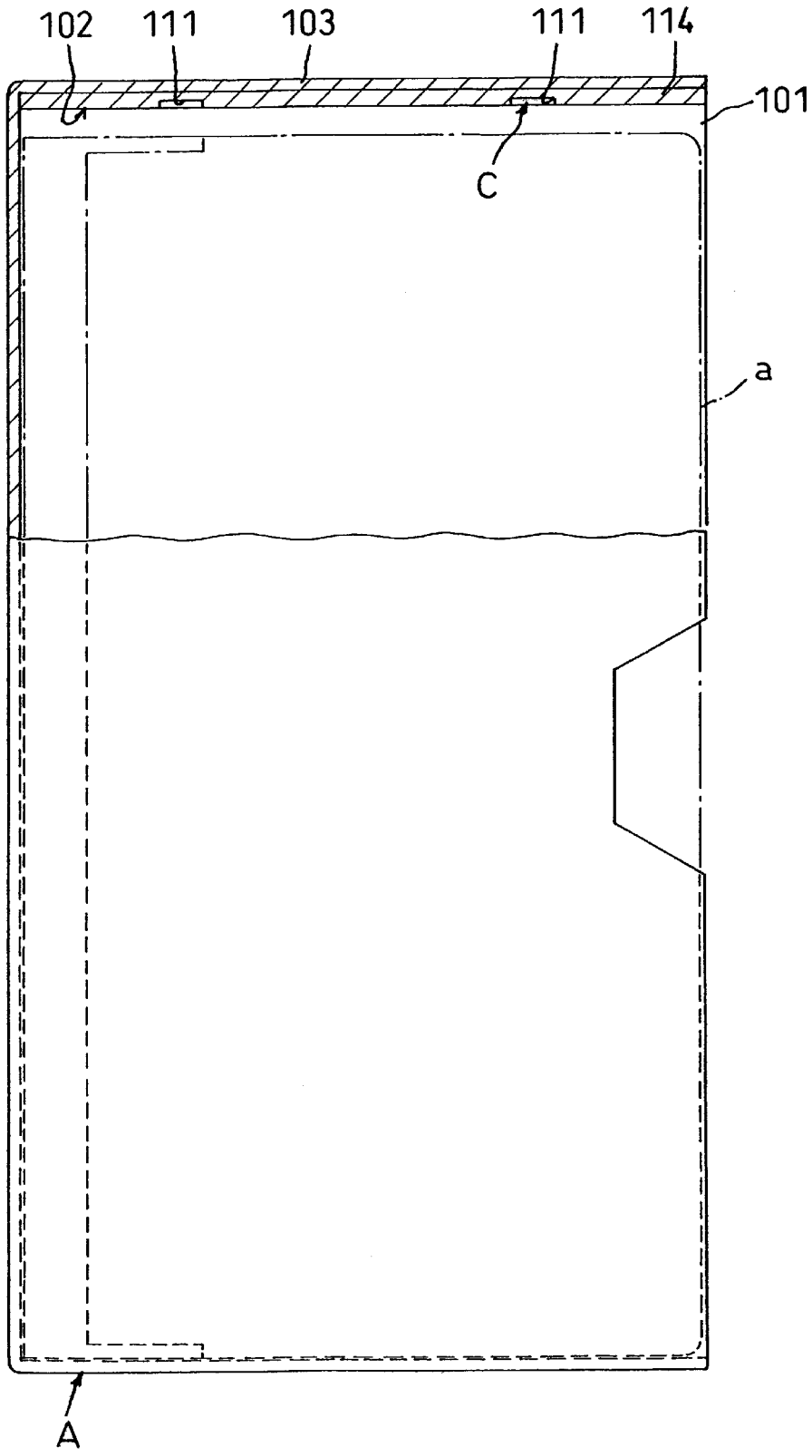
FIG. 27 is a perspective view showing a case according to a seventh embodiment of the present invention.
Figure 28:
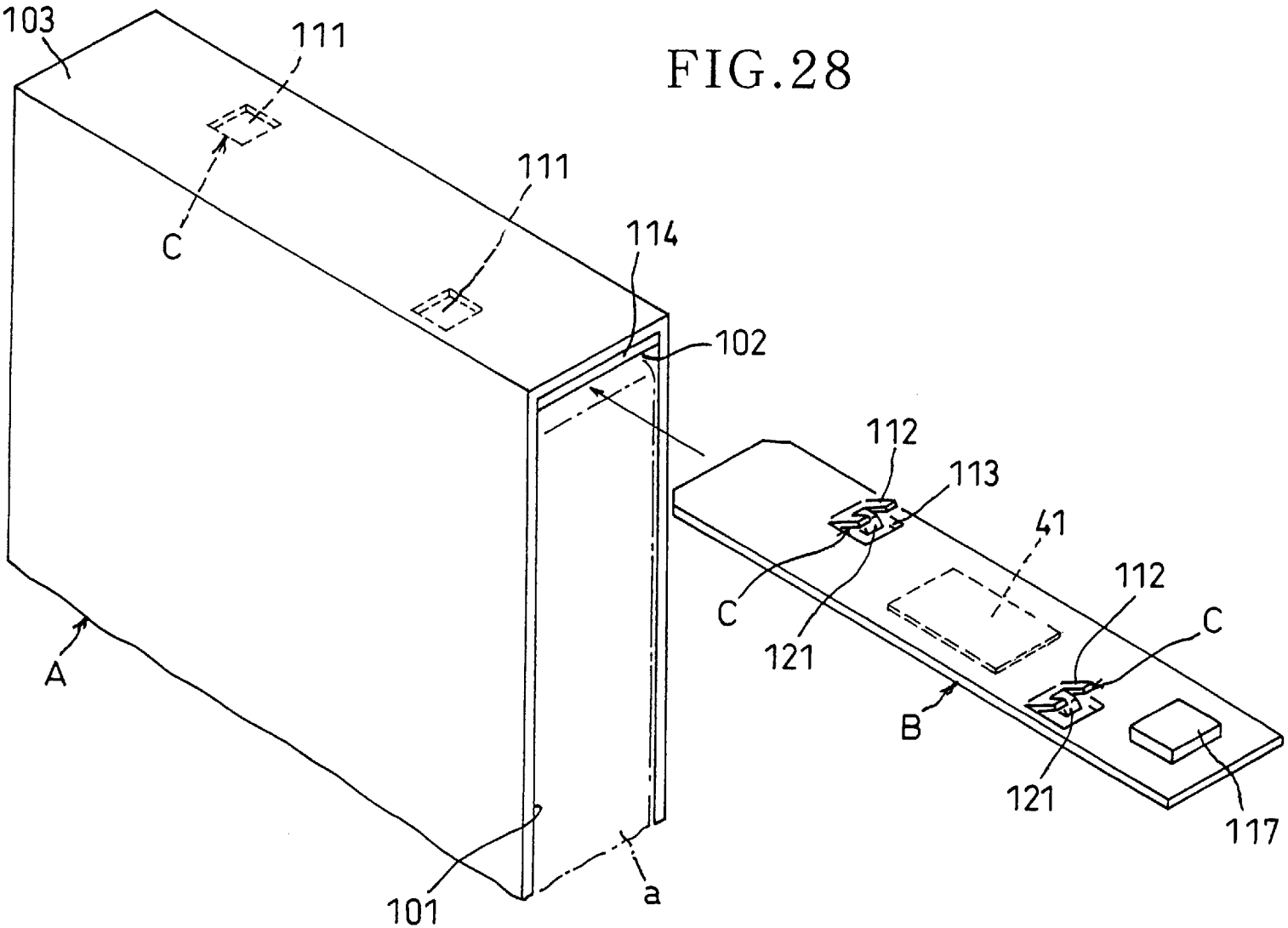
FIG. 28 is an exploded perspective view showing the case and a slider.

Moreover, as shown in FIG. 26, when the blocking means 21 has an engaged relation at the same time when the slider B is inserted, the elastic member 76 is automatically fitted into and engaged with a blocking portion 75 on one facing portion of the slider B and the peripheral wall 8, and thus, the slider B is stopped from sliding in an insert direction. Whereby no stopper 13 is required on the case A side.

Of course, the elastic member 76 is pushed when the releasing tool 22 is inserted, and thus, an engagement of the elastic member 76 and the blocking portion 75 is released.

The blocking portion 75 and the elastic member 76 have the same structure as the blocking means 21; therefore, the details are omitted.

As described above, according to the first to sixth embodiments, it is possible to prevent a theft of a commodity received in the case. Moreover, an engagement of the blocking means of the slider and the case is released by the releasing tool on the shop side, and the drawn slider is left at the shop side; therefore, it is possible to use the case as a sales or lending case.

Further, the slider is provided with the tag; therefore, it is possible to reduce a time and labor for attaching the tag to both case and commodity, and the slider attached with a tag is left at the shop side, there is no loss of tag in a sale of case and commodity.

Namely, no slider is required for each case. The reason is as follows; more specifically, a case receiving an article (commodity) is delivered from maker side; on the other hand, the slider is provided in only sales shop and rental shop.

Therefore, it is possible to reuse the slider attached with a tag received by the shop side, so that a cost can be reduced.

Further, the slider is provided with a breaking through pointed portion, so that the slider can be inserted so as to breaking through the packaging film of the case.

Further, it is possible to draw out the releasing tool and the slider together by the blocking means provided in the slider and the releasing tool.

Furthermore, it is possible to slide and draw out the releasing tool and the slider together by the fingertip operating portion fitted into the space formed between the fitting grooves arranged in parallel.

According to a seventh embodiment of the present invention, as shown in FIG. 27 to FIG. 40, a case A for receiving a commodity a is provided with a guide means 102 for inserting a slider B so that the slider B is freely drawn out of the case and inserted into the case.

Figure 44:
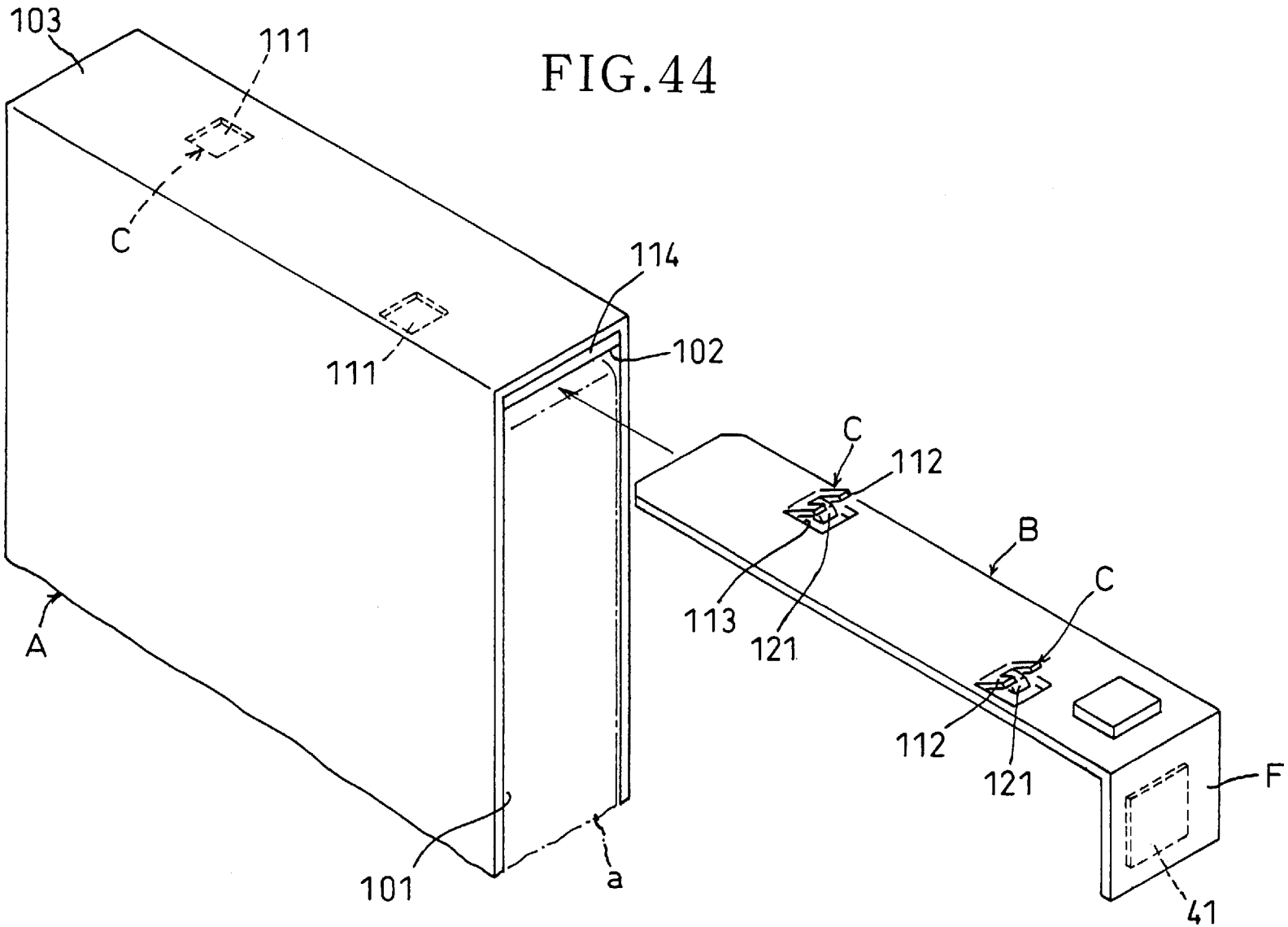
FIG. 44 is an exploded perspective view showing an eighth embodiment of the present invention.

The case A is arranged and displayed on a shelf at a rental shop in a state in which a video tape of the commodity a is received from an opening portion 101 at a rear face of the case A. The case A may be the following type case in accordance with a commodity received therein; for example, there is a type having a box body and a cover body which is provided on the box body via a hinge so that an opening portion of the box body is opened and closed, and a type in which an upper surface is opened as shown in FIG. 44.

Figure 31:
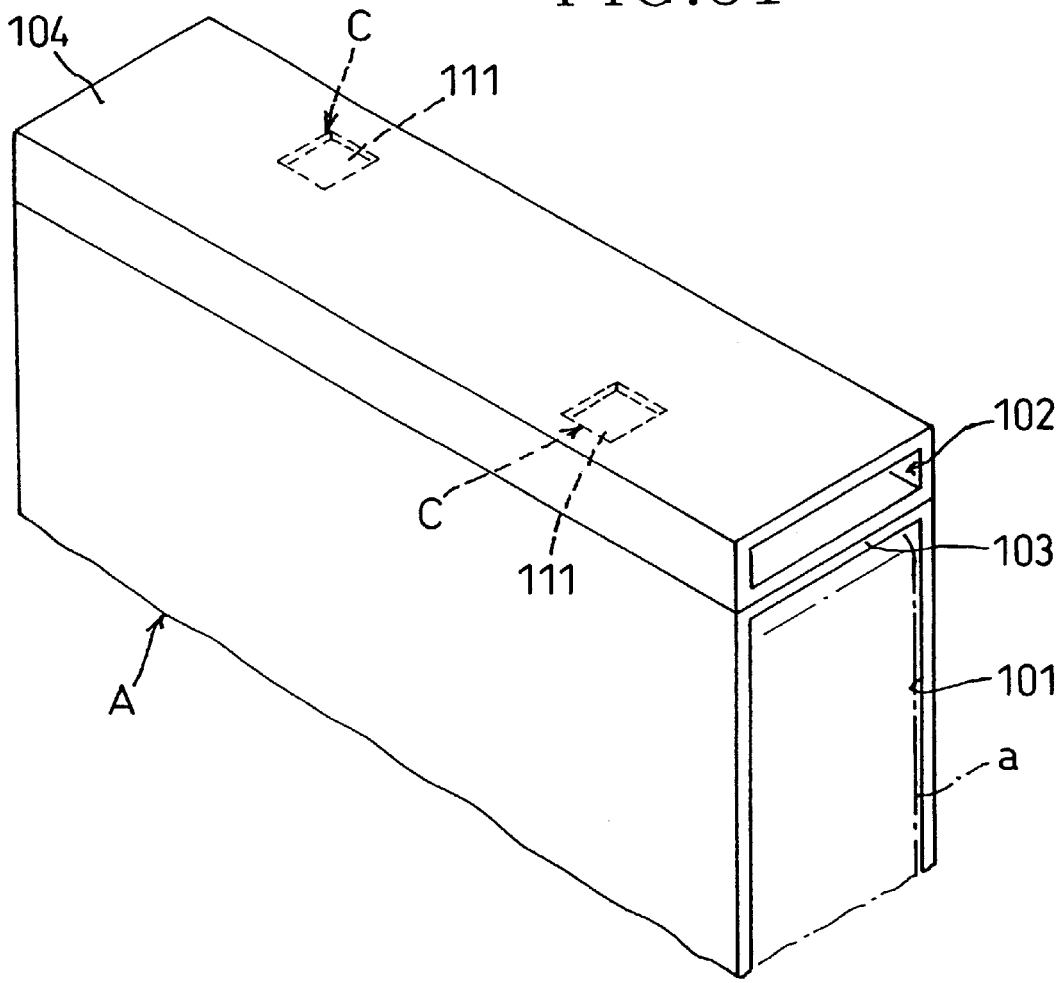
FIG. 31 is a perspective view showing another example of guide means.
Figure 32:
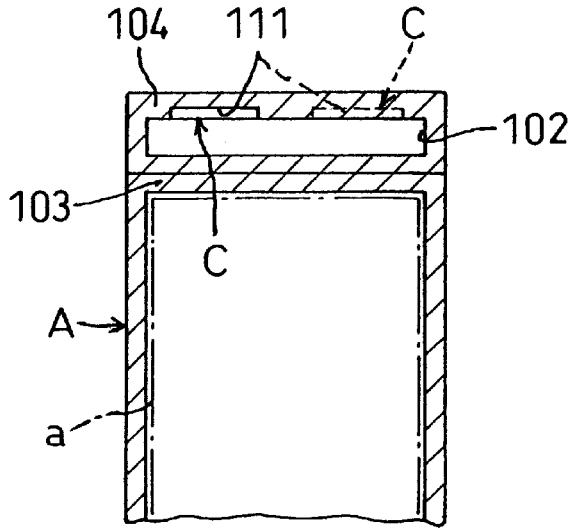
FIG. 32 is a longitudinal sectional front view showing the guide means.
Figure 35:
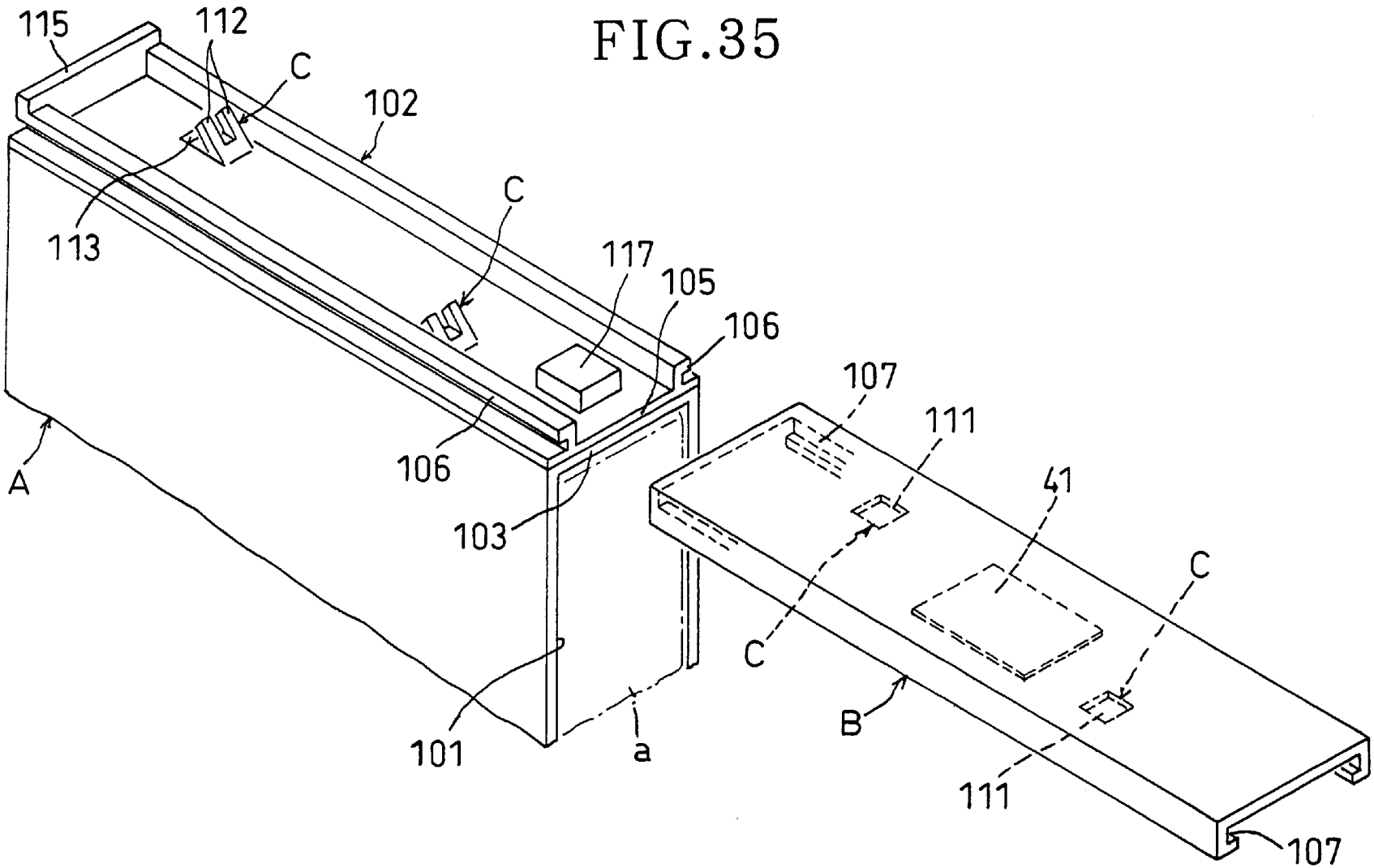
FIG. 35 is a perspective view showing another example of guide means.
Figure 36:
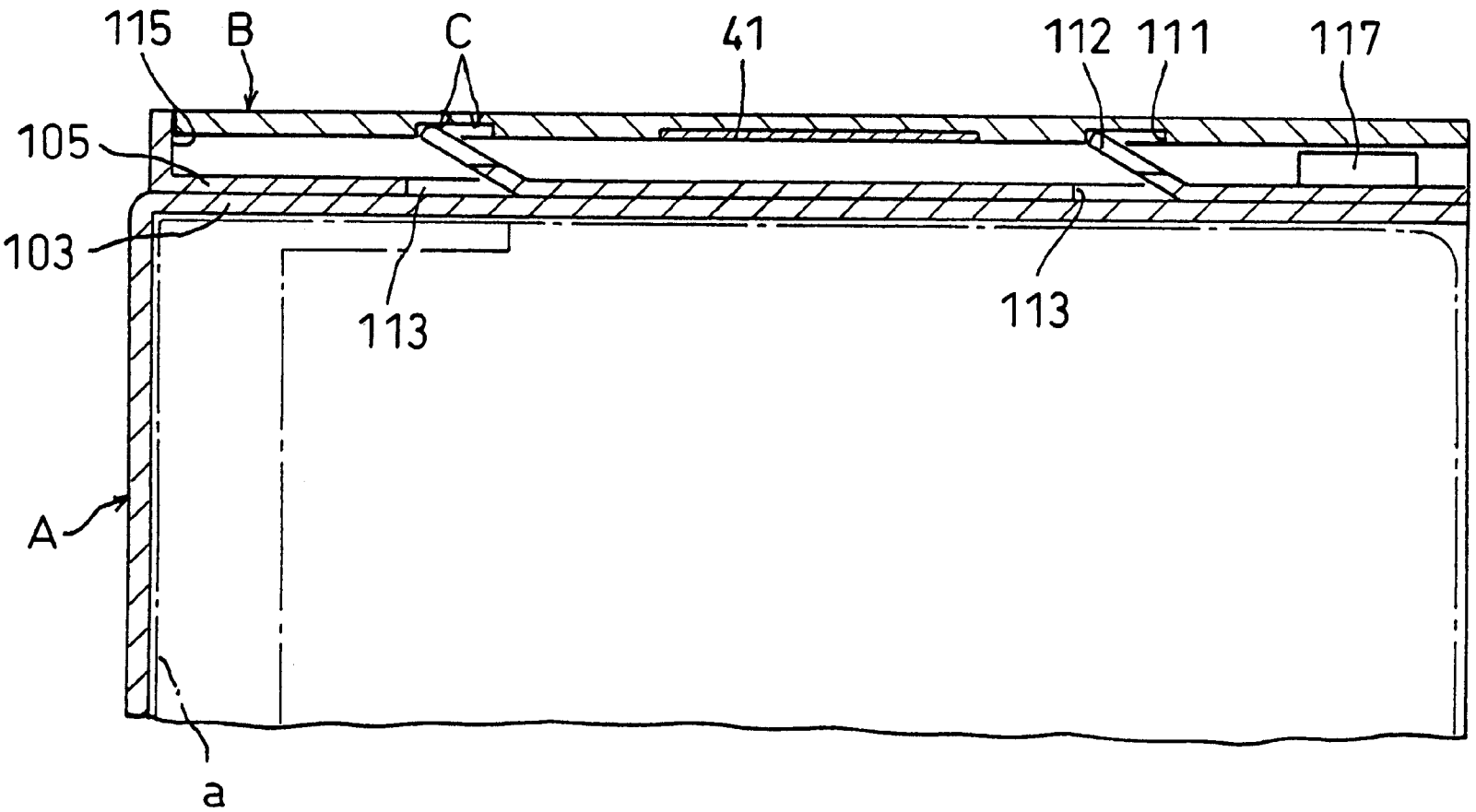
FIG. 36 is a longitudinal sectional side view showing a state in which the guide means and a slider are engaged.

The guide means 102 has the following two types. More specifically, as shown in FIG. 27 to FIG. 30, the guide means 102 is provided between an upper surface of the commodity a received in the case A from the opening portion 101 and a lower surface of a top wall 103 of the case A. Moreover, as shown in FIG. 31 and FIG. 32, a flat rectangular cylinder 104 is overlaid on the upper surface of the top wall 103 of the case A, and then, the overlaid surface is fixed by a fixing means such as a bonding agent, fusion bonding and the like. Besides, the rectangular cylinder 104 is molded integrally with the case A, and the inside of the rectangular cylinder 104 is used as the guide means 102. In addition, as shown in FIG. 33 and FIG. 34, a mounting wall 105 is fixed on the lower surface of the top wall 103 by a fixing means such as a bonding agent, fusion bonding and the like, and then, both side edge portions on the lower surface of the mounting wall 105 are formed into a protrusion 106; on the other hand, both side edge portions of the slider B are formed into a groove 107, and thus, the protrusion is fitted into the groove, and thereby, the guide means is performed. As shown in FIG. 35 and FIG. 36, a mounting wall 105 is fixed on the lower surface of the top wall 103 of the case A by the same fixing means as above, and then, the upper surface side of the mounting wall 105 is formed into protrusion 106; on the other hand, both side edge portions of the slider B are formed into a groove 107, and thus, the protrusion is fitted into the groove, and thereby, the guide means is performed. Although illustration is omitted, an L-letter parallel groove member or H-letter guide member is provided on the top wall 103, and a member such as an L-letter parallel groove member or H-letter guide member is provided on the top wall 103.

In short, the guide means 102 may be any other form so long as the slider B is freely drawn out and inserted into the case.

A blocking means C is provided on a surface where the case A or the guide means 102 and the slider B face each other. The blocking means C is pushed back when the slider B is inserted, and has an engagement when the insert of the slider B is completed, so as to block the draw-out and insert of the slider B.

As shown in FIG. 27 to FIG. 30, the blocking means C is composed of a recess-like blocking portion 111 whose lower surface is opened in the top wall 103 side of the case A, and a blocking member 112 whose free end is directed to a direction opposite to the insert direction of the slider B.

Figure 42:
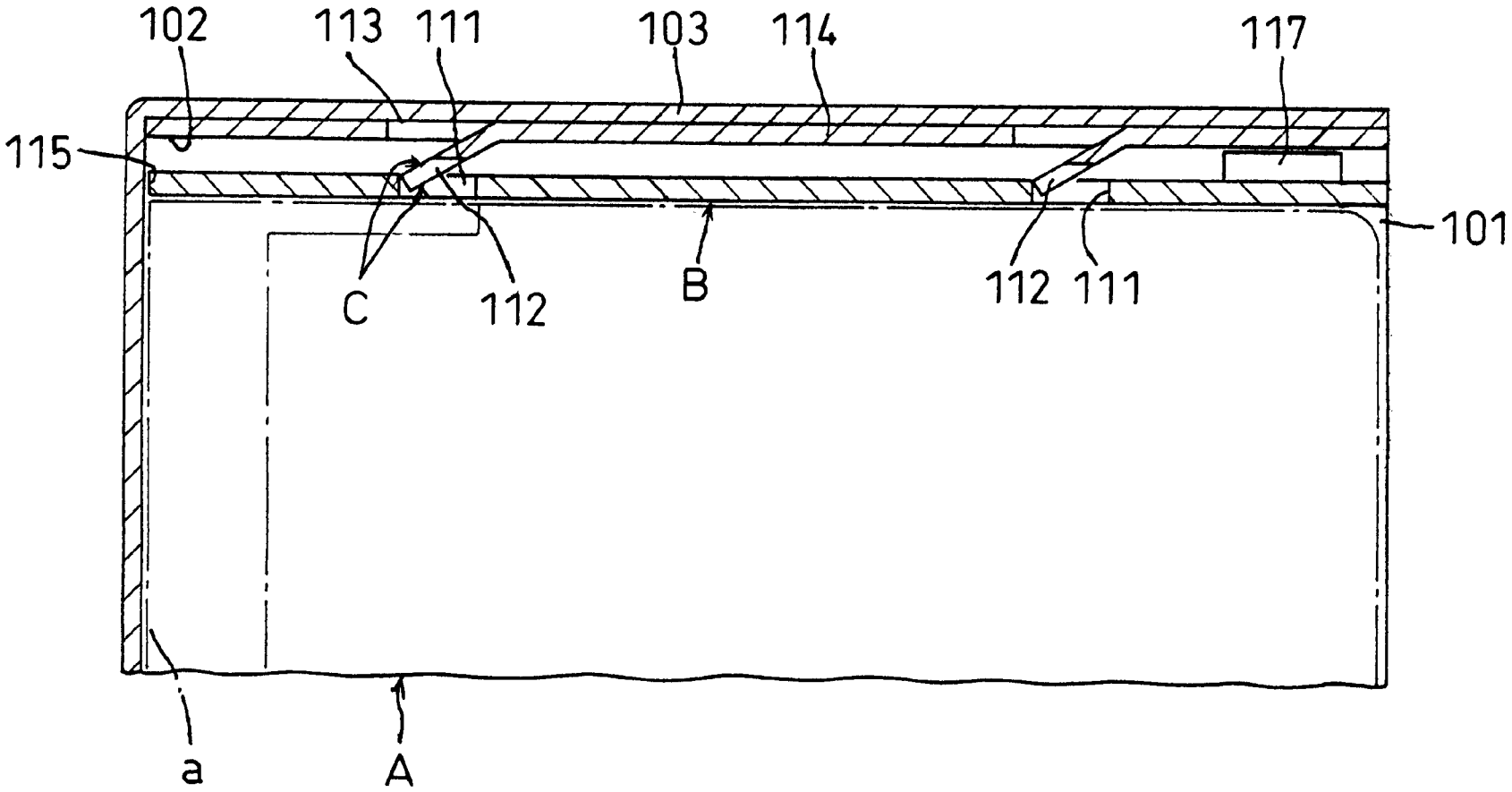
FIG. 42 is a longitudinal sectional side view showing another blocking portion.
Figure 43:
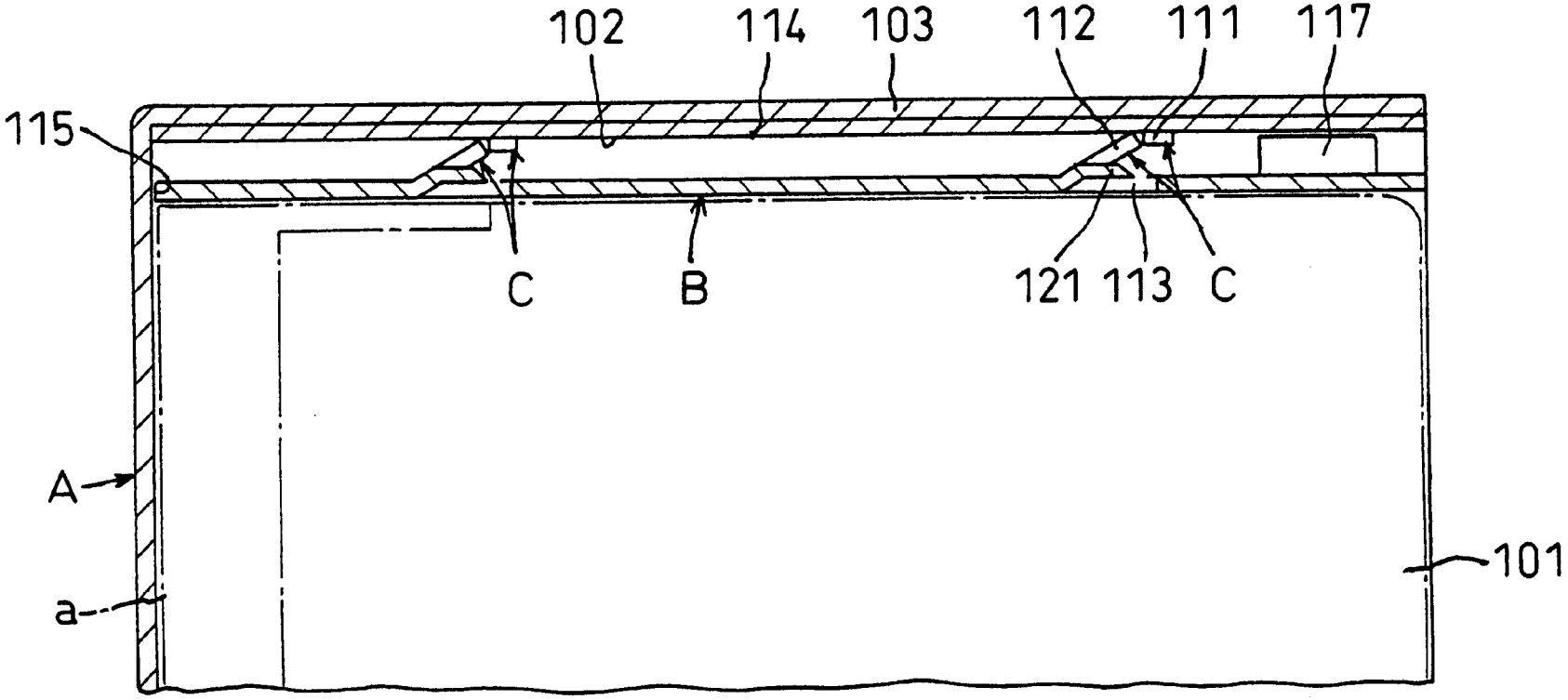
FIG. 43 is a longitudinal sectional side view showing another blocking portion.

The blocking portion 111 is formed into the recess (concave) shape, and besides, may be formed into a through hole as shown in FIG. 42 and may be formed into a protrusion as shown in FIG. 43. On the other hand, the blocking member 112 is formed in a manner that the slider B is formed with a U-letter slit 113, and an inside of the slit 113 is lifted up. A lower end of the blocking member 112 formed independently may be fixed on the slider B by a fixing means such as bonding, fusion bonding, iron.

As shown in FIG. 27 to FIG. 34, the blocking portion 111 is provided on the guide means 102 side, and the blocking member 112 is provided on the slider B side. Of course, as shown in FIG. 35 and FIG. 36, the blocking member 112 may be provided on the guide means 102 side, and the blocking portion 111 is provided on the slider B side.

Figure 37:
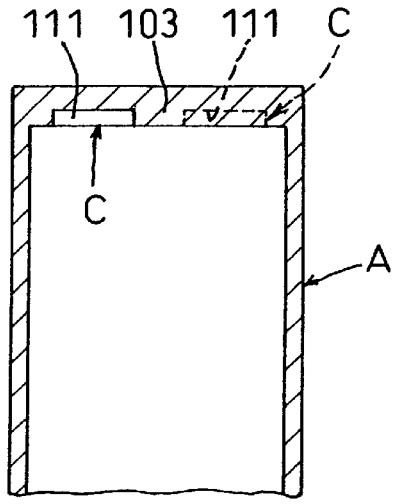
FIG. 37 is a longitudinal sectional front view showing a blocking portion.
Figure 38:
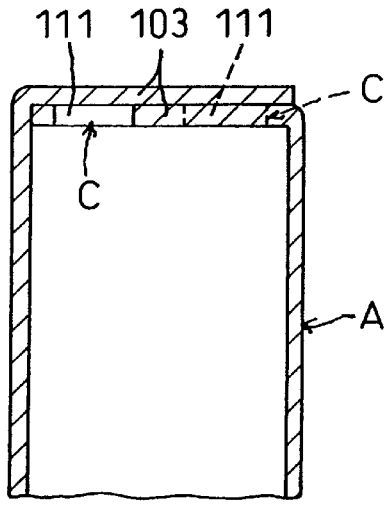
FIG. 38 is a longitudinal sectional front view showing another blocking portion.

In the case where a wall thickness of the top wall 103 of the case A is thin, or in there case where there is a problem in workability, a working plate 114 of the blocking means C is stuck to the lower surface of the top wall 103 by a proper fixing means, or as shown in FIG. 34, the mounting plate 105 is attached to the rectangular cylinder 104 wall shown in FIG. 31 and FIG. 32. Moreover, as shown in FIG. 37, a wall thickness of the top wall 103 of the case A is thickened more than that of other walls, or as shown in FIG. 38, the top wall of the case A is formed into a double wall, and further, the inside top wall is formed with a through hole blocking portion 111.

The slider B is positioned to an insert stop position by a proper stopper 115.

Figure 29:
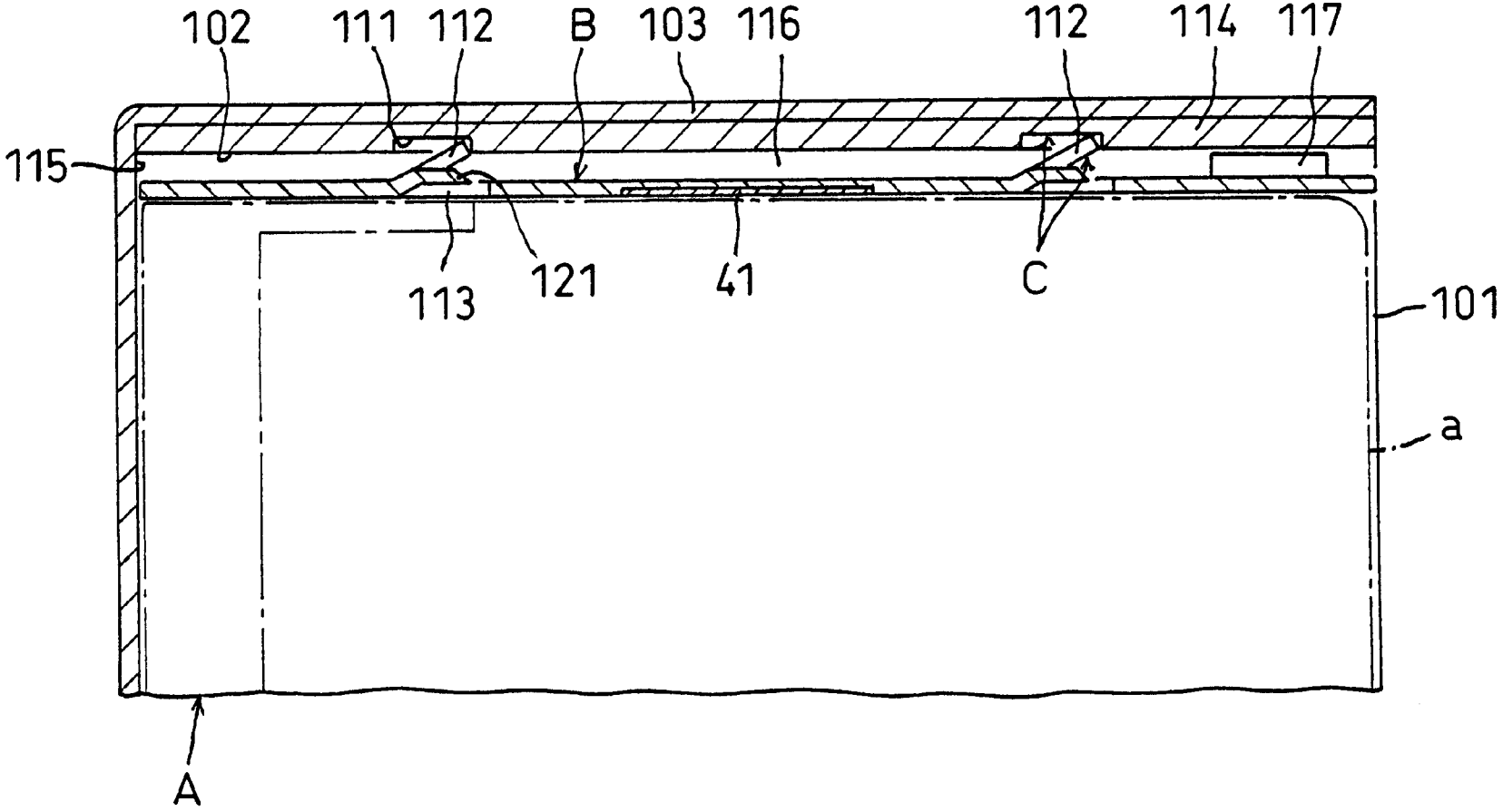
FIG. 29 is a longitudinal sectional side view showing a state in which the slider is inserted into the case.

The stopper 115 functions as a stopper in a manner as shown FIG. 29. The insert distal end of the slider B collides with the front wall of the case A, and besides, a closed wall on the end face of the rectangular cylinder 104 may be used, or as shown in FIG. 25 and FIG. 36, a projected portion of the edge of the mounting wall 31 may be used.

A space for inserting an engagement releasing tool D of the blocking means C is formed between opposite surfaces of the blocking means C.

Figure 39:
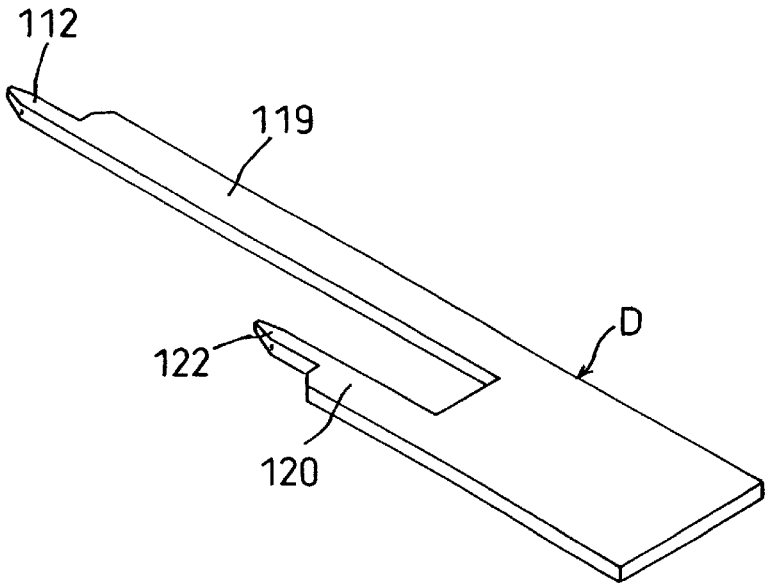
FIG. 39 is a perspective view showing an engagement releasing tool.
Figure 40:
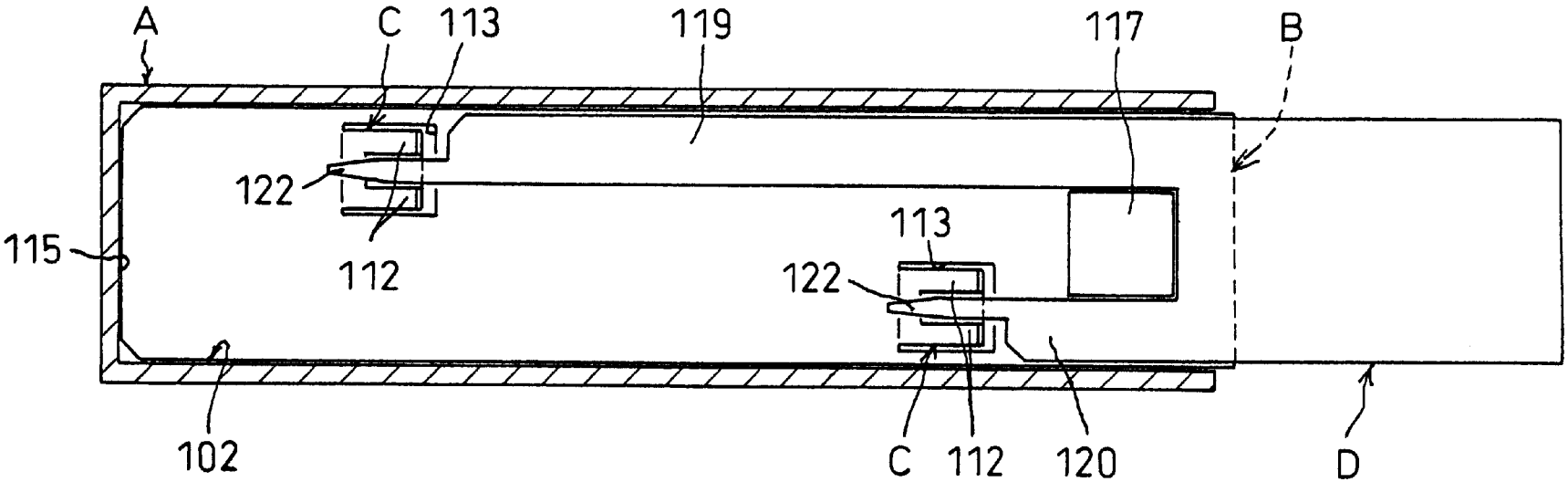
FIG. 40 is a transverse sectional plan view showing the engagement releasing tool.
Figure 41:
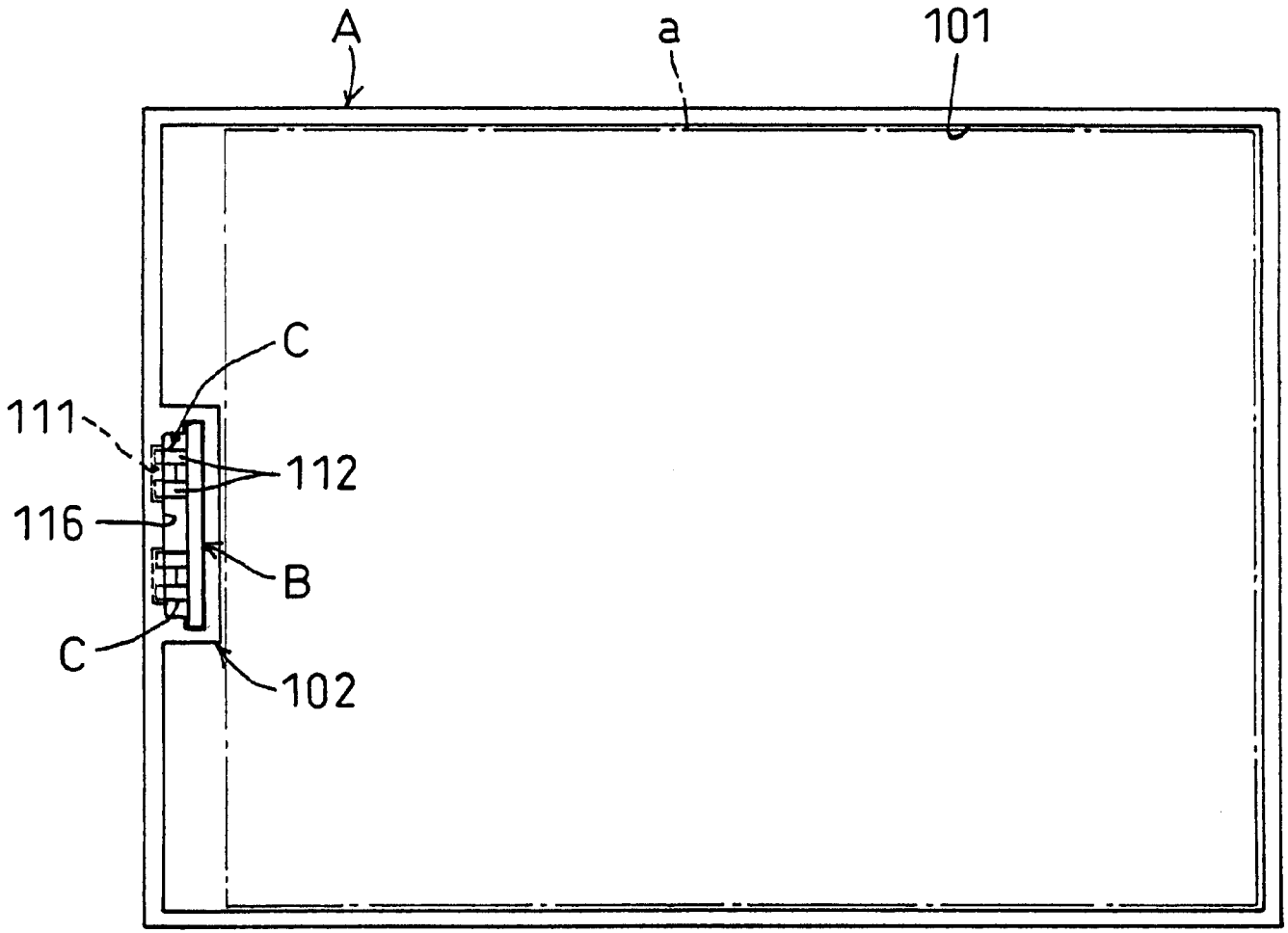
FIG. 41 is a top plan view showing another case.

As shown in FIG. 39 and FIG. 40, an obstacle portion 117 is formed in the space 116; for this reason, the engagement releasing tool D is provided with a fork-like longer piece portion 119 and shorter piece portion 120 so that the engagement releasing tool D does not collide with the obstacle portion 117. The longer piece portion 119 releases an engagement of the depth side blocking means C of rear and front two blocking means C, and the shorter piece portion 120 releases an engagement of the inlet side blocking means C of them.

The free end of each blocking member 112 is formed like a fork, and each blocking member 112 is formed with a guide portion 121 which projects in a direction opposite to the blocking portion 111. The above engagement releasing tool D releases an engagement in the following manner that when each pointed portion 122 of the longer and shorter piece portions 119 and 120 runs on the guide portion 121, the blocking member 112 is pushed back against a projecting force, and then, the free end of the blocking member 112 is released from the blocking portion 111.

Moreover, the slider B is attached with the antitheft tag 41 having a peculiar ID code.

In an antitheft implement according to a seventh embodiment, a commodity a is received in the case A, and the slider B is inserted into the guide means 102.

In this case, when the slider B is inserted, the blocking member 112 of the blocking means C is pushed back by the guide means 102, and then, when the insert of the slider B is completed, the blocking member 112 and the blocking portion 111 are engaged with each other. Therefore, the blocking member 112 thus pushed back is fitted into the blocking portion 111, and thereby, the blocking portion 111 and the blocking member 112 are automatically engaged as shown in FIG. 29 and FIG. 36, so that the slider B can be blocked from being drawn out of the guide means 102.

By doing so, in the case where the case A receiving a commodity a is taken out of a shop, a theft of the commodity is detected by the tag 41 attached to the slider B.

In the case of selling a commodity a, a salesperson inserts the engagement releasing tool D into the space 116.

Figure 30:
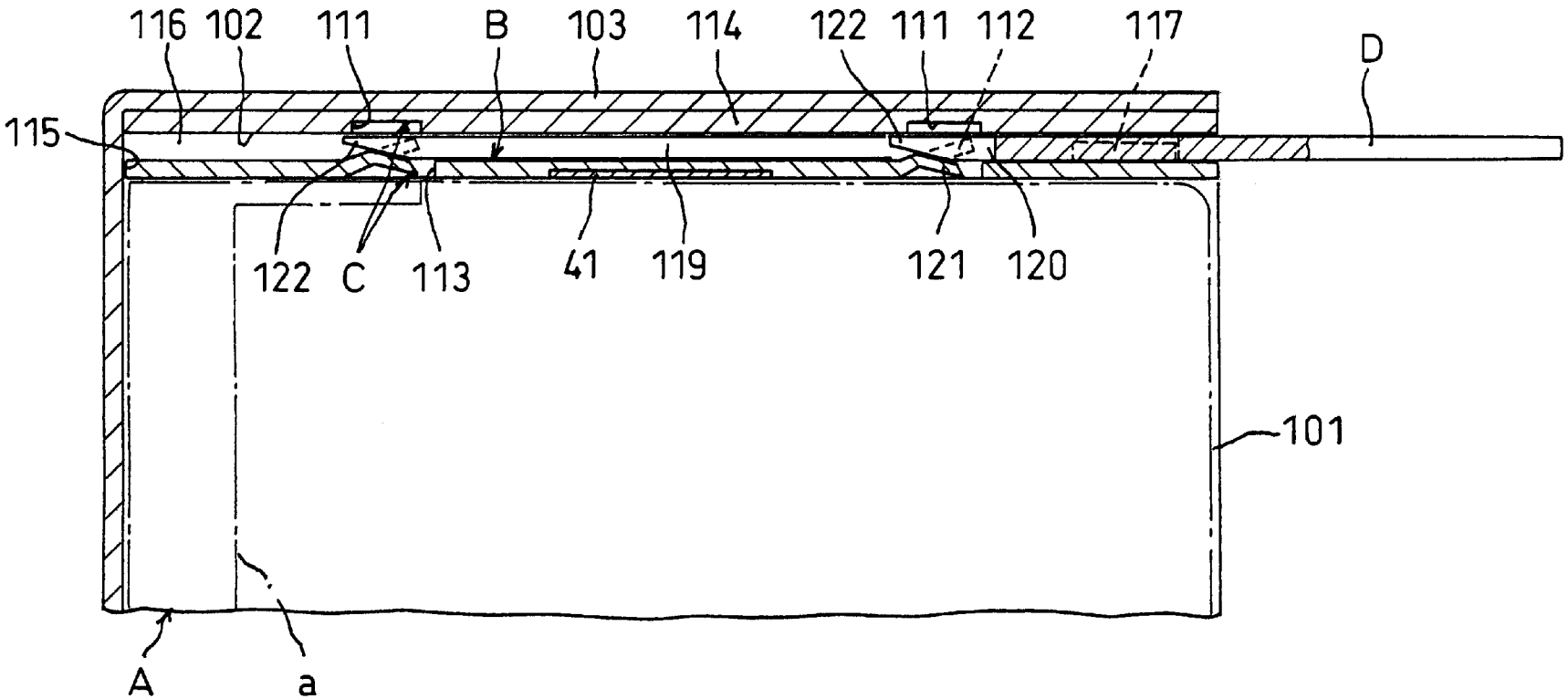
FIG. 30 is a longitudinal sectional side view showing a state in which an engagement releasing tool is inserted.

When the engagement releasing tool D is inserted, each pointed portion 122 of the longer and shorter piece portions 119 and 120 runs on the guide member 121, and then, when the insert of the engagement releasing tool D is continued, the blocking member 112 is pushed; therefore, as shown in FIG. 30, the blocking member 112 is released from the blocking portion 111, and thus, the engagement is released.

For this reason, when drawing out the engagement releasing tool D, the slider B is simultaneously drawn out, and then, the slider B thus drawn out is left at a shop side.

In a rental shop, it is possible to perform a lending service of the commodity a together with the case A, and in a shop, it is possible to sell the commodity a together with the case A.

By using a contact pressure of the surface where the engagement releasing tool D and the slider B overlap with each other, the blocking member 112 is pushed so that the draw-out of the slider B is permitted. When the insert of the engagement releasing tool D is completed, the engagement releasing tool D and the slider B overlap with each other by a proper means, or a hooking means may be provided on a surface where they face.

A shape of the engagement releasing tool D is formed into a forked shape in accordance with an arrangement of the blocking means C; however, the shape is not limited to a forked shape. More specifically, the number of the blocking means C and the arrangement are free, and the engagement releasing tool D may be any other form so long as the blocking member 112 is pushed back by the insert of the engagement releasing tool D so as to release an engagement of the blocking member 112 and the blocking portion 111.

According to an eighth embodiment of the present invention, as shown in FIG. 44 to FIG. 49, the slider B of the above seventh embodiment is provided with a stopper F which is projected from the side end opposite to the insert end, and prevents a commodity a from being drawn out of the opening portion 101 of the case A.

The above stopper F is provided integrally with the slider B. An independent stopper F may be fixed to the slider B.

In the above eighth embodiment, the opening portion 101 formed in the case A, the guide means 102, the slider B, the blocking means C provided in the slider B and the case A and the tag 41 are the same as the seventh embodiment; therefore, their details are omitted.

The tag 41 may be attached to a rear surface of the stopper F without being limited to the slider B.

Figure 47:
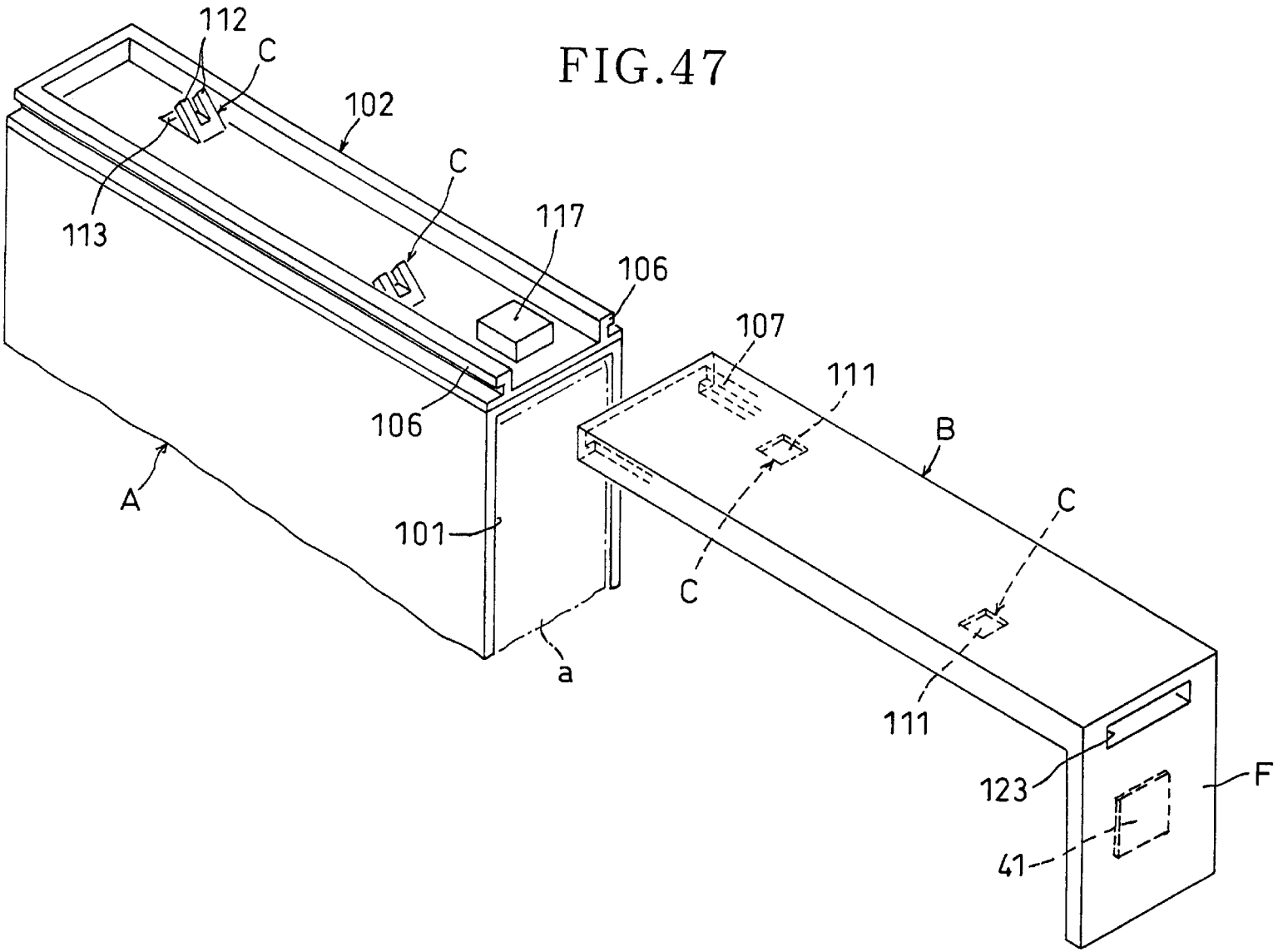
FIG. 47 is a perspective view showing another example of the guide means and the slider.
Figure 48:
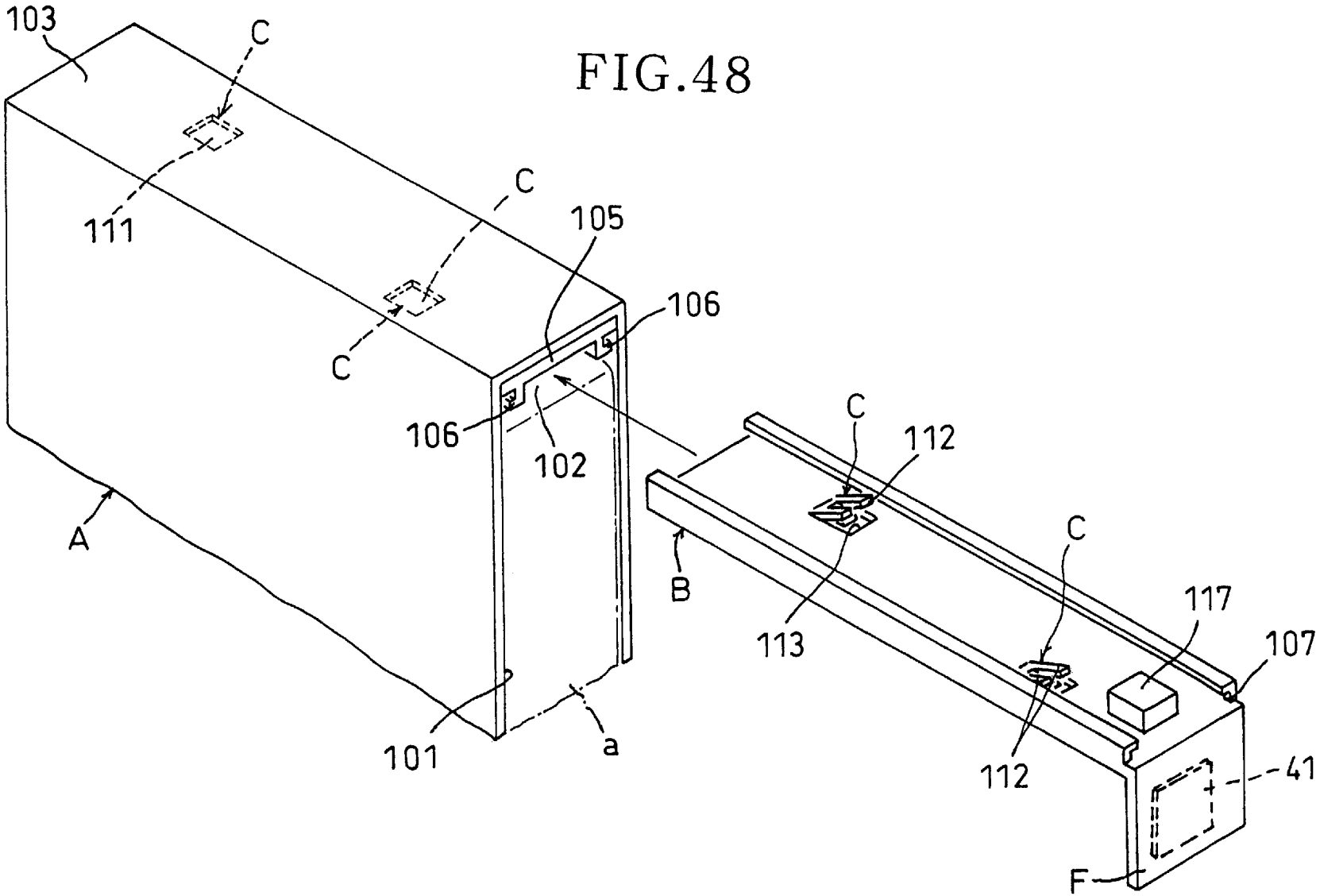
FIG. 48 is a perspective view showing another example of the guide means and the slider.

Moreover, the slider B is provided with the stopper F; for this reason, in the case where the engagement releasing tool D is not inserted, as shown in FIG. 47, the stopper F may be formed with a through window 123 for inserting the engagement releasing tool D.

Figure 45:
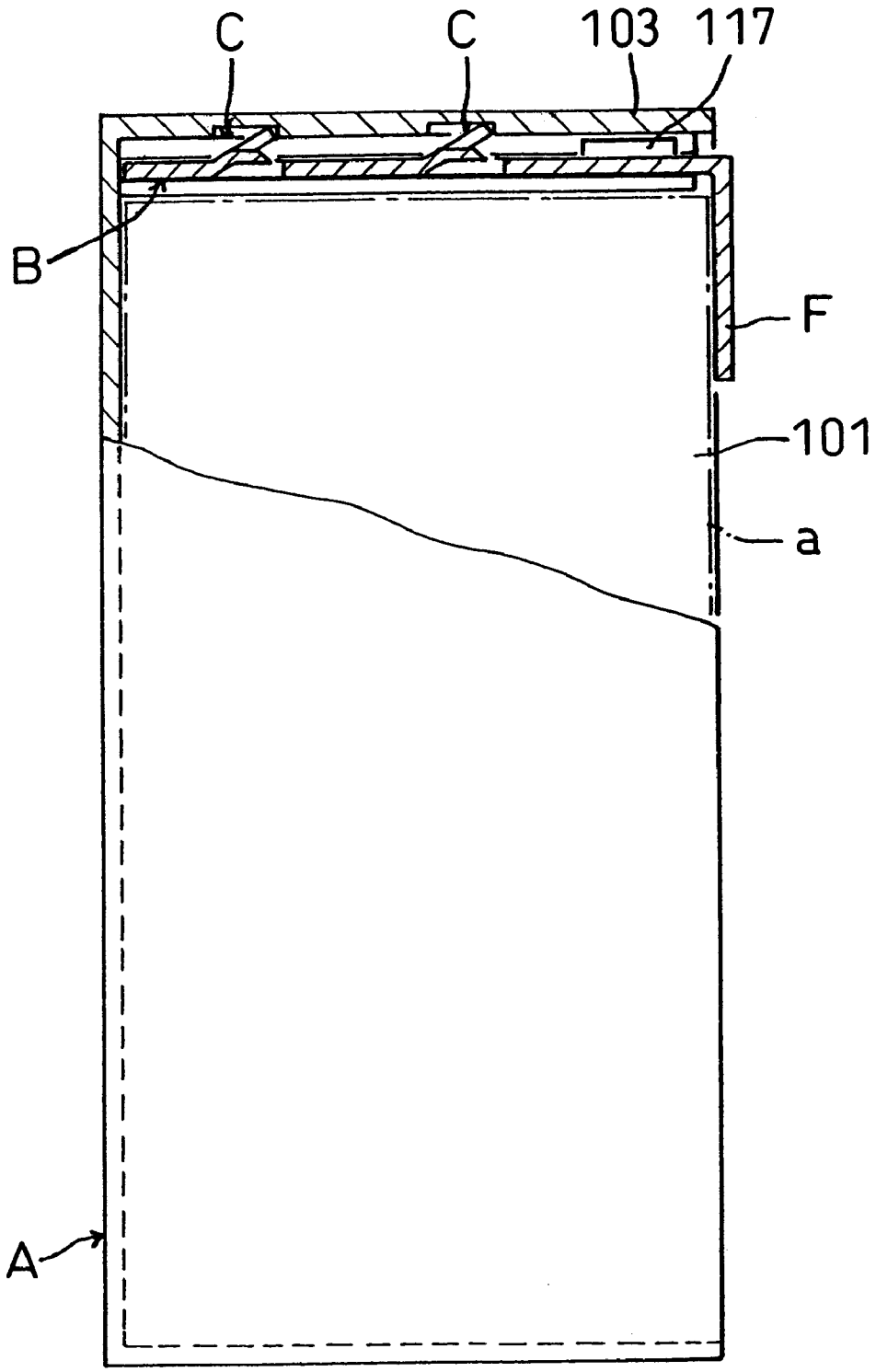
FIG. 45 is a longitudinal sectional side view showing a state in which a slider is inserted into a case.
Figure 46:
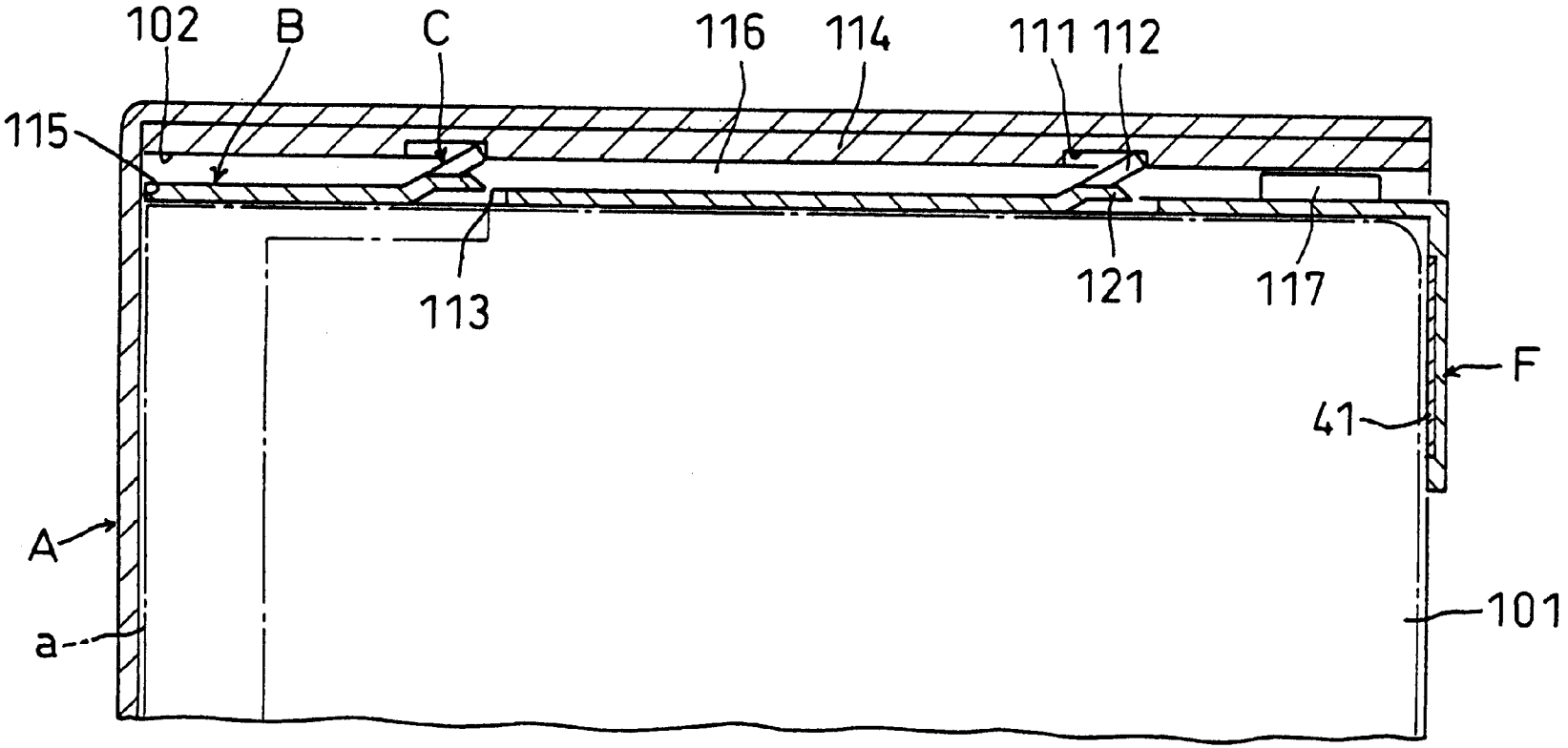
FIG. 46 an enlarged longitudinal sectional side view showing principal parts.
Figure 50:
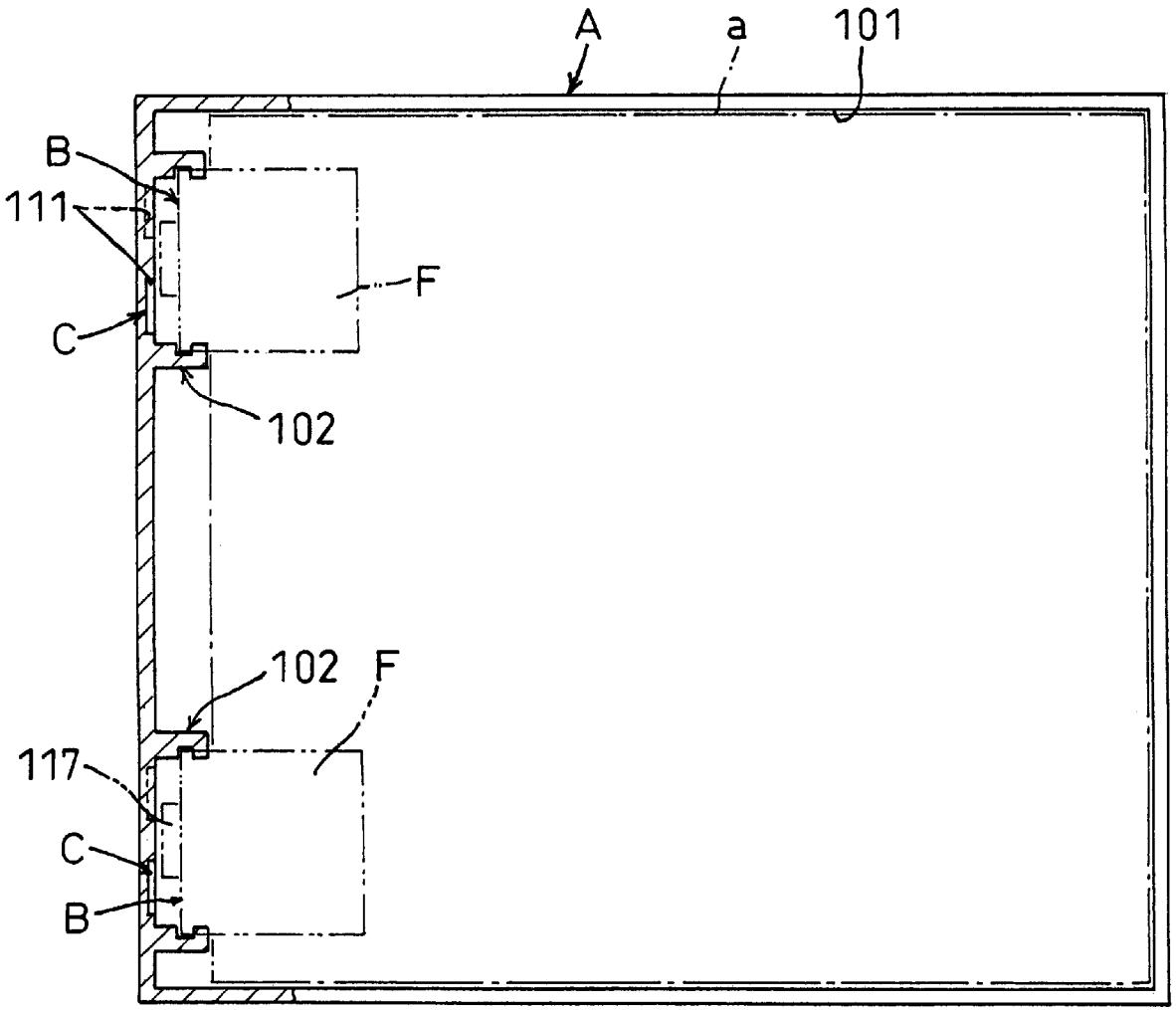
FIG. 50 is a transverse sectional plan view showing another example of the case.

In the eighth embodiment, a commodity a is received in the case A, and thereafter, the slider B guided by the guide means 102 is inserted, and then, the slider B is set so as not to be drawn out of the case A by an engagement of the blocking means C. By doing so, as shown in FIG. 45, FIG. 46 and FIG. 50, the stopper F faces the commodity a, and the commodity a is blocked from being drawn out of the case A, and thus, it is possible to prevent a theft of the commodity a.

Figure 49:
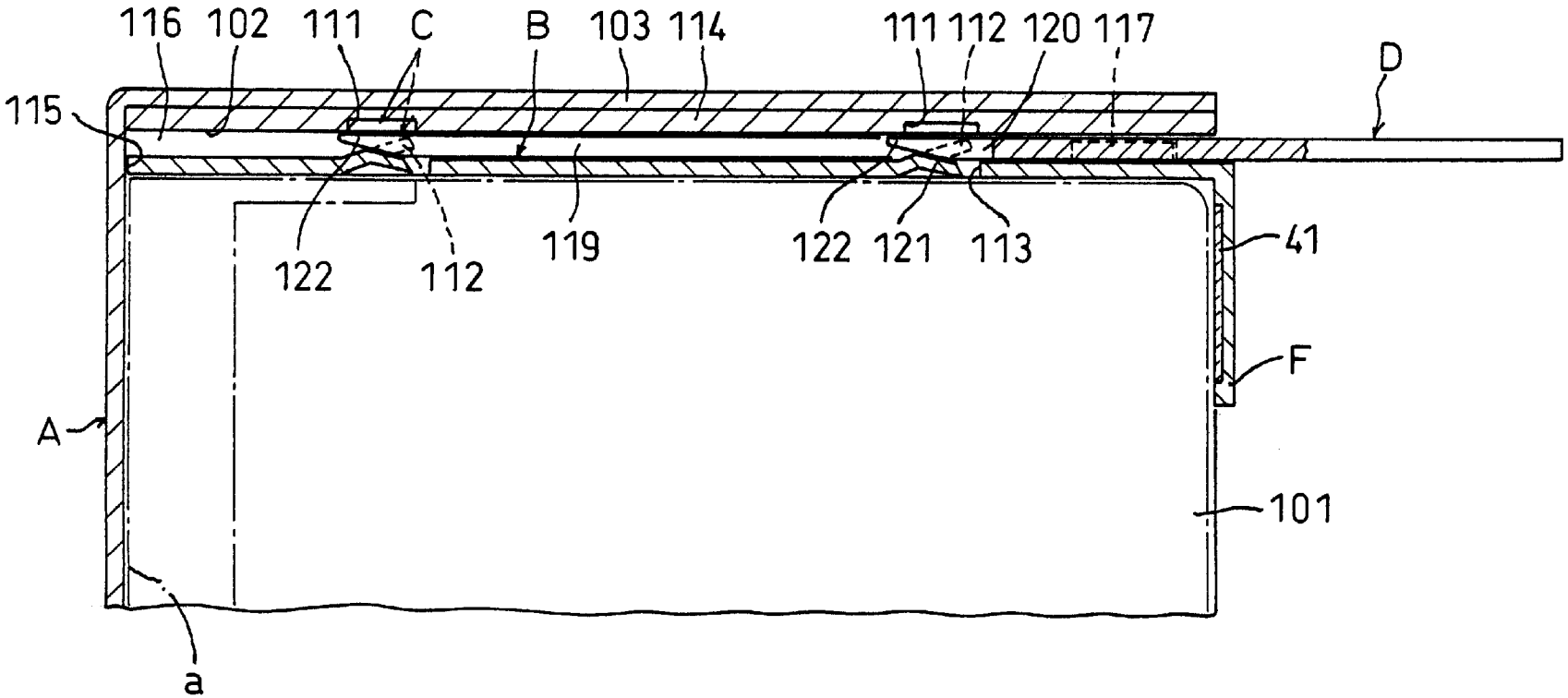
FIG. 49 is a longitudinal sectional side view showing a state in which an engagement releasing tool is inserted.

In the case where the commodity a is taken out of a shop together with the case A, the theft of the commodity a is detected by the tag 41, and in the case of drawing the slider B attached with the tag 41, the engagement releasing tool D is used as shown in FIG. 49.

The operation and effect of the engagement releasing tool D are the same as the seventh embodiment; therefore, the details are omitted.

Figure 51:
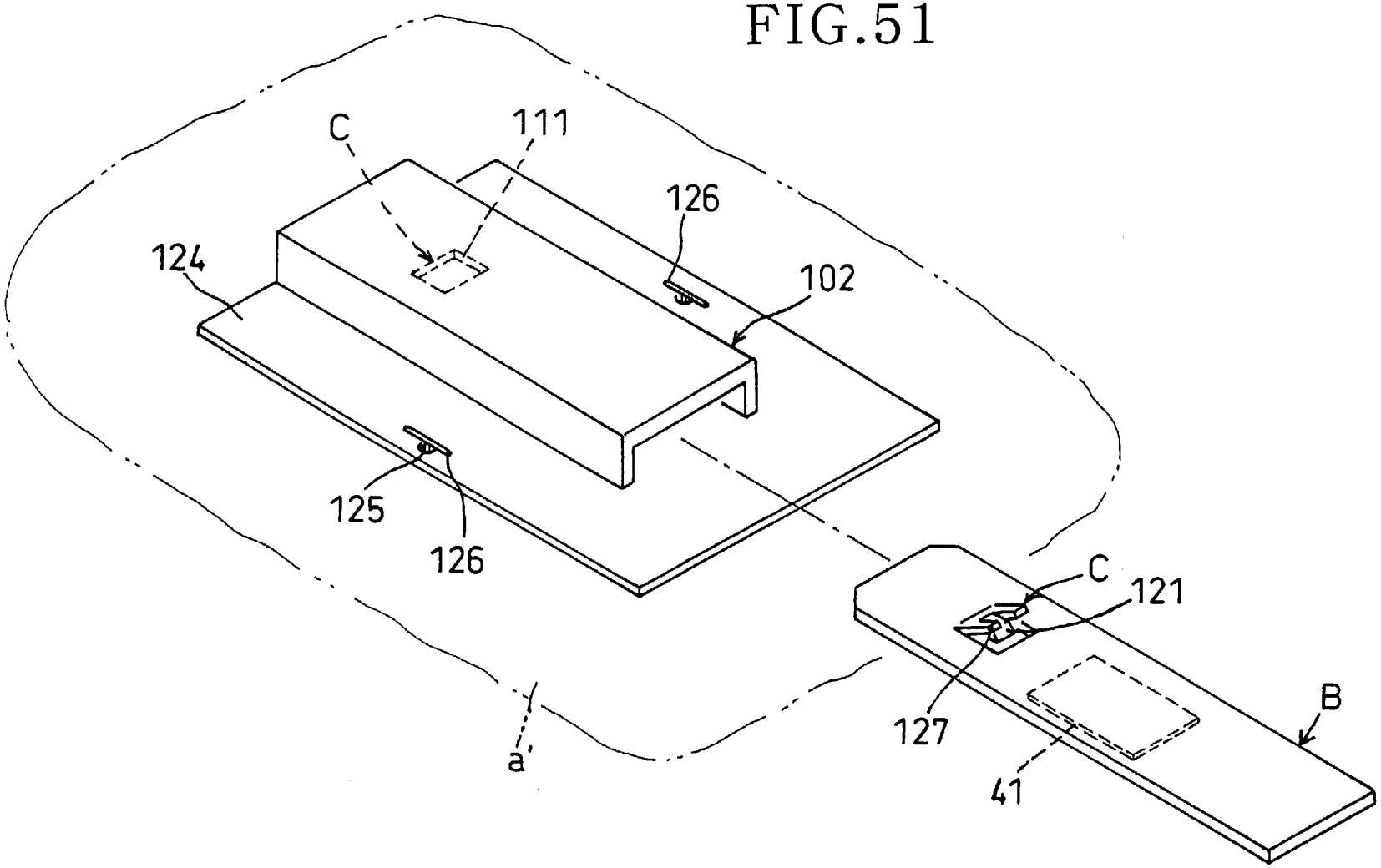
FIG. 51 is a perspective view showing a ninth embodiment of the present invention.
Figure 52:
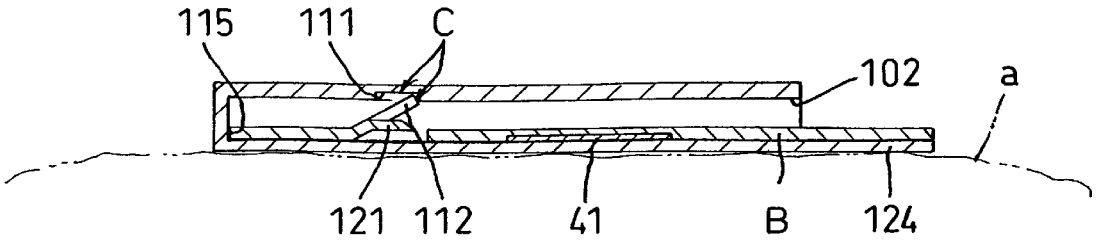
FIG. 52 is a longitudinal sectional side view showing a state in which the slider is inserted.
Figure 53:
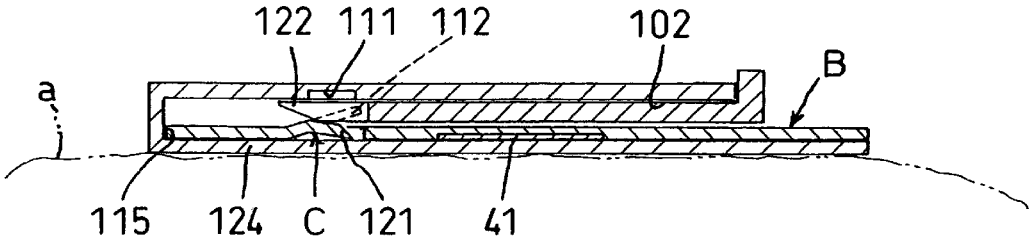
FIG. 53 is a longitudinal sectional side view showing a state in which an engagement releasing tool is inserted into the slider.

According to a ninth embodiment, as shown in FIG. 51 and FIG. 52, a mounting member 124 is attached to a commodity a' by a proper means, and the mounting member 124 is provided with the guide means 102. The slider B is freely drawn and inserted by the guide means 102, and the inserted slider B is prevented from being drawn out by the blocking means C. In a shop side, an engagement of the blocking means C is released by using an engagement releasing tool D.

The above guide means 102, the slider B, the blocking means C and the engagement releasing tool D are the same as the seventh embodiment; therefore, their details are omitted.

Of course, the slider B is attached with the tag 41 for preventing a theft of the commodity.

The mounting member 124 is attached to the commodity a' in the following manner; more specifically, in the case of clothes, a soft synthetic resin stopper pin 126 is stuck into a through hole 125 formed in the mounting member 124. Depending upon the commodity a', the mounting member 124 may be attached to the commodity a' by other means so long as the mounting member 124 with guide means 102 is not obstructed.

With the above structure, the slider B attached with the tag 41 is inserted, and thereby, it is possible to detect a theft of the commodity a'.

In the case of selling the commodity a', the slider B is drawn out by using the engagement releasing tool D, and then, the slider B thus drawn out is recovered by a shop side, and is reused.

The above operation is the same as the seventh embodiment; therefore, the details are omitted.

Figure 54:
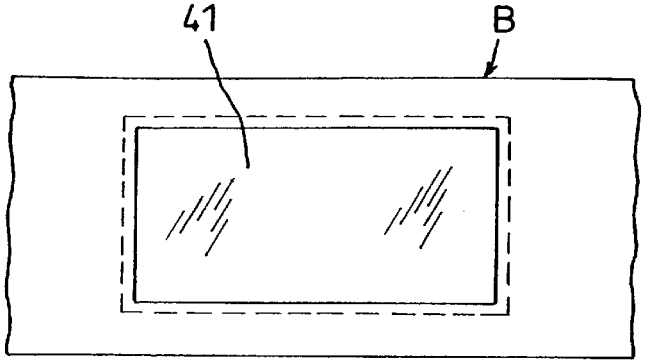
FIG. 54 is a top plan view showing an antitheft implement according to a tenth embodiment of the present invention.
Figure 55:
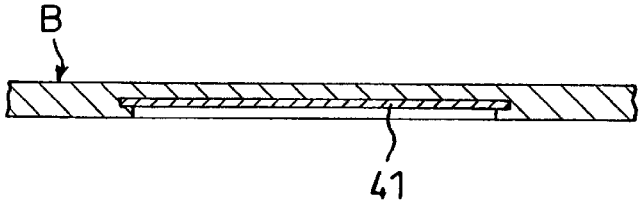
FIG. 55 is a longitudinal sectional side view showing the antitheft implement.

According to a tenth embodiment of the present invention, as shown in FIG. 54 and FIG. 55, the tag 41 is attached to the slider B in a state of being embedded therein.

The tag 41 is embedded in the slider B in the following manner; more specifically, in molding the slider B out of a synthetic resin, the tag 41 is embedded in the slider B, and in this case, a foil of the tag 41 and a conductor such as wire materials are all embedded therein, or the tag 41 is partially exposed as shown in FIG. 54 and FIG. 55.

Whereby it is possible to dispense a work for attaching the tag 41 to the slider B using a bonding agent.

In the antitheft implement according to the above seventh to tenth embodiments, it is possible to prevent the following thefts of taking out a received commodity together with the case, and stealing the commodity out of the case, and the slider B attached with the tag 41 is recovered at a shop side, and thereafter, can be reused, and further, it is possible to prevent the commodity from being unfairly taken out.

Moreover, in molding the slider B, the tag 41 is embedded in the slider B; therefore, it is possible to dispense a work for sticking the tag 41.

In an antitheft implement according to an eleventh embodiment of the present invention, as shown in FIG. 56 to FIG. 64, a through window 201 is provided at a predetermined position of an antitheft object commodity A, and an insert member 203 provided with the antitheft tag 41 is freely inserted into and drawn out of the through window 201.

Figure 56:
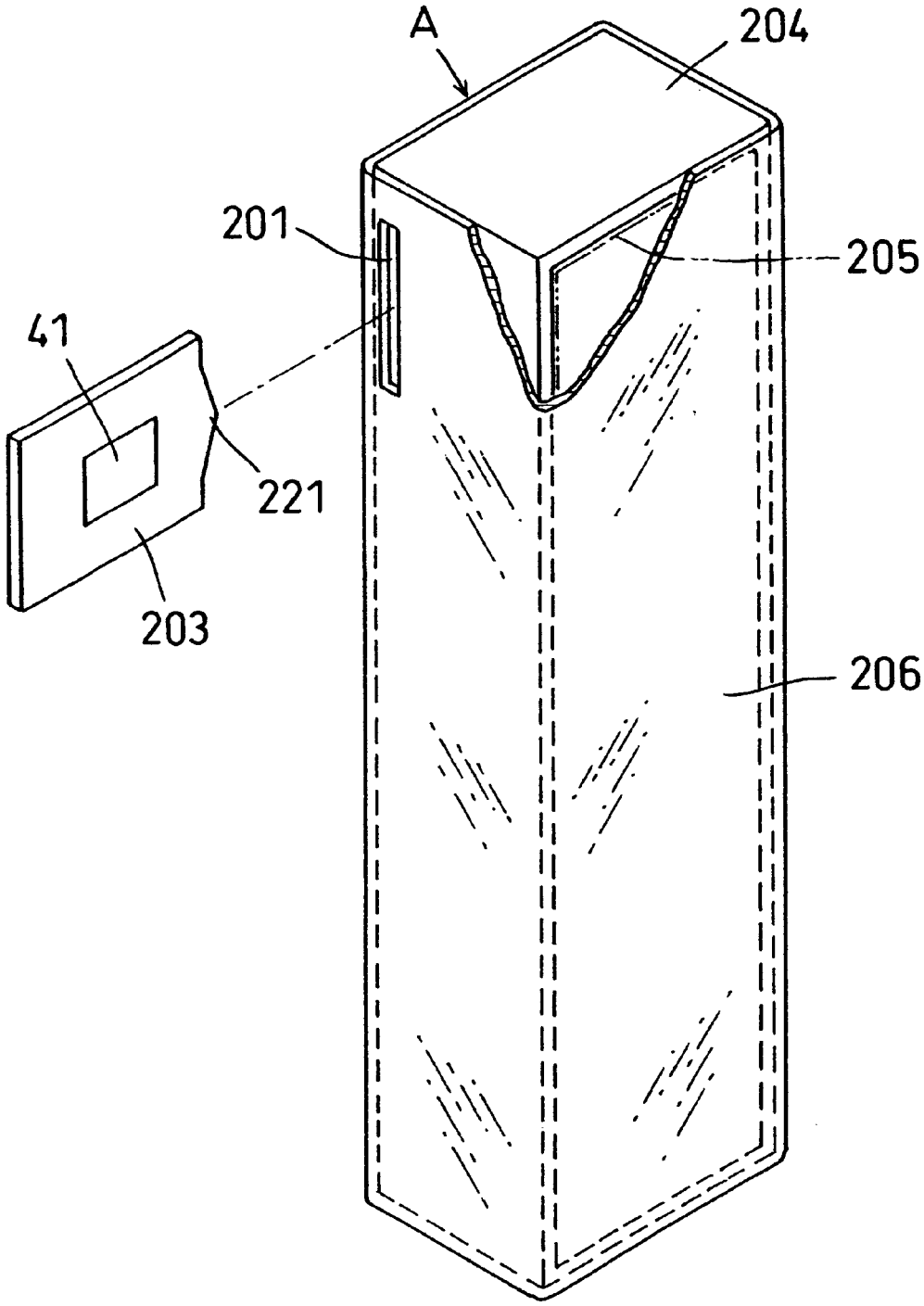
FIG. 56 is a perspective view partly in section showing an antitheft implement according to an eleventh embodiment of the present invention.
Figure 57:
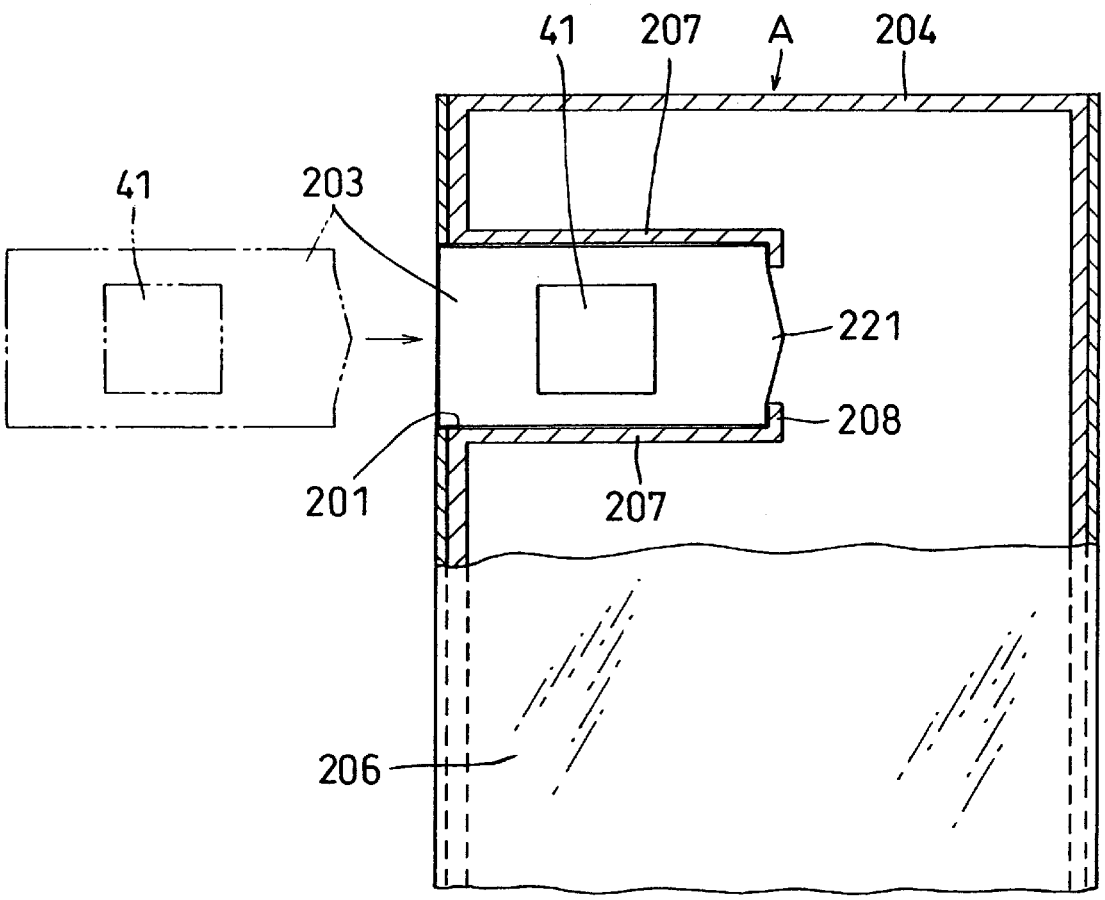
FIG. 57 is an enlarged longitudinal sectional front view showing principal parts of the antitheft implement.
Figure 58:
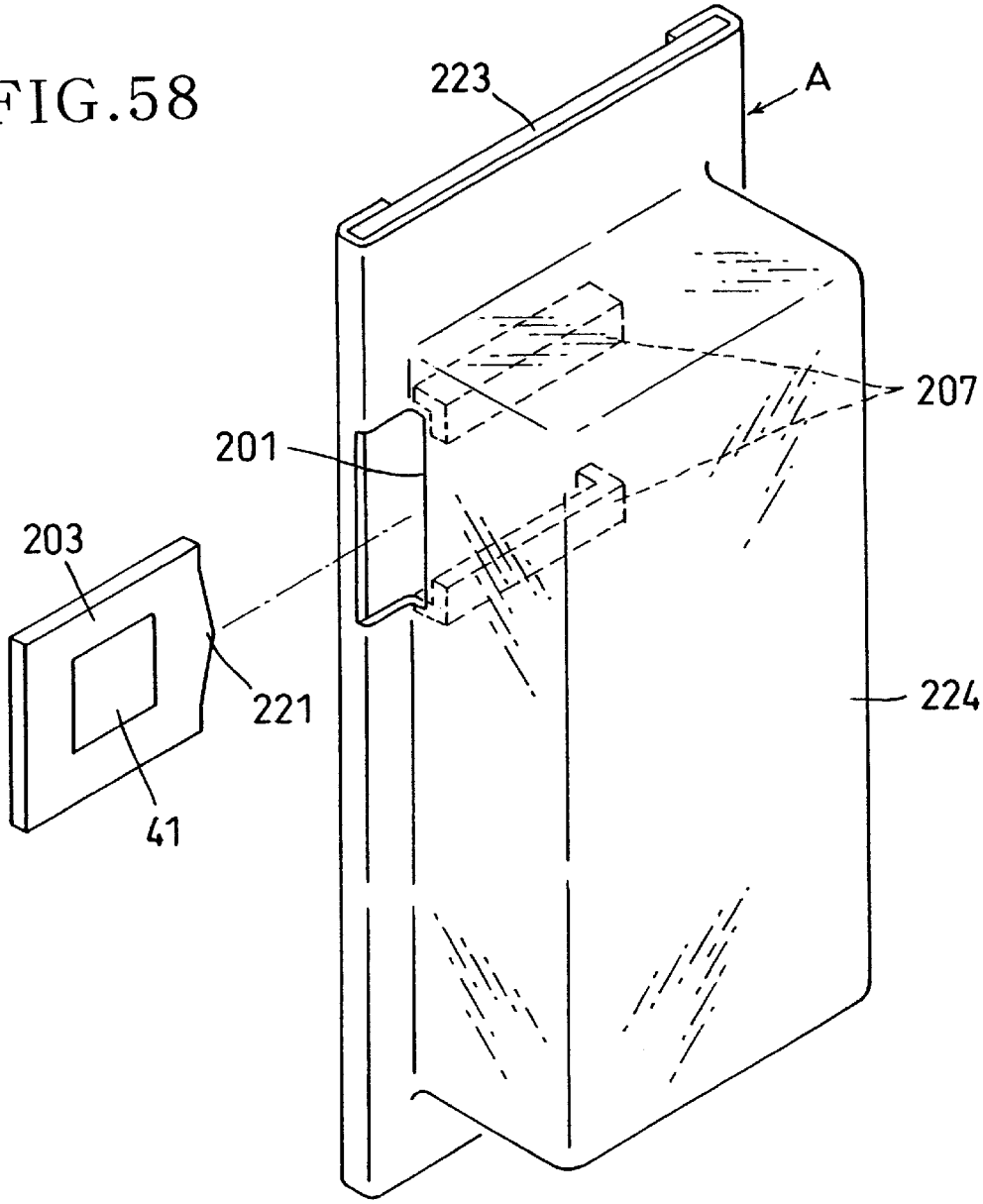
FIG. 58 is a perspective view showing another example of an antitheft object.
Figure 59:
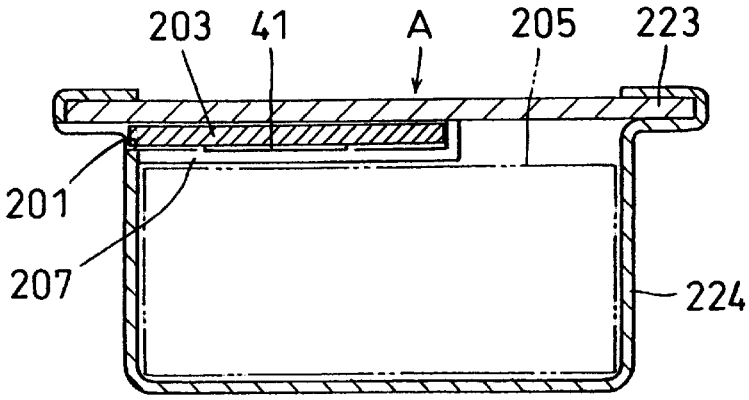
FIG. 59 is a transverse sectional plan view showing the antitheft object.

The antitheft object commodity A is applied to commodities requiring a theft of the commodity to be prevented while displaying them. For example, the following commodities are cited as the antitheft object commodity A; more specifically, an article 205 is received in a case 204 as shown in FIG. 56 and FIG. 57, and then, the outer side of the case is covered with a cover 206 made of a transparent synthetic resin capable of visibly confirming the article 205. As shown in FIG. 58 and FIG. 59, there is a blister packaging type, for example, a cover 224 is combined in a manner of molding plastic in accordance with a shape of a pasteboard 223 and an article 205, and besides, there are a skin packaging type and a strip packaging type. Usually, the antitheft object commodity A comprises a box body and cover body, and it is difficult to take out the article in displaying by a thermal shrinkable film covering the outer side of the commodity, and besides, there are other packaging types.

Of course, if the above cover 206 is made of a hard material incapable of being broken through, the cover 206 is provided with a window equivalent to the through window 201 of the case side.

Moreover, the tag 41 may be stuck to and embedded in the insert member 203.

The insert member 203 inserted from the through window 201 is guided by a proper guide means 207 in the antitheft object commodity A so as to be freely drawn out and inserted.

Figure 60:
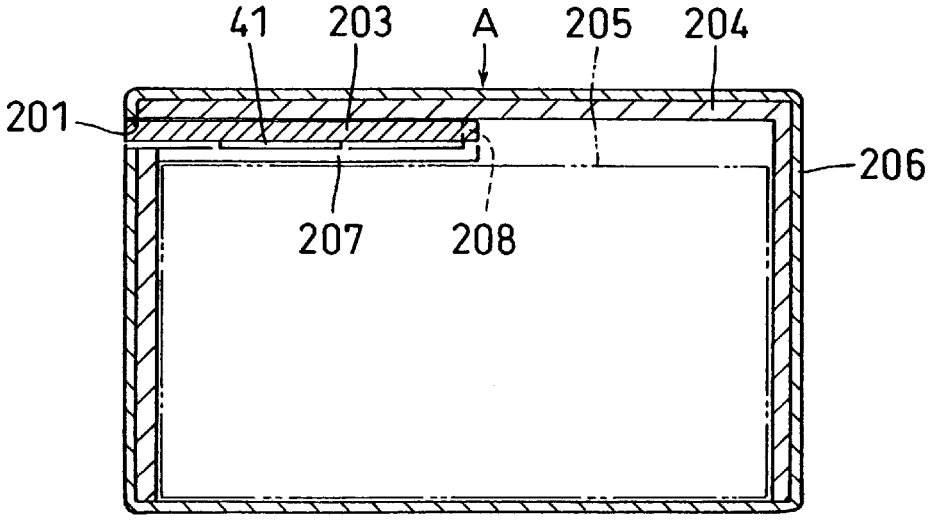
FIG. 60 is a transverse sectional plan view showing a state in which an insert member is inserted.
Figure 61:
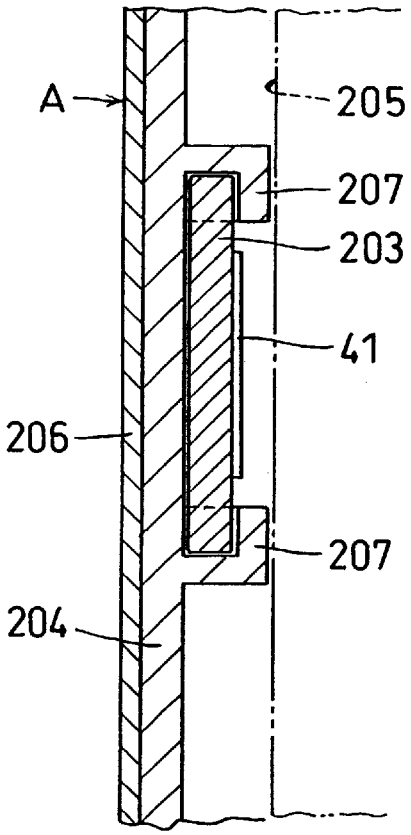
FIG. 61 is a longitudinal sectional side view showing a state in which the insert member is inserted.
Figure 62:
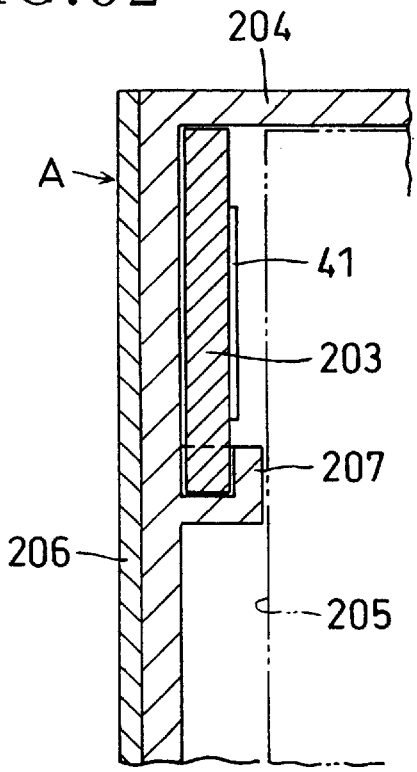
FIG. 62 is a longitudinal sectional front view showing a guide means.

In order to provide the above guide means 207, the following methods are employed. For example, two L-shaped rails are provided up and down on an inner surface of a side wall of the case 204 of the commodity A as shown in FIG. 57 to FIG. 59, and then, is molded integrally with the case 204, or independent rails are fixed thereto by a bonding agent or the like. As shown in FIG. 60 and FIG. 62, one rail is provided so as to guide the lower edge of the insert member 203, and then, the upper edge of the insert member 203 is guided by a top wall of the case 204.

In this case, the rail of the guide means 207 is not limited to the L-letter shape, and the rail may be formed into a flat rail so long as the insert member 203 does not come off the rail by the article 205 received in the case 204.

In FIG. 60, a reference numeral 208 denotes a stopper of the insert member 203 provided in the guide means 207.

With the above construction, in displaying the commodity A in a shop, the insert member 203 is inserted into the antitheft object commodity A from the through window 201 by the shop side.

By doing so, in the case where the antitheft object commodity A is taken out of the shop, it is possible to detect a theft of the commodity by the tag 41 of the insert member 203.

In selling the antitheft object commodity A, the insert member 203 is pulled out by a salesperson, and then, the insert member 203 thus pulled out is left at a shop side, and is reused.

Figure 63:
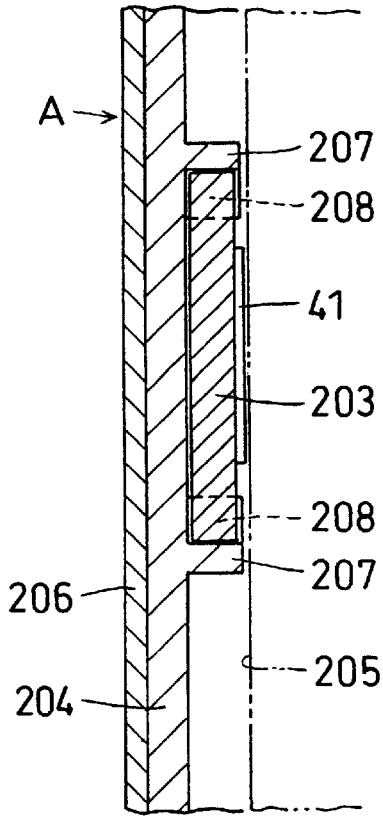
FIG. 63 is a longitudinal sectional front view showing another guide means.
Figure 64:
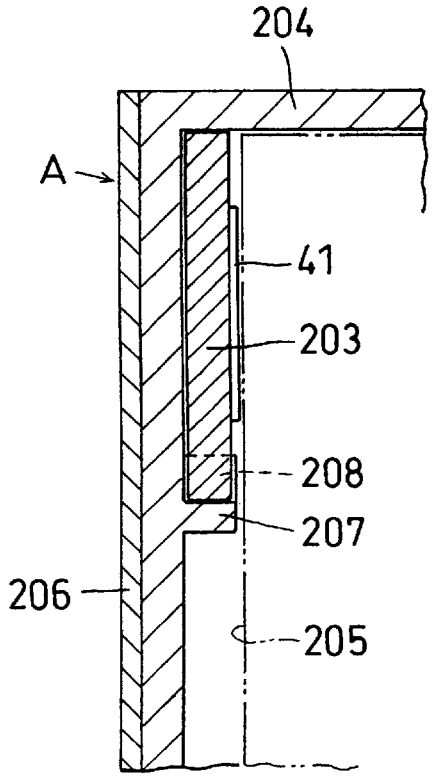
FIG. 64 is a longitudinal sectional front view showing another guide means.
Figure 65:
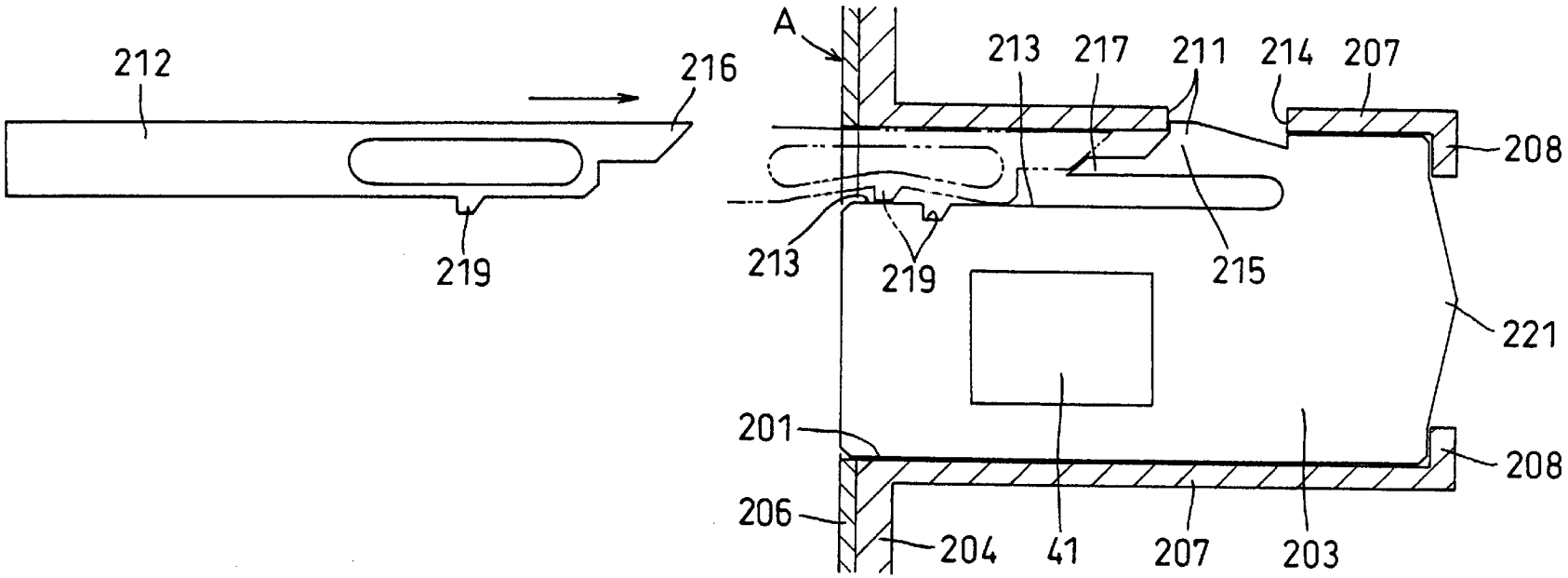
FIG. 65 is a longitudinal sectional front view showing an antitheft implement according to a twelfth embodiment of the present invention.

According to a twelfth embodiment of the present invention, as shown in FIG. 63 to FIG. 65, a blocking means 211 is provided between the commodity A and the inserted insert member 203, or between the guide means 207 and the inserted insert member 203. The blocking means 211 is pushed back when the insert member 203 is inserted, and makes an engagement when the insert of the insert member 203 is completed. An insert space 213 is formed at a surface facing the blocking means 211, and a releasing tool 212 for releasing an engagement of the blocking means 211 is inserted into the space 213.

The above space 213 is formed in a manner of notching the insert member 203 from its upper edge to the distal end direction. The blocking means 211 blocks a draw-out of the insert member 203 in the following manner. More specifically, the guide means 207 is formed with a hole 214, and the insert member 203 is provided with a locking pawl 215, and then, when the insert member 203 is inserted, the locking pawl 215 contacting with the guide means 207 is pushed back, and thus, as shown in FIG. 63, at the point of time when the insert of the insert member 203 is completed, the locking pawl 215 thus pushed back is fitted into the hole 214 so as to make a locking state. In the locking pawl 215 of the guide means 207, the insert member 203 is provided with a recess portion engaging with the locking pawl 215, or the hole 214 is formed into a recess portion.

The above releasing tool 212 releases an engagement in the following manner; more specifically, a pointed portion 216 on an insert distal end is pushed between a projected portion 217 of the locking pawl 215 and the guide means 207 so as to release an engagement of the locking pawl 215, and as shown in FIG. 64, when an engagement is released, the locking pawl 215 is released from the hole 214.

In this case, the antitheft object commodity A, the insert member 203, and the guide means 207 are the same as the eleventh embodiment; therefore, the details are omitted.

With the above construction, it is possible to prevent the insert member 203 inserted into the through window 201 from being drawn out by an engagement of the blocking means 211.

By doing so, in the case where the antitheft object commodity A is taken out of the shop, it is possible to detect a theft of the commodity by the insert member 203 with the tag 41 in the antitheft object commodity A.

In selling the antitheft object commodity A, the releasing tool 212 is inserted into the space 213 so as to release an engagement of the blocking means 211, and in a state of releasing an engagement, the insert member 203 is drawn out together with the releasing tool 212, and further, the releasing tool 212 and the inserted member 203 thus drawn out are left at a shop side.

In this case, when the insert member 203 is drawn out, the locking pawl 215 is pushed back, and thereby, the projected portion 217 is pushed against the pointed portion 216 by a resilience force of the push-back, so that the insert member 203 can be drawn out together with the releasing tool 212 by a contact pressure.

Moreover, as shown in FIG. 63 and FIG. 64, at the point of time when the insert of the releasing tool 212 is completed, the releasing tool 212 and the insert member 203 are combined by an automatically engaging portion 219, and thereby, when the releasing tool 212 is drawn out, the insert member 203 can be also securely drawn out.

The above engaging portion 219 is formed in the following manner; more specifically, the insert member 203 is formed with a recess portion, and the releasing tool 212 is formed with a protrusion, and further, the releasing tool 212 is formed with a long slot 220 in a manner that when the releasing tool 212 is inserted, the releasing tool 212 contacts with an edge of the space 213 so as to be pushed back, and then, when the insert of the releasing tool 212 is completed, the protrusion pushed back is automatically fitted into a recess portion. By doing so, even if the releasing tool 212 has the protrusion, it is possible to insert the releasing tool 212 without hindrance.

Figure 66:
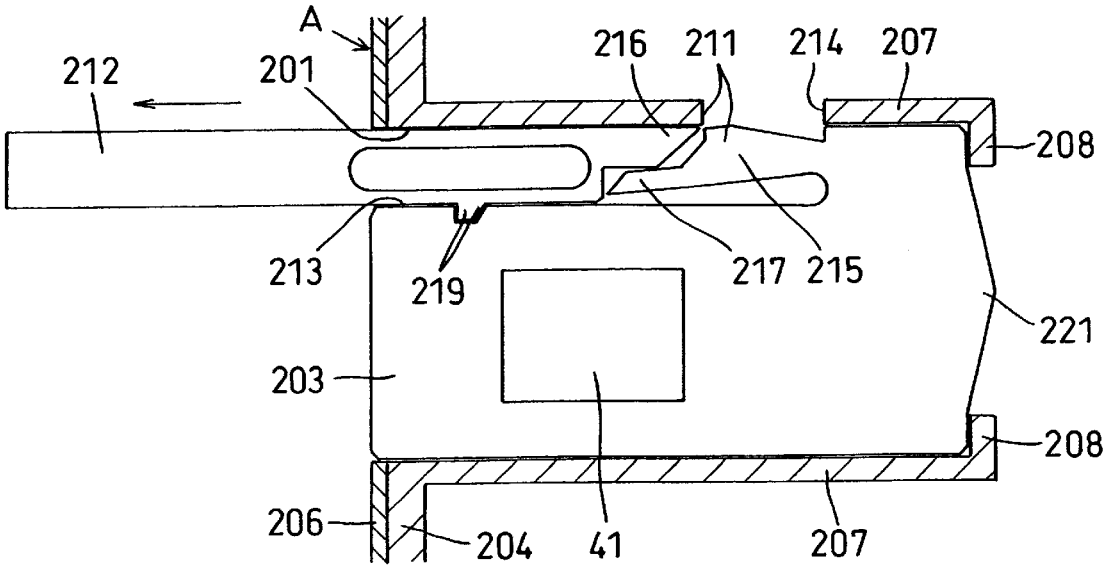
FIG. 66 is a longitudinal sectional front view showing a state in which a releasing tool is used.
Figure 67:
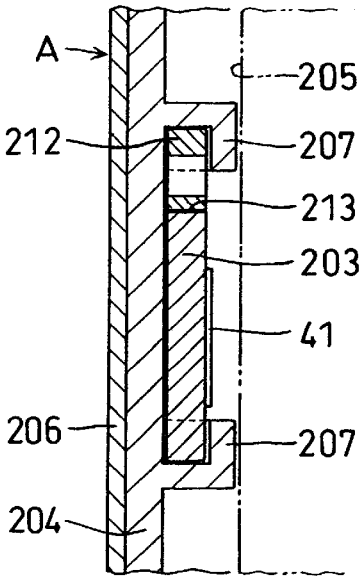
FIG. 67 is a longitudinal sectional side view showing a state in which the releasing tool is used.
Figure 68:
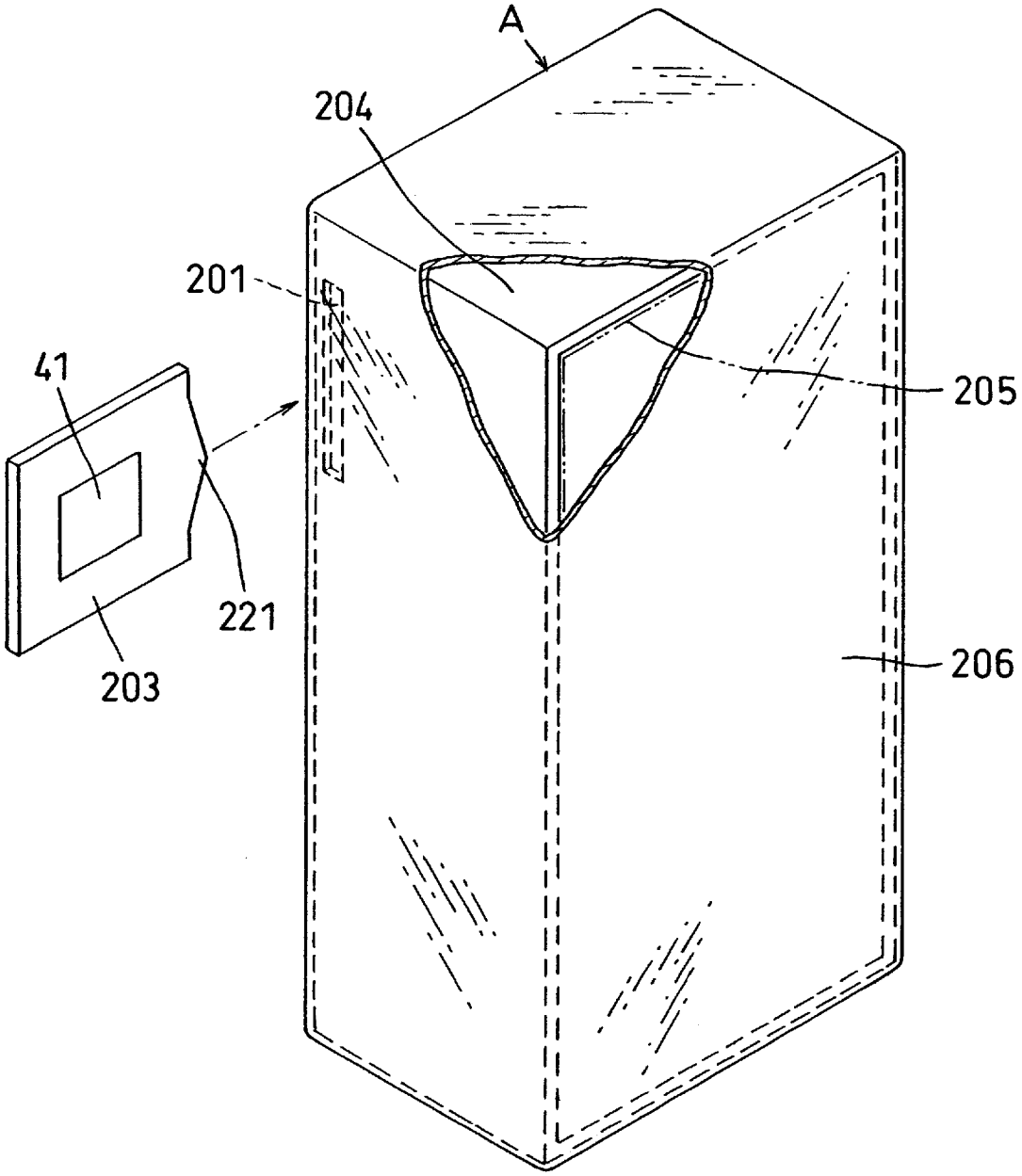
FIG. 68 is a perspective view showing an antitheft implement according to a thirteenth embodiment of the present invention.
Figure 69:
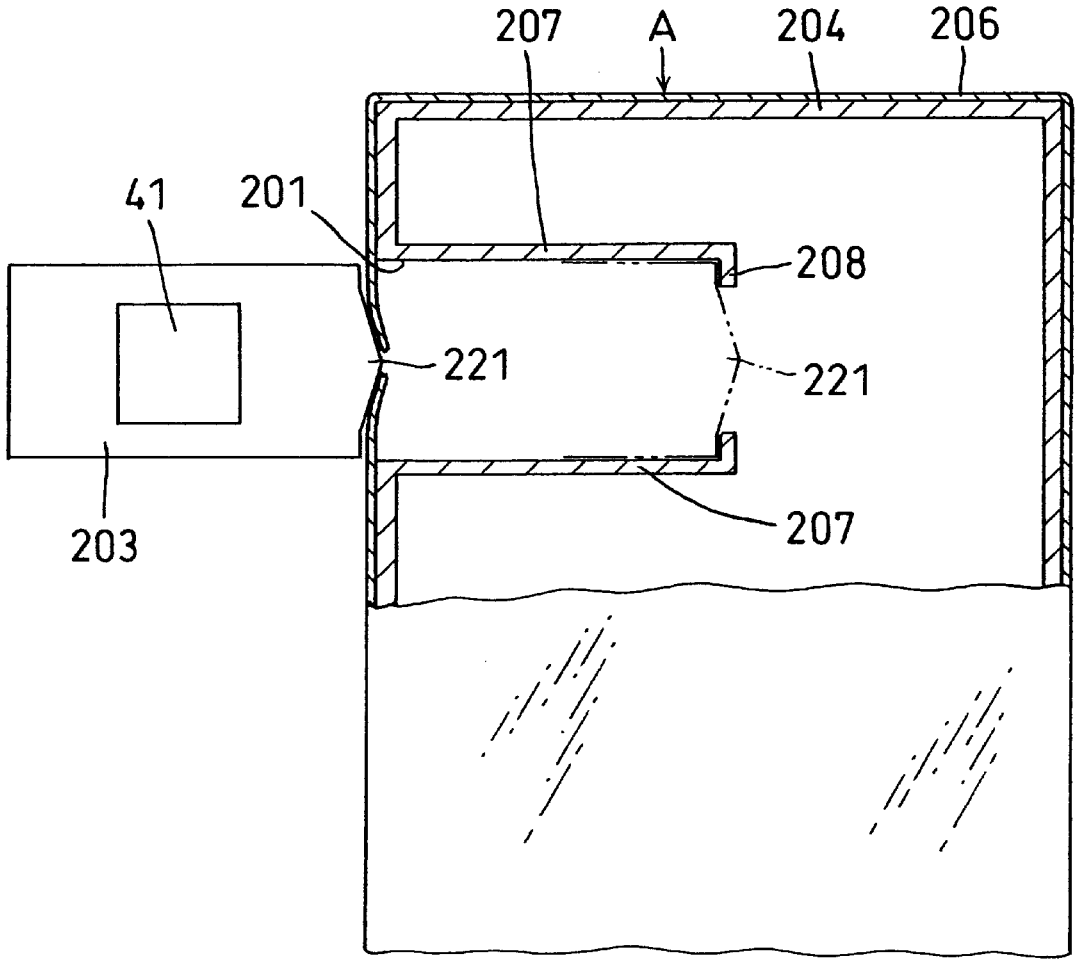
FIG. 69 is a longitudinal sectional front view showing a state in which the antitheft implement is used.

According to a thirteenth embodiment of the present invention, as shown in FIG. 66, an insert distal end of the insert member 203 is provided with a pointed portion 221 for breaking-through a packaging material, for example, the cover 206 formed of a soft film.

The pointed portion 221 is projected into V-letter shape, and the shape is not limited.

With the above construction, even if the antitheft object commodity A is packaged by a packaging material, the packaging material is broken through by the pointed portion 221, and thereby, it is possible to readily insert the insert member 203 into the antitheft object commodity A from the through window 201.

In this case, the usage and effect of the insert member 203 attached with the tag 41 are the same as the eleventh embodiment; therefore, the details are omitted.

Figure 70:
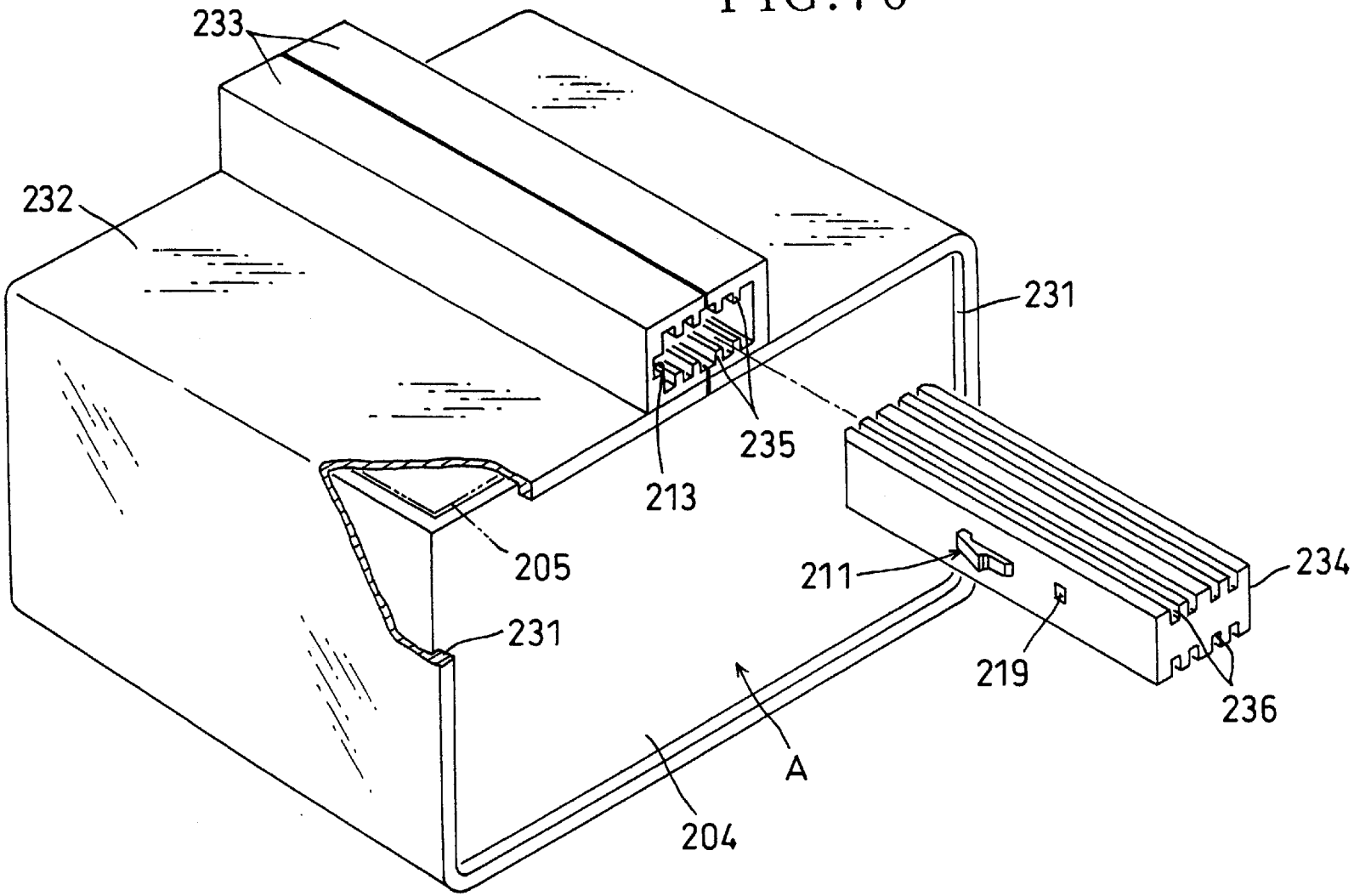
FIG. 70 is a perspective view showing an antitheft implement according to a fourteenth embodiment of the present invention.
Figure 71:
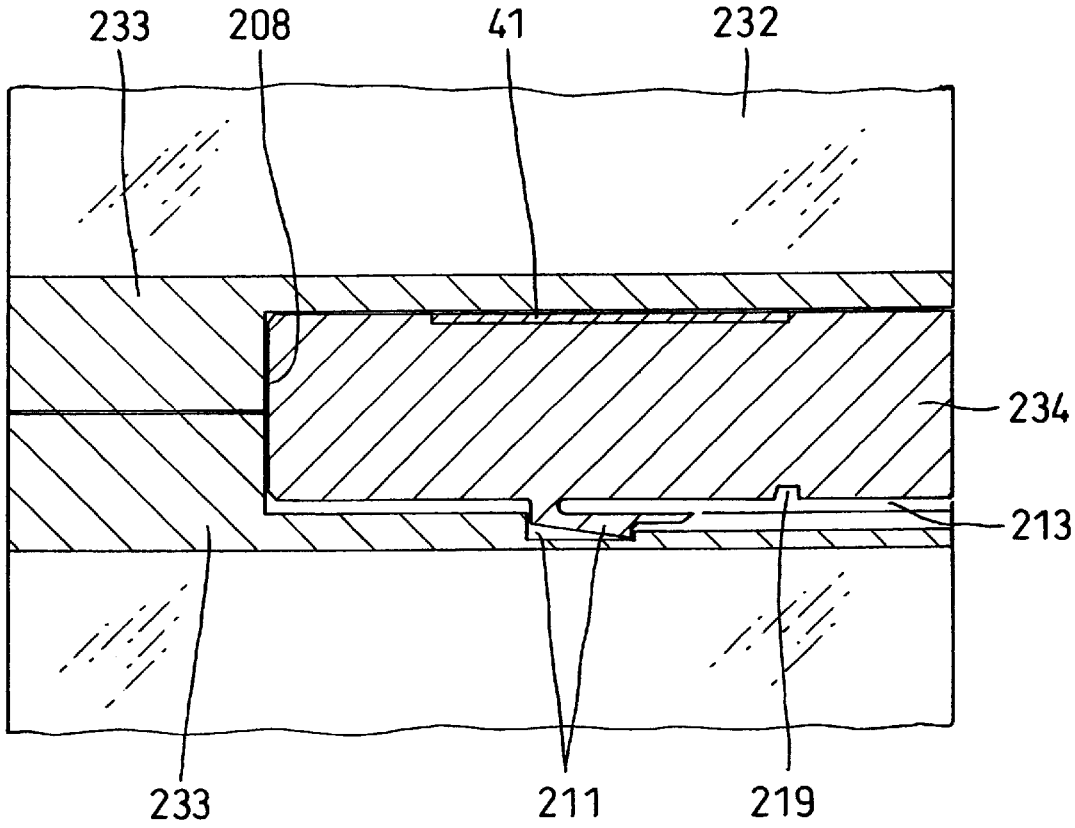
FIG. 71 is a transverse sectional plan view showing a state in which the antitheft implement is used.

According to a fourteenth embodiment of the present invention, as shown in FIG. 70 and FIG. 71, a cover case 232 is covered on an outer side of the antitheft object commodity A so that the antitheft object commodity A is prevented from being drawn out of the case via a proper blocking means 231, and a guide rails 233 contacting and facing each other are provided on both side edges of the cover case 232.

A slider 234 is inserted into the guide rails 233 and 233 arranged in parallel so as to be freely drawn out and inserted in a come-off preventive state.

The above cover case 232 may be any other form so long as the outer side of the commodity A is covered by a resin sheet or the like.

Of course, the cover case 232 is formed of a transparent sheet, and thereby, it is possible to visibly confirm the commodity A.

Moreover, the blocking means 231 is provided so that the commodity A is not drawn out of the cover case 232. The following means is employed as the blocking means; more specifically, a protrusion formed on an inner surface of both side edges of the cover case 232 is abutted against the both end faces of the commodity A.

The guide rails 233 and 233 are provided in a manner of integrally fixing a groove member or an independent member by a bonding agent, and the slider 234 is inserted into the guide rails 233 and 233 arranged in parallel. Moreover, it is possible to cover a groove type slider 234 on an outer side of the guide rails 233. The slider 234 and the guide rails 233 are engaged in a manner that a protrusion 235 is engaged with a groove 236, and then, the slider 234 is inserted, and thereby, the guide rails 233 and 233 are maintained at a parallel arranged state.

Either the above slider 234 or the cover case 232 is provided with the same tag 41 as the eleventh embodiment.

With the above construction, in the case where the antitheft object commodity A is taken out of the shop, it is possible to detect a theft of the commodity by the tag 41 of the slider 234.

In selling the commodity A, a salesperson draws out the slider 234, and then, removes the cover case 232.

The drawn slider 234 and the removed cover case 232 are left at a shop side.

The blocking means 211 is provided between the slider 234 and the guide rails 233. The blocking means 211 is pushed back when the slider 234 is inserted in the same manner as the eleventh embodiment, and then, when the insert of the slider 234 is completed, an engagement is made. The guide rails 233 are formed with the space 213 for inserting the releasing tool 212 for releasing an engagement of the blocking means 211.

By doing so, in displaying, the slider 234 is prevented from being drawn out, and at a shop side, the releasing tool 212 for drawing out the slider 234.

The construction and effect of the blocking means 211, the space 213 and the releasing tool 212 are the same as the eleventh embodiment; therefore, the details are omitted.

Moreover, the slider 234 and the releasing tool 212 are provided with a blocking portion 219 which is engaged when releasing an engagement of the blocking means 211 so that the releasing tool 212 and the slider 234 are drawn together.

Whereby it is possible to draw out the slider 234 simultaneously when the releasing tool 212 is drawn out.

The construction and effect of the blocking portion 219 are the same as the eleventh embodiment; therefore, the details are omitted.

Figure 72:
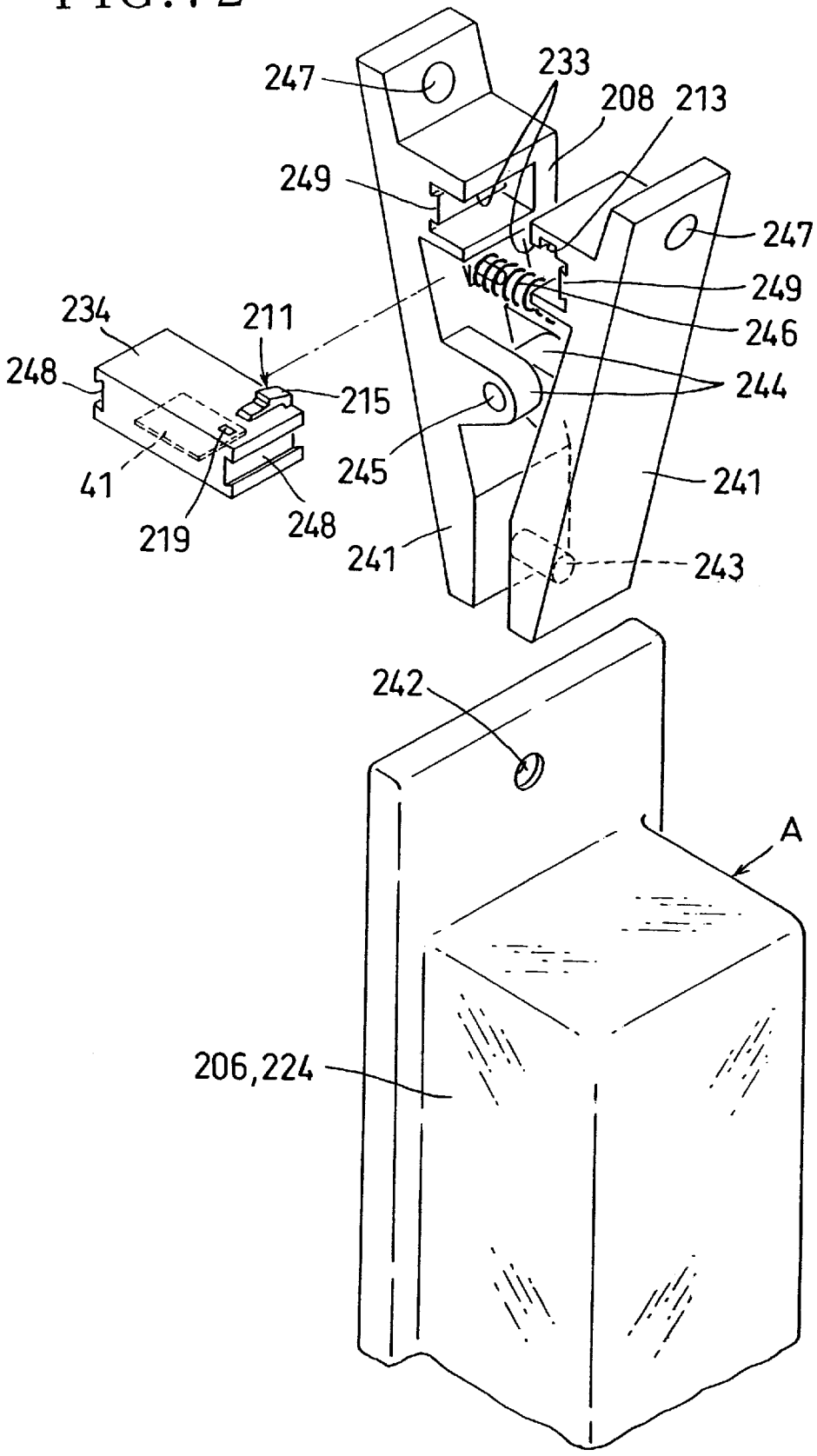
FIG. 72 is a perspective view showing an antitheft implement according to a fifteenth embodiment of the present invention.
Figure 73:
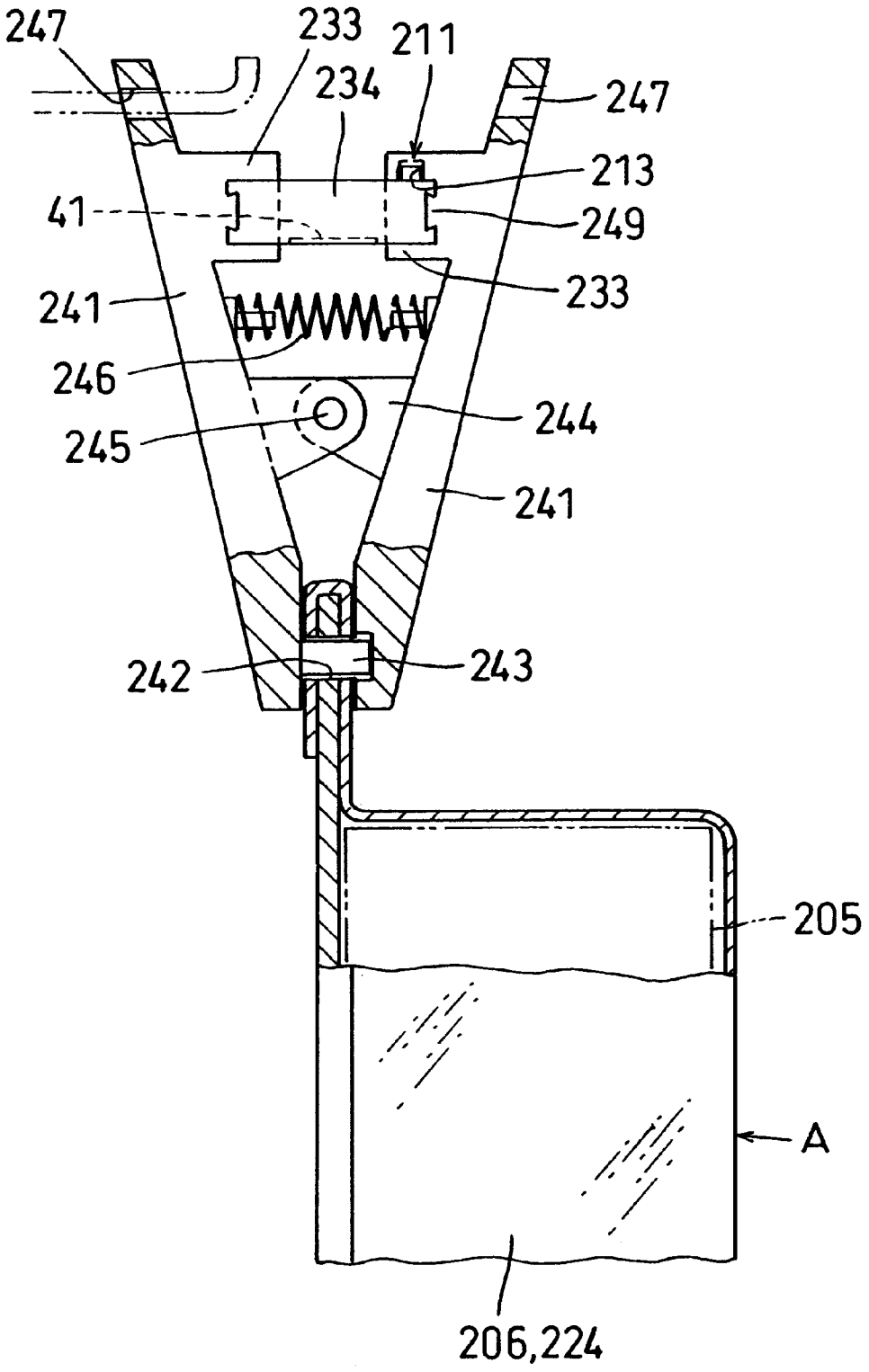
FIG. 73 is a side view partly in section showing a state in which the antitheft implement is used.
Figure 74:
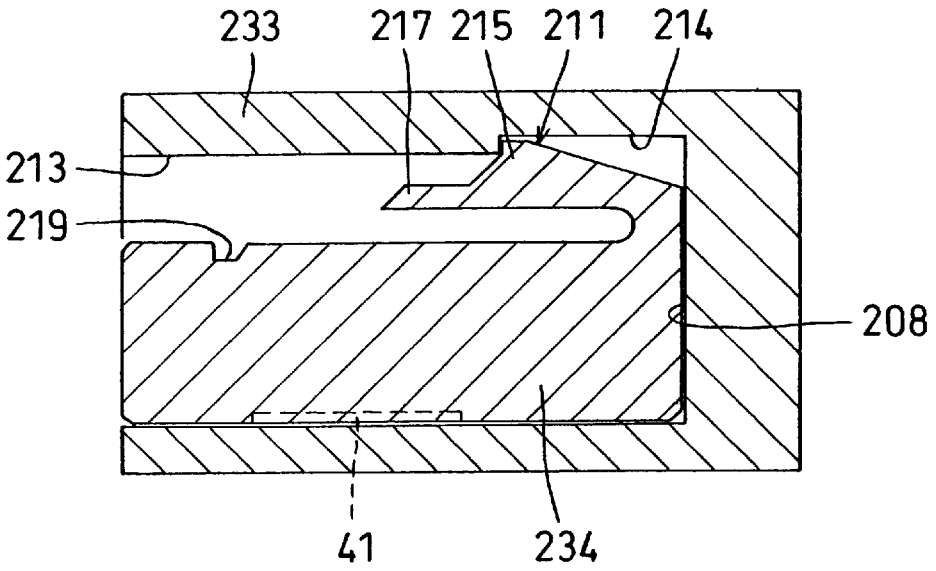
FIG. 74 is a longitudinal sectional front view showing principal parts of the antitheft implement.

According to a fifteenth embodiment of the present invention, as shown in FIG. 72 to FIG. 74, a pair of pinch plates 241 and 241 have a rotating fulcrum on the midway, and at least one of the pinch plates 241 is provided with a hooking protrusion 243 which is fitted into a hooking hole 242 such as a hole or recess portion of the antitheft object commodity A.

The hooking protrusion 243 is formed in the following manner; more specifically, one of the pinch plates 241 is provided with a projected shaft which is fitted into a hole constituting the hooking portion 242, and the other pinch plate 241 is formed with a recess portion in which the projected shaft is fitted. The pinch plate 241 may be hooked on the commodity A by other means.

The rotating fulcrum is provided in a manner that a support shaft 245 penetrates through a plurality of projected portions 244 as shown in FIG. 72. The rotating fulcrum may have other constructions.

Both pinch plates 241 and 241 are respectively provided with the guide rails 233 and 233 at their terminal end portions in a state that they face each other. The slider 234 is inserted into the guide rails 233 and 233 so as to be freely drawn and inserted in a blocking state, and then, the inserted slider 234 prevents the distal end side of both pinch plates 241 from being separated, so that the pinch plates 241 can be kept at a blocking state with respect to the commodity A.

The slider 234 is attached with the same tag 41 as the eleventh embodiment.

The means for attaching the tag 41 is the same as the eleventh embodiment, and the guide rails 233 and the slider 234 are the same as the fourteenth embodiment; therefore, their details are omitted.

In FIG. 72, a reference numeral 246 denotes a spring for giving a rotation to a direction of closing the distal ends of the pinch plates 241, and a reference numeral 247 denotes a hook hole.

With the above construction, the antitheft object commodity A is displayed in a state of being suspended via the pinch plates 241, and thereby, it is possible to prevent the antitheft object commodity A from being removed from the pinch plates 241 by the slider 234 inserted into the guide rails 233 in displaying.

On the other hand, in the case where the antitheft object commodity A is taken out of a shop, it is possible to detect a theft of the commodity by the tag 41 attached to the slider 234.

In selling the antitheft object commodity A, the slider 234 is drawn out of the guide rails 233, and then, the pinch plates 241 are removed while the removed slider 234 and the pinch plates 241 are left at a shop side.

The same blocking means 211 as the eleventh embodiment is provide on each facing side between the slider 234 and the guide rails 233. The pinch plates 241 are formed with the insert space 213 for inserting the same releasing tool 212 as the eleventh embodiment at a surface facing the blocking means 211.

Whereby it is possible to prevent the slider 234 from being drawn out in displaying, and a shop side uses the releasing tool 212 for drawing out the slider 234.

The construction and effect of the above blocking means 211, the space 213 and the releasing tool 212 are the same as the eleventh embodiment; therefore, the details are omitted.

The inserted slider 234 engages with the guide rails 233; for example, the engagement may be performed in a manner that a dovetail groove 248 engages with a protrusion 249.

Of course, the same engaging portion 219 as the eleventh embodiment is provided so that the releasing tool 212 and the slider 234 are drawn out together.

Figure 76:
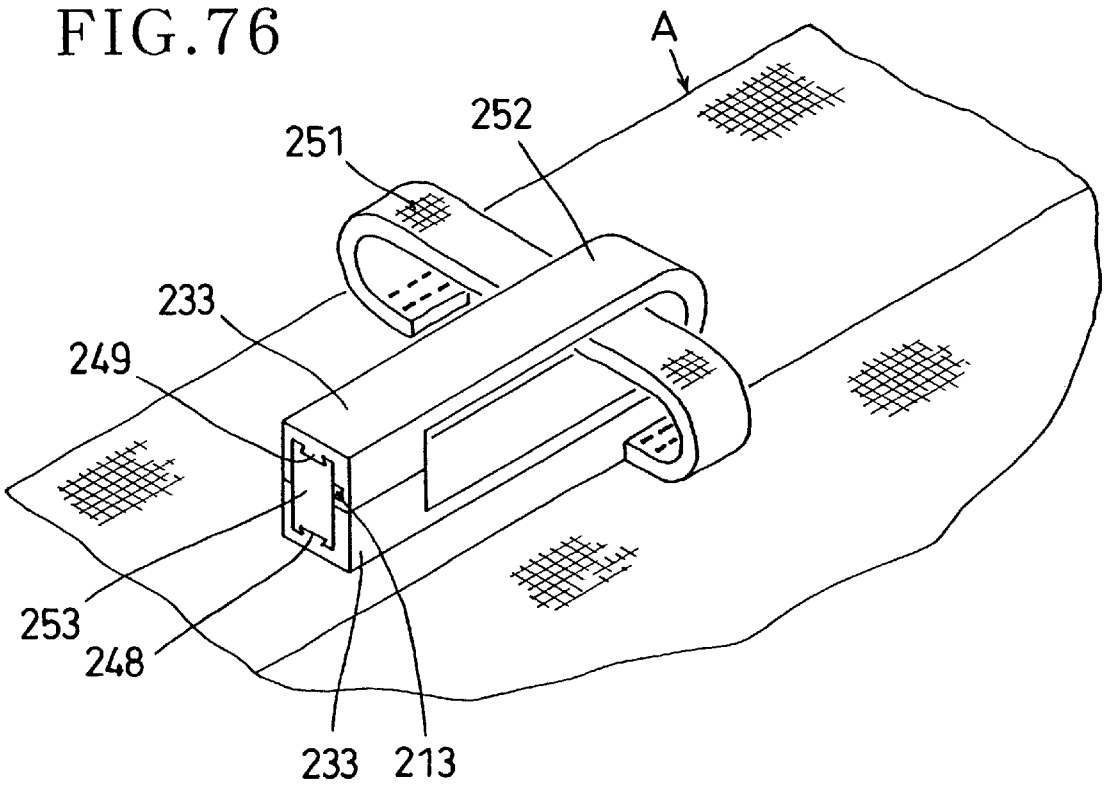
FIG. 76 is a perspective view showing a state in which the antitheft implement is used.
Figure 75:
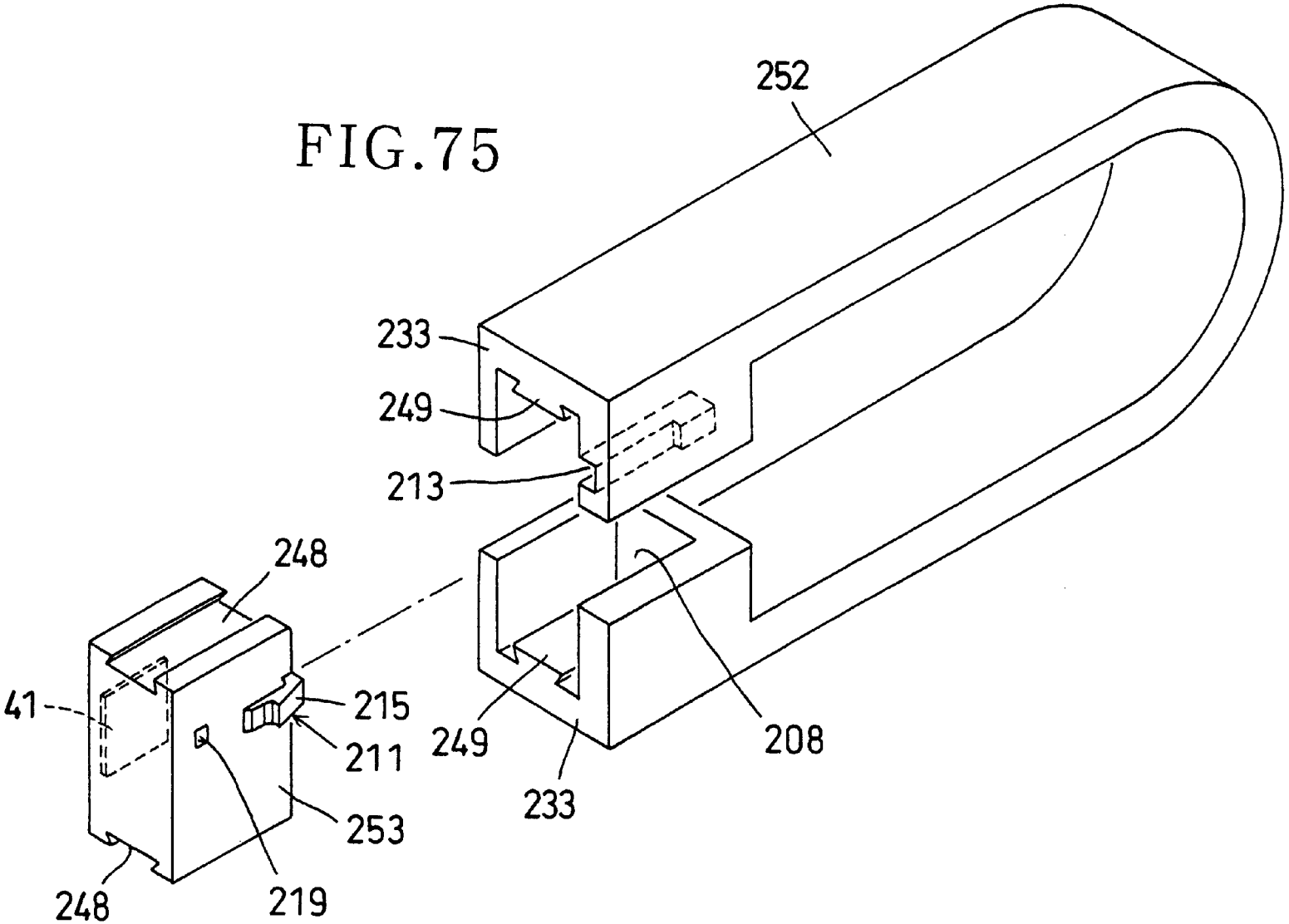
FIG. 75 is a perspective view showing an antitheft implement according to a sixteenth embodiment of the present invention.

According to a sixteenth embodiment of the present invention, as shown in FIG. 75 and FIG. 76, an insert member 252 inserting through a hole of the commodity A and an insert portion 251 is provided with the guide rails 233 and 233 at its both end portions. A fitting member 253 is freely inserted into and drawn out of the guide rails 233 and 233 in a blocking state for keeping a parallel arrangement of these guide rails 233.

The fitting member 253 is provided with the same tag 41 as the eleventh embodiment.

The insert portion 251 shows a belt loop of clothes, e.g., trousers. A folded band and string-like insert portion 252 is inserted through a button hole of clothes.

The guide rails 233 and 233 have the same structure as the fourteenth and fifteenth embodiments. Other guide rails may be used.

In the fitting member 253, the dovetail groove 248 engages with the protrusion 249, and thereby, the guide rails 233 and 233 are kept at a parallel arrangement state with respect to the fitting member 253. The fitting method is not limited to the above inside fitting, and an outer fitting method may be employed.

By doing so, in displaying the commodity A, the insert member 252 is inserted through the insert portion 251, and then, the fitting member 253 is fitted into the guide rails 233 and 233, and thereby, in the case where the commodity is taken out of a shop, it is possible to detect a theft of the commodity by the tag 41.

In selling, the fitting member 253 is drawn out, and the insert member 252 is removed, and thus, the fitting member 253 and the insert member 252 are left at a shop side, and are reused.

The same blocking means 211 as the eleventh embodiment is provided on a facing side between the guide rail 233 and the fitting member 253, and the fitting member 252 is provided with the space 213 for inserting the releasing tool 212 like the eleventh embodiment.

Whereby it is possible to prevent the fitting member 253 from being drawn out by persons other than salesperson.

The construction and effect of the above blocking means 211, the space 213 and the releasing tool 212 are the same as the eleventh embodiment; therefore, the details are omitted.

Of course, the same engaging portion 219 as the eleventh embodiment is provided, and thereby, the releasing tool 212 and the fitting member 253 can be drawn out together.

According to a seventeenth embodiment of the present invention, as shown in FIG. 77 to FIG. 80, a case 265 is composed of a box body 262 having an opening portion 261 for taking in and out a commodity at its one side surface, and a cover body 264 for opening and closing the opening portion 261 via a hinge 263 on one edge side of the opening portion 261.

The box body 262 is formed with an outer peripheral wall 266 at its each side edge, and the cover body 264 is formed with an inner peripheral wall 267 fitted inside the outer peripheral wall 266 at side edges other than the hinge 263. The structure is not limited to the above description.

An antitheft locking means 268 is provided on a side edge opposite to the hinge 263 between the box body 262 and the cover body 264, and an engagement of the locking means 268 is released by a salesperson on a shop side.

The antitheft locking means 268 is constructed in a manner that the box body 262 and the cover body 264 are provided with parallel arranged L-letter guide rails 269, and an H-type slider 270 engaging with both guide rails 269 is inserted into the guide rails 269, and thus, a locking state is kept. The slider is fitted into an outer side of the guide rails, and thus, a locking state is kept.

By doing so, when the slider 270 is inserted, the cover body 264 is hesitated to be opened; therefore, this serves to perform an antitheft effect. Moreover, as the eleventh embodiment, the slider 270 is provided with the tag 41, and thereby, in the case where a commodity is taken out of a shop, a theft of a commodity is detected by the tag 41. In addition, like the eleventh embodiment, the blocking means and the method of releasing an engagement of the blocking means by the releasing tool are employed, and thereby, it is possible to further improve an antitheft effect.

In order to prevent a fingertip from being caught, a chamfered portion 272 is provided on each corner of both side edges having no hinge 263 and guide rails 269 of at least one of the box body 262 and the cover body 264.

Figure 77:
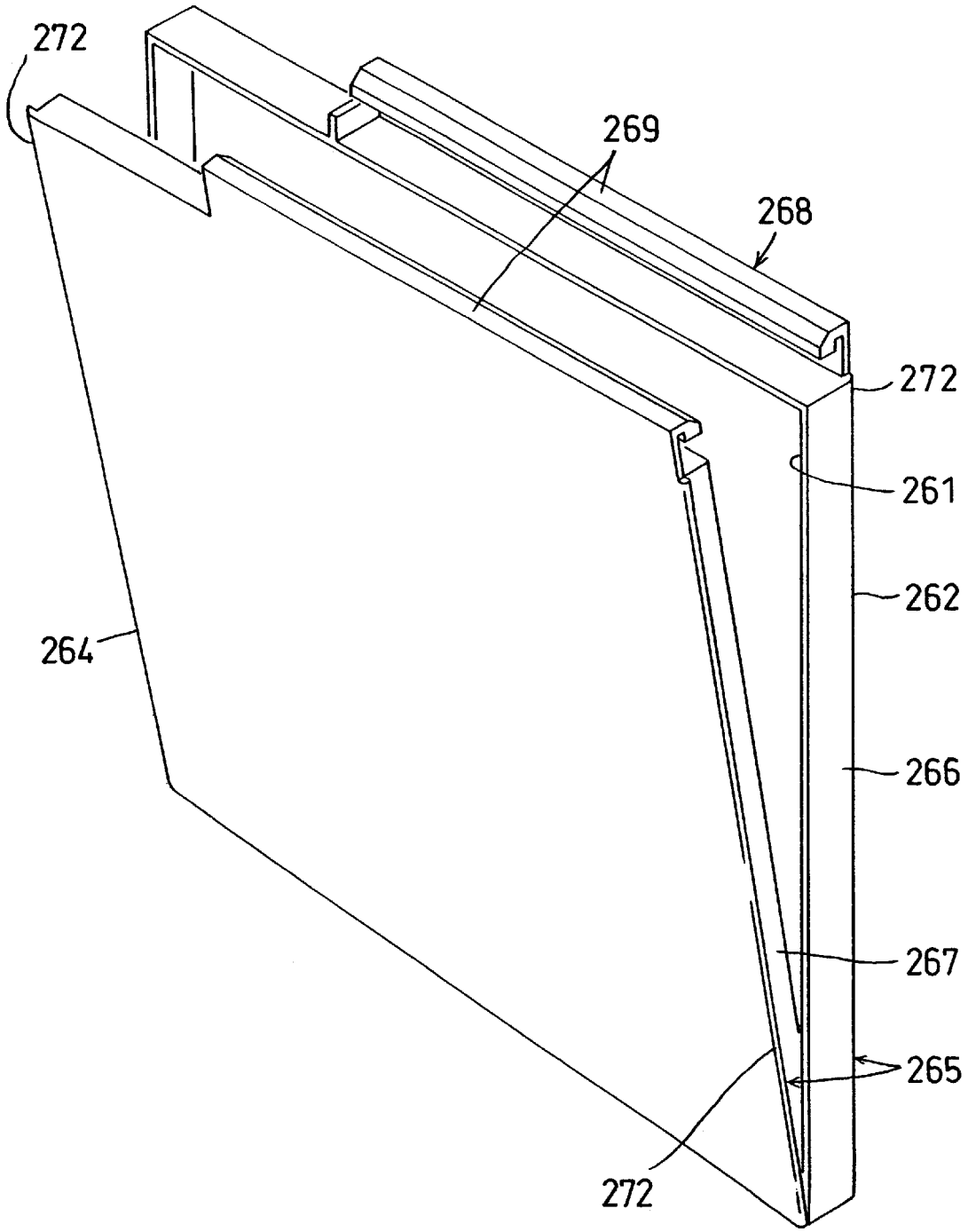
FIG. 77 is a perspective view showing an antitheft implement according to a seventeenth embodiment of the present invention.
Figure 78:
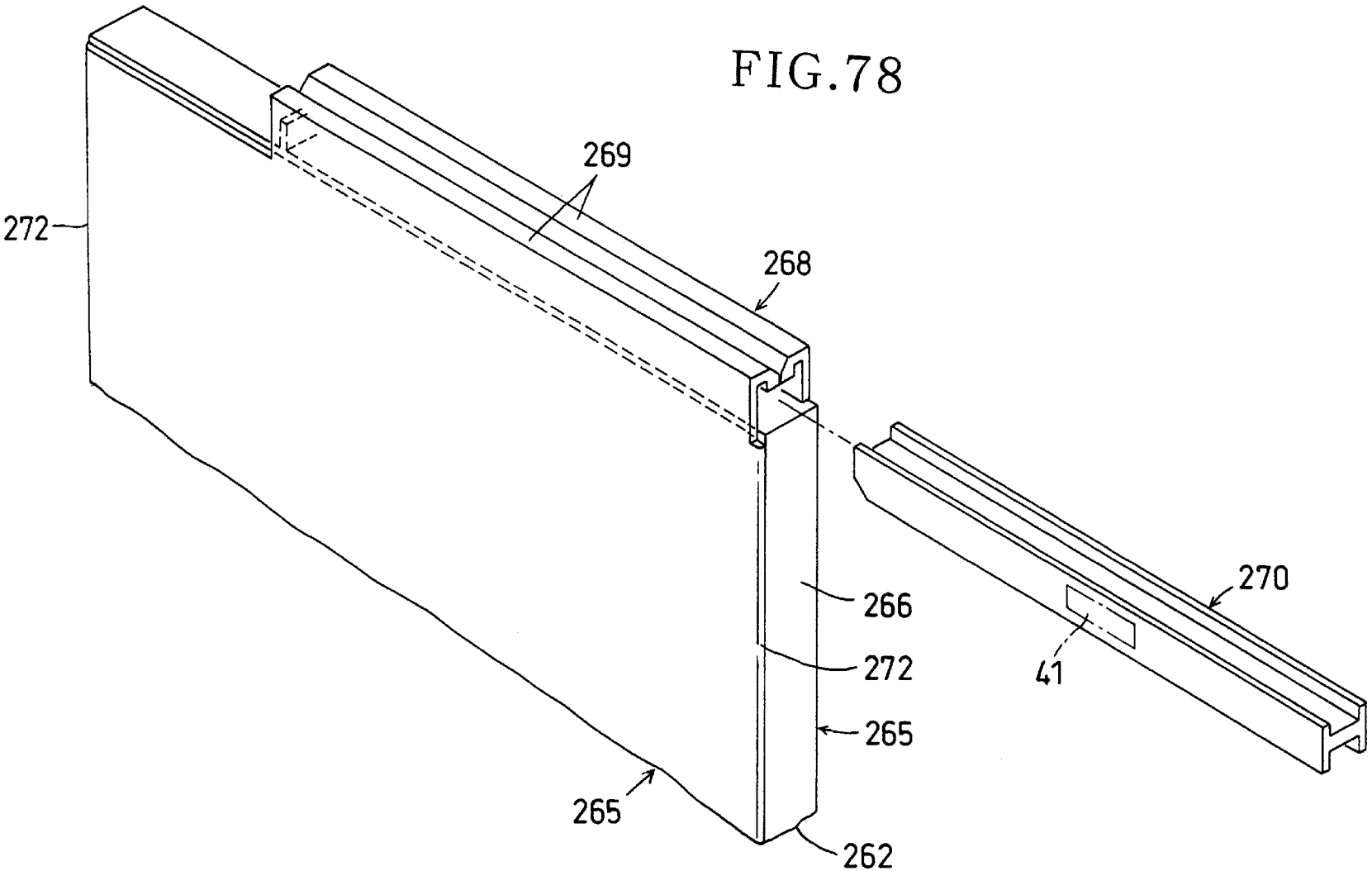
FIG. 78 is a perspective view showing principal parts of the antitheft implement.
Figure 79:
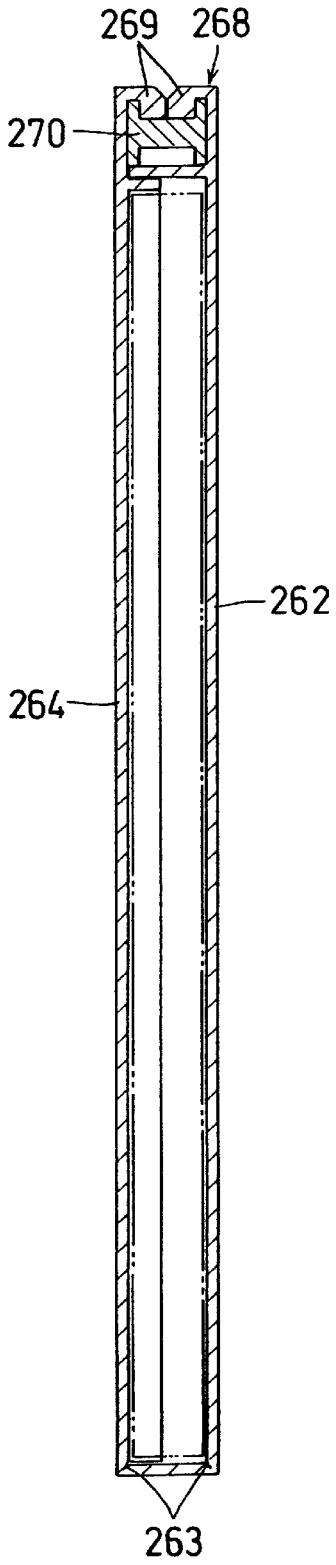
FIG. 79 is a longitudinal sectional side view showing the antitheft implement.
Figure 80:
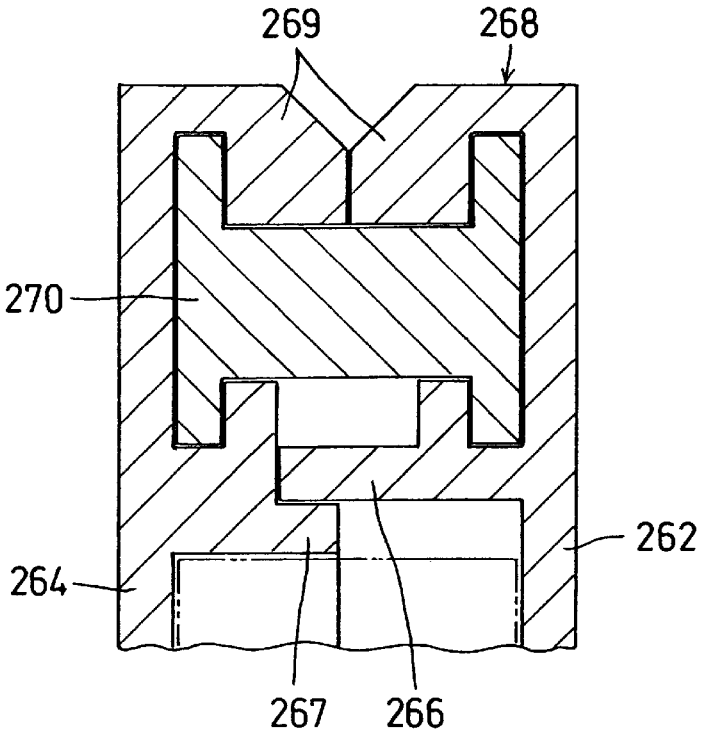
FIG. 80 is an enlarged longitudinal sectional side view showing the principal parts.
Figure 81:
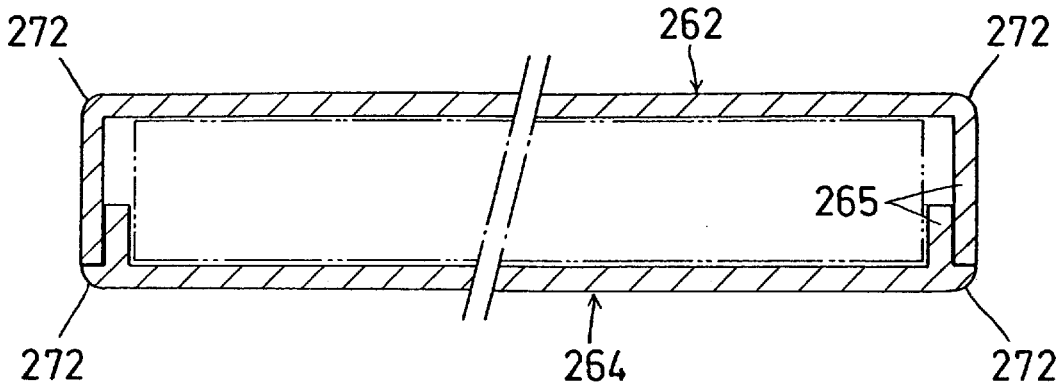
FIG. 81 is an enlarged transverse sectional plan view showing the principal parts.

The above chamfered portion 272 may be provided on one of the box body 262 and the cover body 264 shown in FIG. 77, and is not limited to both of them.

Figure 82:
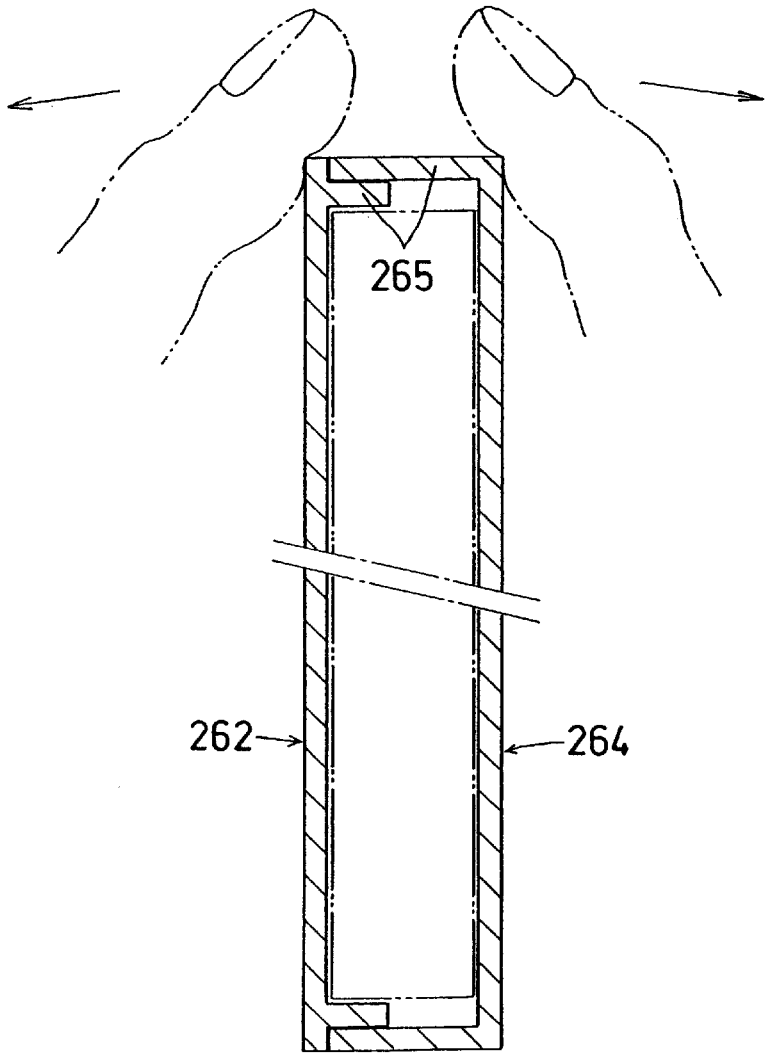

By doing so, it is possible to prevent a received commodity from being taken out; more specifically, even if a person pushes his fingertip against both corner edges of the cover body 264 and the box body 262, and then, pulls the box body 262 and the cover body 264 to a mutually reverse direction, the fingertip slips by the chamfered portion 272; for this reason, the cover body 264 and the box body 262 are not forcibly opened. Namely, in the case where no chamfered portion is provided on the corner edge, as shown in FIG. 82, the fingertip is caught onto the corner edge of the cover body and the box body.

As described above, in the antitheft implement according to the eleventh to seventeenth embodiments, in the case where the commodity is taken out of a shop, the commodity thus taken out is detected by the insert member, the slider and the tag of the fitting member, and thereby, it is possible to prevent a theft of the antitheft object commodity.

In selling, the insert member attached with the tag, the slider and the fitting member are removed, and then, are left at a shop side; therefore, these members can be reused, and there is no need of attaching a tag for each commodity, and shielding the tag.

Further, the insert member attached with the tag, the slider and the fitting member are not removed in places other than the shop unless the blocking means and the releasing tool are used; therefore, it is possible to further improve an antitheft effect.

Furthermore, the chamfered portions prevent the case from being forcibly opened; therefore, it is possible to prevent the commodity from being taken out of the case.

What is claimed is:

1. A commodity antitheft implement for use with a commodity, said commodity antitheft implement comprising:

a case including:

a box body having: a side, an opening portion at said side of said box body for taking in and out the commodity, a lower edge side, and an upper edge;

a hinge mounted on said lower edge side of said box body;

a cover body for opening and closing said opening portion of said box body via said hinge, said cover body having an upper edge;

parallel arranged fitting grooves, provided on said upper edge of said cover body and said upper edge of said box body, respectively;

a slider freely movable to be inserted into and drawn out of said fitting grooves, and closing and locking said box body and said cover body when inserted into said grooves;

wherein any of said box body, said cover body, and said fitting grooves is provided with blocking means for blocking said slider, when inserted, from being drawn out of said fitting grooves.

2. The commodity antitheft implement as claimed in claim 1, wherein an insert distal end of said slider is provided with a breaking-through pointed portion.

3. A commodity antitheft implement for use with a commodity, said commodity antitheft implement comprising:

a case including:

a box body having: a side, an opening portion at said side of said box body for taking in and out the commodity, a lower edge side, and an upper edge;

a hinge mounted on said lower edge side of said box body;

a cover body for opening and closing said opening portion of said box body via said hinge, said cover body having an upper edge; and a facing side;

parallel arranged fitting grooves, provided on said upper edge of said cover body and said upper edge of said box body, respectively, wherein said facing side of said case is between said case and said fitting grooves;

a slider freely movable to be inserted into and drawn out of said fitting grooves, and closing and locking said box body and said cover body when inserted into said grooves;

blocking means provided in said slider or said facing side of said case so that said blocking means is pushed back when said slider is inserted and when insertion is completed said blocking means is engaged;

an engagement releasing tool;

a space, facing said blocking means, for accepting insertion of said engagement releasing tool, wherein said slider and said engagement releasing tool when inserted overlap each other; and engagement means for making engagement when insertion of said engagement releasing tool is completed.

4. The commodity antitheft implement as claimed in claim 3, wherein said slider is provided with an antitheft tag.

5. A commodity antitheft implement for use with a commodity, said commodity antitheft implement comprising:

a case including:

a box body having: a side, an opening portion at said side of said box body for taking in and out the commodity, a lower edge side, and an upper edge;

a hinge mounted on said lower edge side of said box body;

a cover body for opening and closing said opening portion of said box body via said hinge, said cover body having an upper edge; and a facing side;

parallel arranged fitting grooves, provided on said upper edge of said cover body and said upper edge of said box body, respectively, wherein said facing side of said case is between said case and said fitting grooves;

a slider freely movable to be inserted into and drawn out of said fitting grooves, and closing and locking said box body and said cover body when inserted into said grooves, said slider including a fingertip hooking portion projecting from said slider;

blocking means provided in said slider or said facing side of said case so that said blocking means is pushed back when said slider is inserted and when insertion is completed said blocking means is engaged;

an engagement releasing tool;

a first space, facing said blocking means, for accepting insertion of said engagement releasing tool; and a second space provided between said parallel fitting grooves, wherein said fingertip hooking portion is fitted into said second space.

6. A commodity antitheft implement for use with a commodity, said commodity antitheft implement comprising:

a case;

guide means, provided in said case, for receiving the commodity;

a slider insertable into said guide means so as to be freely inserted into said guide means and freely drawn out of said guide means, said slider having a facing side that faces said case;

blocking means provided in said case or said facing side of said slider so that said blocking means is pushed back when said slider is inserted and when insertion is completed said blocking means is engaged.

7. A commodity antitheft implement for use with a commodity, said commodity antitheft implement comprising:

a case;

guide means, provided in said case, for receiving the commodity;

a slider insertable into said guide means so as to be freely inserted into said guide means and freely drawn out of said guide means, said slider having a facing side that faces said case;

blocking means provided in said case or said facing side of said slider so that said blocking means is pushed back when said slider is inserted and when insertion is completed said blocking means is engaged;

an engagement releasing tool;

a space, facing said blocking means, for accepting insertion of said engagement releasing tool; and an antitheft tag attached to said slider.

8. The commodity antitheft implement as claimed in claim 7, wherein said antitheft tag is embedded in said slider.

9. A commodity antitheft implement for use with a commodity, said commodity antitheft implement comprising:

a case having a side, and a front opening portion at said side of said case for taking in and out the commodity;

a guide provided in said case;

a slider insertable into said guide of said case so as to be freely inserted into said guide and freely drawn out of said guide, said slider having a facing side that faces said case;

blocking means provided in said case or said facing side of said slider so that said blocking means is pushed back when said slider is inserted and when insertion is completed said blocking means is engaged.

10. A commodity antitheft implement for use with a commodity, said commodity antitheft implement comprising:

a mounting member including a mounting device and a guide, said mounting member to be attached to the commodity via said mounting device;

a slider insertable into said guide so as to be freely inserted into said guide and freely drawn out of said guide, said slider having a facing side that faces said guide;

blocking means provided in said mounting member or said facing side of said slider so that said blocking means is pushed back when said slider is inserted and when insertion is completed said blocking means is engaged;

an engagement releasing tool;

a space, facing said blocking means, for accepting insertion of said engagement releasing tool; and an antitheft tag attached to said slider.

11. A slider device for use with an antitheft case, said slider comprising:

a slider insertable into the antitheft case so as to be freely inserted into the antitheft case and freely drawn out of the antitheft case, said slider including an antitheft tag;

blocking means provided in said slider so that said blocking means is pushed back when said slider is inserted and when insertion is completed said blocking means is engaged;

an engagement releasing tool; and a space, facing said blocking means, for accepting insertion of said engagement releasing tool.

12. An antitheft implement for use with a commodity, said antitheft implement comprising:

a box body having: a side, an opening portion at said side of said box body for taking in and out the commodity;

a hinge mounted on one side of said opening portion of said box body;

a cover body for opening and closing said opening portion of said box body via said hinge;

a parallel arranged guide means, provided on sides of said cover body and said box body opposite said hinge;

a slider insertable into said guide means so as to be freely inserted into said guide means and freely drawn out of said guide means;

a case formed of said box body, said cover body, said guide means, and said slider; and a chamfered portion for preventing a fingertip from being caught, provided on a corner edge of said sides of said cover body and box body and said guide means.

* * * * *